US006679052B2

(12) United States Patent
Nakatani et al.

(10) Patent No.: US 6,679,052 B2
(45) Date of Patent: Jan. 20, 2004

(54) EMISSION CONTROL APPARATUS

(75) Inventors: Koichiro Nakatani, Susono (JP); Shinya Hirota, Susono (JP)

(73) Assignee: Toyota Jidosha Kaisha, Toyota (JP)

( * ) Notice: Subject to any disclaimer, the term of this patent is extended or adjusted under 35 U.S.C. 154(b) by 7 days.

(21) Appl. No.: 10/201,719

(22) Filed: Jul. 24, 2002

(65) Prior Publication Data

US 2003/0029165 A1 Feb. 13, 2003

(30) Foreign Application Priority Data

Jul. 31, 2001 (JP) ..... 2001-231578
Sep. 4, 2001 (JP) ..... 2001-267652

(51) Int. Cl.[7] ..... F01N 3/00

(52) U.S. Cl. ..... 60/297; 60/286; 60/287; 60/288; 60/296; 60/311

(58) Field of Search ..... 60/286, 287, 288, 60/296, 297, 311; 55/DIG. 30, 483, 484

(56) References Cited

U.S. PATENT DOCUMENTS 2,946,651 A * 7/1960 Houdry ..... 423/212
3,796,546 A * 3/1974 Poullot ..... 422/171
4,462,379 A * 7/1984 Tsuge et al. ..... 60/278
4,485,622 A * 12/1984 Takagi et al. ..... 60/296
4,515,758 A * 5/1985 Domesle et al. ..... 423/213.2
4,916,897 A * 4/1990 Hayashi et al. ..... 60/286
5,162,287 A * 11/1992 Yoshimoto et al. ..... 502/439
5,738,832 A * 4/1998 Dogahara et al. ..... 422/171
5,768,888 A * 6/1998 Matros et al. ..... 60/274
5,884,474 A * 3/1999 Topsøe ..... 60/274
6,314,722 B1 * 11/2001 Matros et al. ..... 60/274
6,546,721 B2 * 4/2003 Hirota et al. ..... 60/297

FOREIGN PATENT DOCUMENTS

JP A 7-189656 7/1995
JP B2 7-106290 11/1995

OTHER PUBLICATIONS

U.S. patent application Ser. No. 09/817,187, Hirota et al., filed Mar. 27, 2001.
U.S. patent application Ser. No. 10/088,477, Hirota et al., filed Mar. 20, 2002.

* cited by examiner

*Primary Examiner*—Thomas Denion
*Assistant Examiner*—Diem Tran
(74) *Attorney, Agent, or Firm*—Oliff & Berridge, PLC

(57) ABSTRACT

An emission control unit includes a trunk passage, a loop passage connected to the trunk passage, and a path change portion that is provided in a connecting portion between the trunk passage and the loop passage and that includes a switching valve for changing the path of exhaust gas. The loop passage is provided with a first emission control portion for purifying NOx and carbon-containing particles present in exhaust gas. A second emission control portion for purifying NOx present in exhaust gas is provided in a downstream-side partial trunk passage. The emission control unit is equipped with a reducer injection nozzle for injecting into a first partial loop passage a reducing agent for recovering the emission control functions of the two emission control portions.

43 Claims, 41 Drawing Sheets

RECOVERY OF FIRST AND SECOND EMISSION CONTROL PORTIONS

RECOVERY OF SECOND EMISSION CONTROL PORTION

RECOVERY OF FIRST AND SECOND EMISSION CONTROL PORTIONS

RECOVERY OF SECOND EMISSION CONTROL PORTION

EMISSION CONTROL APPARATUS

INCORPORATION BY REFERENCE

The disclosure of Japanese Patent Application No. 2001-231578 filed on Jul. 31, 2001 and No. 2001 filed on Sep. 4, 2001, including the specifications, drawings and abstracts thereof, is incorporated herein by reference in its entirety.

BACKGROUND OF THE INVENTION

1. Field of the Invention

The invention relates to a technology for controlling emissions from an internal combustion engine.

2. Description of the Related Art

Emissions from diesel engines normally include particulate substances such as black smoke (soot) and the like, nitrogen oxides, etc. Lately, there is a strong demand for the control of air pollutant emissions. Therefore, in general, diesel engines are equipped with emission control apparatuses for purifying exhaust emissions.

An emission control apparatus described in Japanese Patent Application Laid-Open No. 7-189656 employs a filter (trapper) for occluding particulate substances in exhaust gas. When exhaust particulate substances are occluded and deposit in the filter, the emission control function of the filter is inhibited, so that it is necessary to recover the emission control function of the filter. The filter is loaded with an oxidation catalyst. Exhaust gas flows into the filter alternately via its opposite side surfaces. The emission control function of the filter is recovered through combustion of particulate substances depending on the exhaust gas temperature. A related-art technology for recovering the filter's emission control function is disclosed in which a filter is loaded with a platinum-group metal and an alkaline-earth metal oxide, and particulate substances occluded by the filter are burned through the use of the temperature of exhaust gas from a diesel engine (in Japanese Examined Patent Application Publication No. 7-106290).

However, the above-described apparatus throttles the intake to the diesel engine in order to raise the exhaust gas temperature. Therefore, during the operation of recovering the emission control function, the operational condition of the diesel engine is forcibly changed. That is, there are cases where the emission control function of the filter cannot be sufficiently recovered in accordance with the engine operation condition required at the time of execution of a normal operation.

The foregoing problem arises not only in the case where the emission control apparatus purifies particulate substances in exhaust gas, but also in the case where the apparatus purifies other air pollutants.

The problem is not limited to diesel engines, but is common to internal combustion engines including, for example, generally termed direction injection gasoline engines in which gasoline is directly injected into the combustion chambers.

SUMMARY OF THE INVENTION

The invention has been accomplished in order to solve the aforementioned problems of the related art. It is an object of the invention to provide a technology capable of recovering the emission control function of an emission control apparatus independently of the operational condition of the internal combustion engine.

Described below will be means for achieving the object, and operation and advantages of the means.

In accordance with an aspect of the invention, an emission control apparatus that is applied to an internal combustion engine having a combustion chamber, and that controls emissions discharged from the combustion chamber, includes: an exhaust passage that conveys an exhaust gas discharged from the combustion chamber, and that includes a trunk passage, and a loop passage having a first partial loop passage and a second partial loop passage that branch from the trunk passage; and a path change portion that is provided in a connecting portion between the trunk passage and the loop passage, and that includes a switching valve that is set in a first state where exhaust gas in the loop passage is caused to flow through the first partial loop passage and the second partial loop passage in that order, and is set in a second state where exhaust gas in the loop passage is caused to flow through the second partial loop passage and the first partial loop passage in that order. A first emission control portion is provided in the loop passage, and has a filter that occludes and purifies at least a particulate substance present in the exhaust gas. One side face of the filter communicates with the first partial loop passage, and another side face of the filter communicates with the second partial loop passage. A second emission control portion is provided in the trunk passage downstream of the path change portion, and purifies at least a specific gaseous substance present in the exhaust gas. The emission control apparatus further includes: a recovery agent injection portion that injects a recovery agent for recovering an emission control function of the first emission control portion and an emission control function of the second emission control portion, into at least one of the first partial loop passage and the second partial loop passage; and a control portion that controls injection of the recovery agent.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the invention will be described hereinafter in the following order:

A. FIRST EMBODIMENT

A-1. OVERALL CONSTRUCTION

A-2. OVERVIEW OF COMBUSTION

A-3. EMISSION CONTROL UNIT

A-4. REVERSAL OF FLOW OF EXHAUST GAS IN EMISSION CONTROL UNIT

A-5. INJECTION OF REDUCER IN EMISSION CONTROL UNIT

A-6. INJECTION OF REDUCER AT THE TIME OF SWITCHING SWITCHING VALVE

A-7. INJECTION OF REDUCER IN ACCORDANCE WITH ENGINE OPERATION CONDITION

B. SECOND EMBODIMENT

C. THIRD EMBODIMENT

D. FOURTH EMBODIMENT

E. FIFTH EMBODIMENT

G. SEVENTH EMBODIMENT

H. EIGHTH EMBODIMENT

I. NINTH EMBODIMENT

J. TENTH EMBODIMENT

K. ELEVENTH EMBODIMENT

L. TWELFTH EMBODIMENT

M. MODIFICATIONS

A. FIRST EMBODIMENT

A-1. OVERALL CONSTRUCTION

Figure 1:
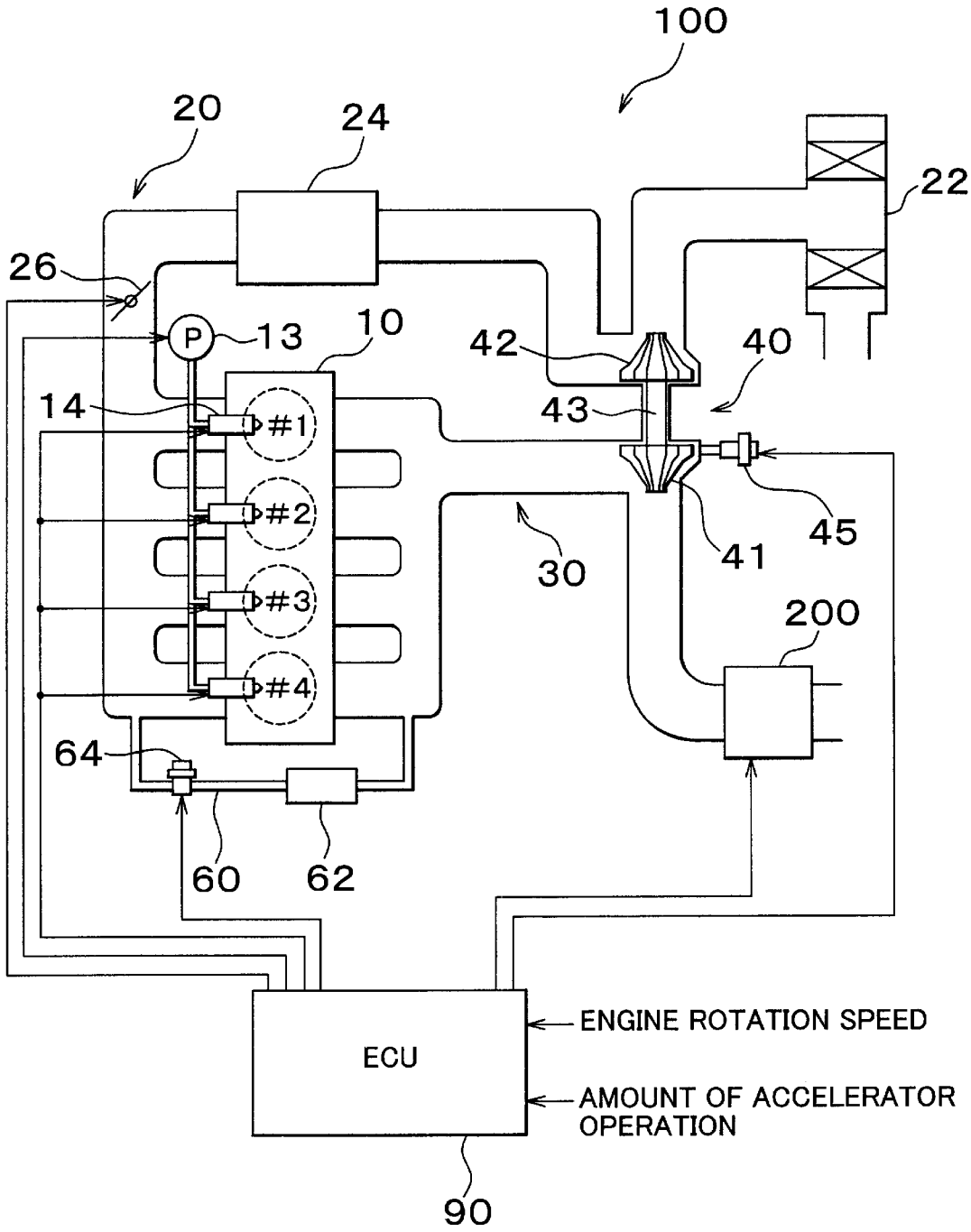
FIG 1 is a diagram schematically illustrating the construction of a diesel engine to which the emission control apparatus of the invention is applied.

FIG. 1 is a diagram schematically illustrating the construction of a diesel engine 100 to which the emission control apparatus of the invention is applied. The diesel engine 100 is a generally termed four-cylinder engine in which an engine body 10 that includes a cylinder block and a cylinder head has four combustion chambers #1 to #4. The combustion chambers #1 to #4 are supplied with air via an intake passage 20. When fuel from a fuel supply pump 13 is injected into a combustion chamber #1 to #4 by a fuel injection nozzle 14, a mixture gas of air and fuel burns in the combustion chamber. Exhaust gas is discharged out via an exhaust passage 30.

A turbocharger 40 is provided between the exhaust passage 30 and the intake passage 20. The turbocharger 40 has a turbine 41 provided in the exhaust passage 30, a compressor 42 provided in the intake passage 20, and a shaft 43 connecting the turbine 41 and the compressor 42. When exhaust gas discharged from the combustion chambers #1 to #4 turns the turbine 41, the compressor 42 rotates via the shaft 43. The compressor 42 compresses air that flows in via an air cleaner 22 provided upstream of the compressor 42. The turbocharger 40 is provided with an actuator 45 for adjusting the area of opening of an inlet of the turbine 41. Reducing the area of opening improves the air compression rate of the compressor 42. Air with an increased temperature due to compression is cooled by an intercooler 24 provided downstream of the compressor 42, and then is supplied to the combustion chamber #1 to #4.

The exhaust passage 30 and the intake passage 20 are connected by an EGR passage 60. The term "EGR" is an abbreviation of "exhaust gas recirculation". A portion of the exhaust gas is returned into the intake passage 20 via the EGR passage 60. As a result, the maximum combustion temperature in the combustion of mixture gas drops, so that the production of nitrogen oxides (NOx) reduces. The EGR passage 60 is provided with an EGR cooler 62 for cooling exhaust gas to be recirculated, and an EGR valve 64 for adjusting the amount of exhaust gas reflow. The intake passage 20 is provided with a throttle valve 26. Adjusting the degree of opening the EGR valve 64 and the degree of opening of the throttle valve 26 adjusts the proportion of the amount of exhaust gas reflow to the total amount of intake into the combustion chambers #1 to #4.

An emission control unit 200 for cleaning exhaust gas discharged from the combustion chambers #1 to #4 is provided in a downstream portion of the exhaust passage 30. The emission control unit 200 removes or purifies particulate substances (hereinafter, referred to as "carbon-containing particles") such as black smoke (soot) and the like, nitrogen oxides (NOx), etc. which are present in exhaust gas. The emission control unit 200 will be described later.

The fuel supply pump 13, the fuel injection nozzle 14, the actuator 45, the EGR valve 64, the throttle valve 26 and the emission control unit 200 are controlled by an electronic control unit (ECU) 90. The ECU 90 detects an engine operation condition, such as the engine rotation speed, the accelerator operation amount, etc., and executes the aforementioned controls in accordance with detection results.

A-2. OVERVIEW OF COMBUSTION

Figure 2:
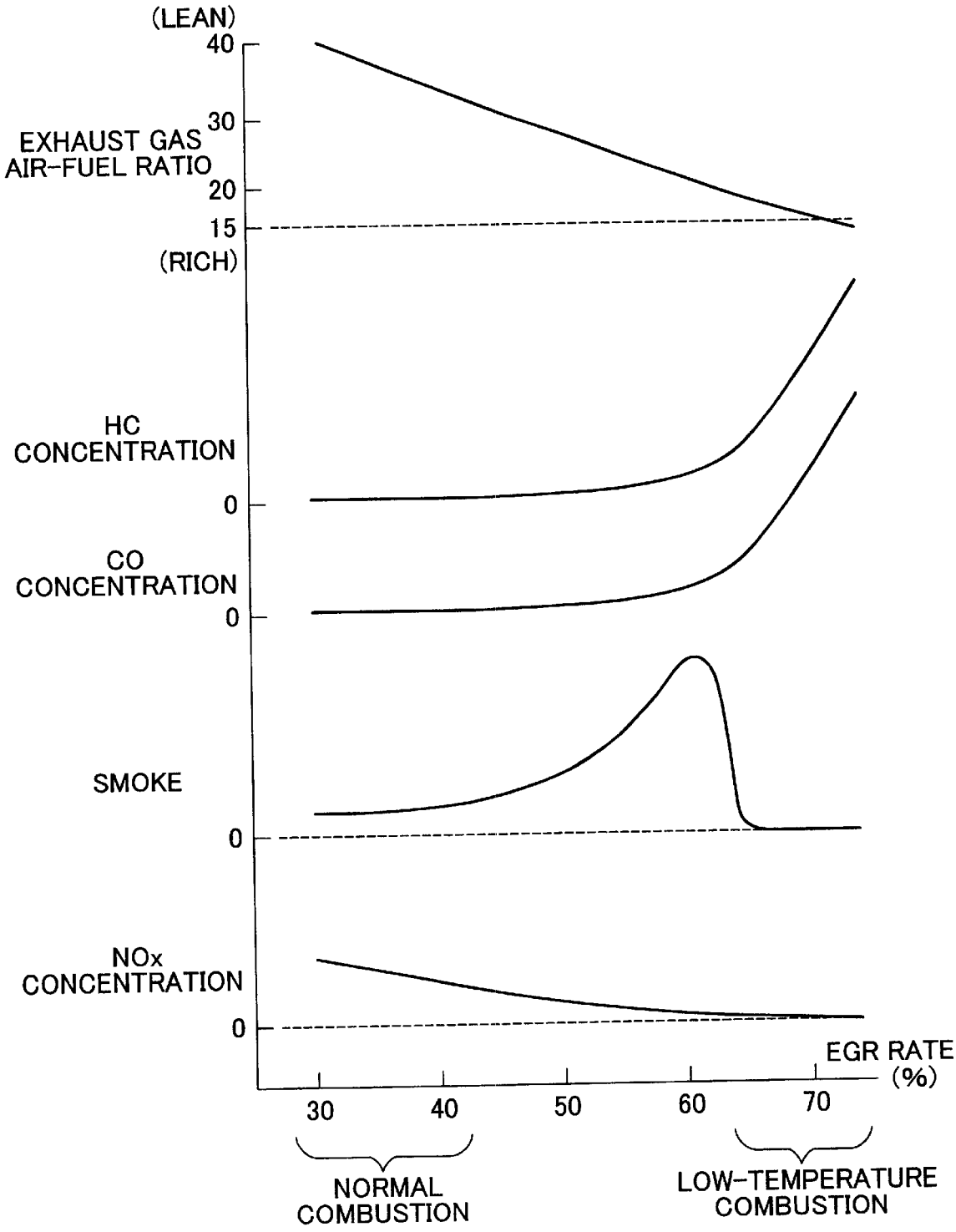
FIG. 2 is a diagram illustrating an overview of combustion in the diesel engine (FIG. 1)

FIG. 2 is a diagram illustrating an overview of combustion in the diesel engine 100 (FIG. 1). FIG. 2 indicates changes in the NOx concentration in exhaust gas, the smoke, the CO (carbon monoxide) concentration, the HC (hydrocarbons) concentration and the exhaust gas air-fuel ratio that occur as the EGR rate is changed.

The EGR rate is the proportion of the amount of exhaust gas reflow to the total amount of intake into the combustion chambers #1 to #4. The smoke is an index indicating the concentration of carbon-containing particles. The exhaust gas air-fuel ratio represents the composition ratio between the air and the reducing substances (HC, CO, etc.). An exhaust gas composition that results in a surplus amount of oxygen remaining after complete combustion of the reducing substances present in exhaust gas is described as "a lean exhaust gas air-fuel ratio". Conversely, an exhaust gas composition that results in an oxygen shortage is complete combustion of the reducing substances present in exhaust gas is attempted is described as "a rich exhaust gas air-fuel ratio". Furthermore, an exhaust gas composition that contains oxygen and reducing substances in exactly matching amounts is described as "a stoichiometric (theoretical) exhaust gas air-fuel ratio". The value of exhaust gas air-fuel ratio is dependent on the property of fuel. The value of the stoichiometric air-fuel ratio is normally about 14.7 to about 14.8.

As indicated in FIG. 2, the exhaust gas air-fuel ratio gradually decreases (shifts to a rich side) as the EGR rate increases. The oxygen concentration in exhaust gas is lower than the oxygen concentration in air. Therefore, if the EGR rate increases (i.e., if the amount of exhaust gas recirculated increases), the oxygen concentration in mixture gas supplied into the combustion chambers decreases. As a result, the oxygen concentration in exhaust gas discharged from the combustion chambers decreases, and the exhaust gas air-fuel ratio decreases.

The NOx concentration gradually decreases with increases in the EGR rate. This is because the maximum combustion temperature at the time of combustion of a mixture gas decreases.

The HC concentration and the CO concentration gradually increase with increases in the EGR rate. Furthermore, as the EGR rate increases, the smoke (i.e., carbon-containing particles) gradually increases, and then sharply drops. More specifically, the smoke starts to increase as the EGR rate exceeds about 40%. The smoke peaks at an EGR rate of about 60%. If the EGR rate is further increased, the smoke starts to sharply decrease. At an EGR rate of about 60%, smoke is no longer produced. As the EGR rate becomes greater than about 60%, the smoke sharply drops, and the CO concentration and the HC concentration sharply rise. This can be explained as follows. That is, if the EGR rate is relatively high, the combustion temperature becomes low, so that fuel, which is a composition of higher hydrocarbon compounds, is discharged in the form of lower hydrocarbon compounds and CO at a stage preceding the combustion-caused change of fuel into carbon-containing particles such as soot and the like.

In conventional diesel engines, the EGR rate is set within a relatively low range, for example, of about 40% or lower. In contrast, in the diesel engine of this embodiment, the EGR rate can be set within a relatively low range, for example, of about 40% or lower, or within a relatively high range of about 65% or higher. The combustion with the EGR rate set within a relatively low range will be referred to as "normal combustion" below. The combustion with the EGR rate set within a relatively high range will be referred to as "low-temperature combustion" below.

If exhaust gas reflow is cooled, it becomes possible to accomplish the low-temperature combustion at a relatively small EGR rate. Therefore, the diesel engine 100 (FIG. 1) of the embodiment is equipped with the EGR cooler 62.

If the normal combustion is performed in a diesel engine as described above, the exhaust gas contains atmospheric pollutants which are mainly carbon-containing particles, NOx, etc. If the low-temperature combustion is performed, the exhaust gas contains atmospheric pollutants, which are mainly HC, CO, etc. That is, performance of the low-temperature combustion reduces the amounts of emission of carbon-containing particles and NOx, which are major problems in conventional diesel engines. However, it is difficult to perform the low-temperature combustion if the engine load is relatively high. This may be explained as follows. That is, in order to operate the engine with high load, it is necessary to increase the amount of fuel injected and the amount of air taken in. To increase the amount of air, it is necessary to reduce the amount of exhaust gas recirculated.

Therefore, the diesel engine 100 (FIG. 1) of this embodiment performs the normal combustion and the low-temperature combustion in accordance with the engine operation condition. Regardless of which one of the normal combustion and the low-temperature combustion is performed, the emission control unit 200 chemically changes atmospheric pollutants into harmless gasses, and discharges the gasses.

A-3. EMISSION CONTROL UNIT

Figure 3A:
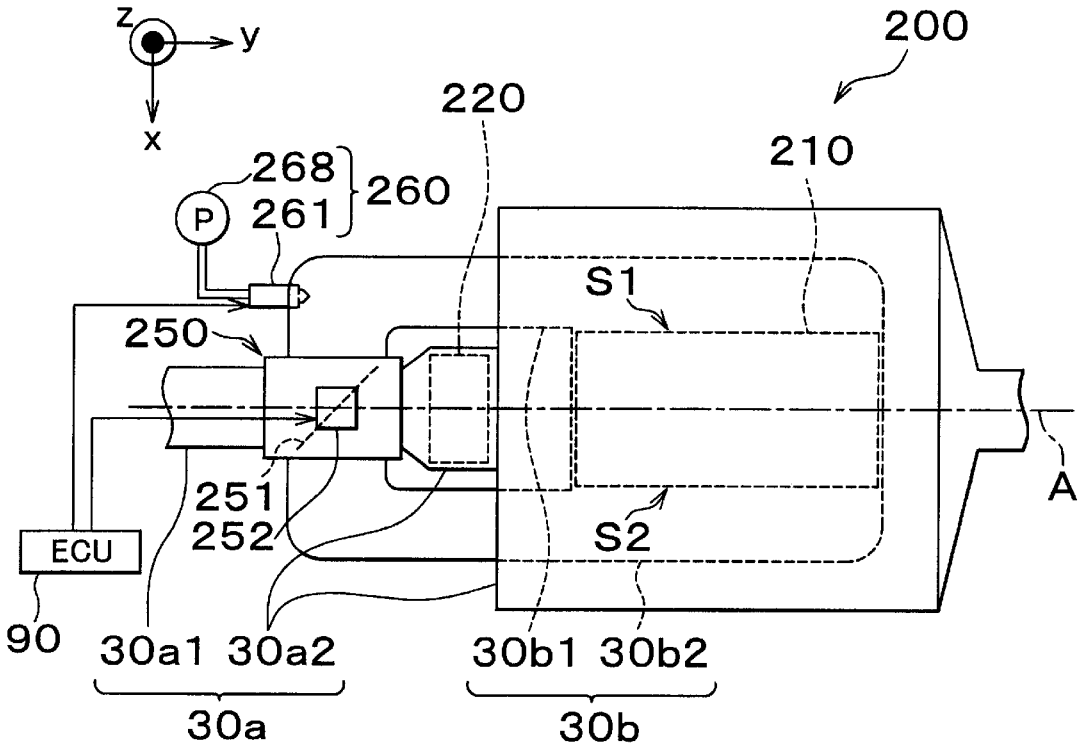
FIGS. 3(A) and 3(B) are diagrams schematically illustrating an emission control unit (FIG. 1)
Figure 3B:
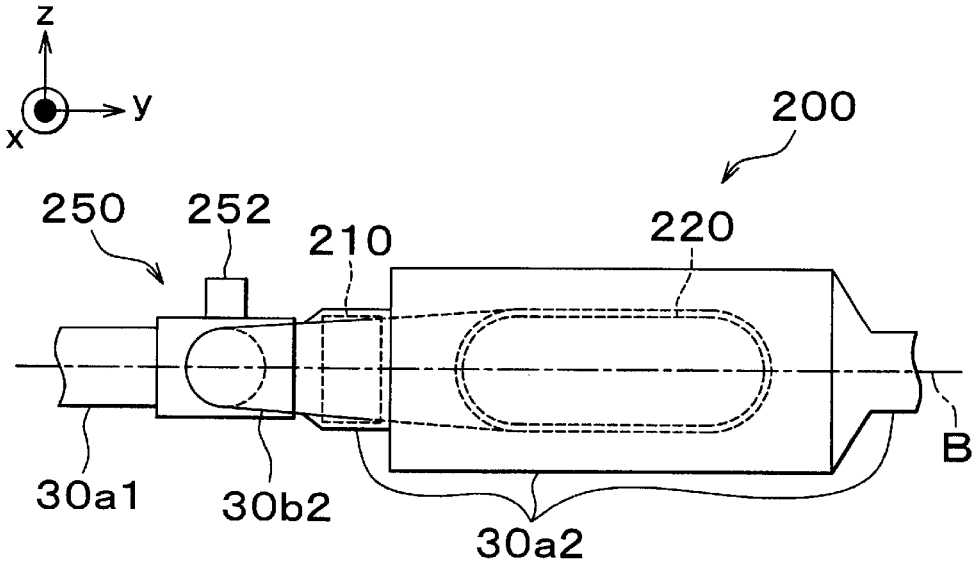
Figure 4A:
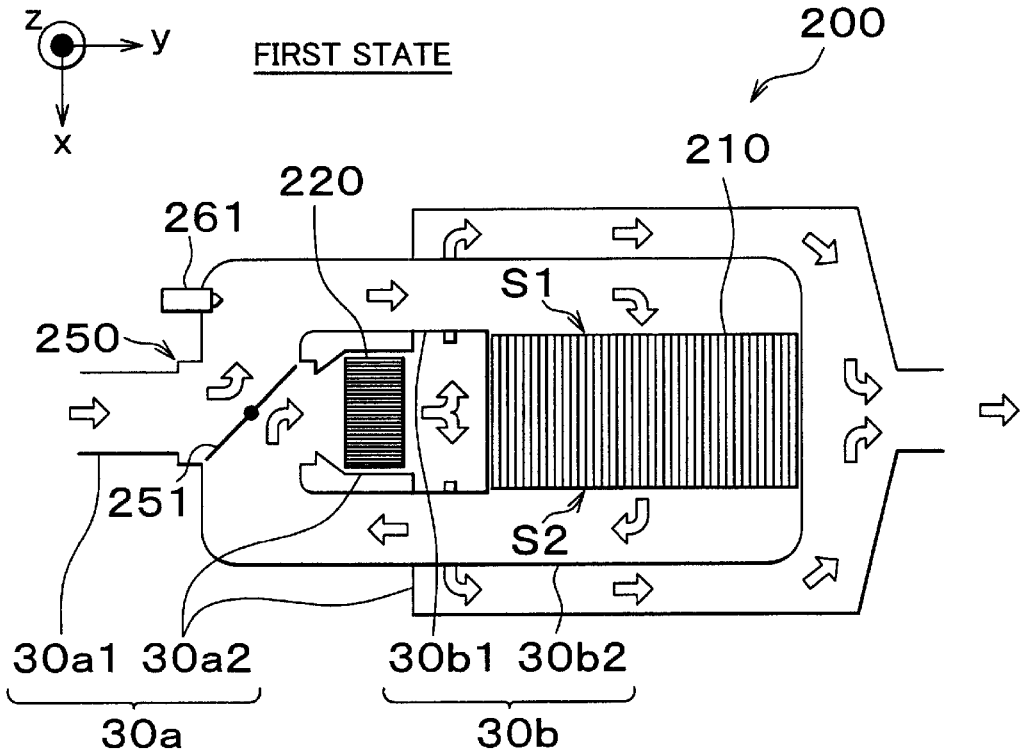
FIGS. 4(A) and 4(B) schematically illustrate flows of exhaust gas where the switching valve is set in a first state.
Figure 4B:
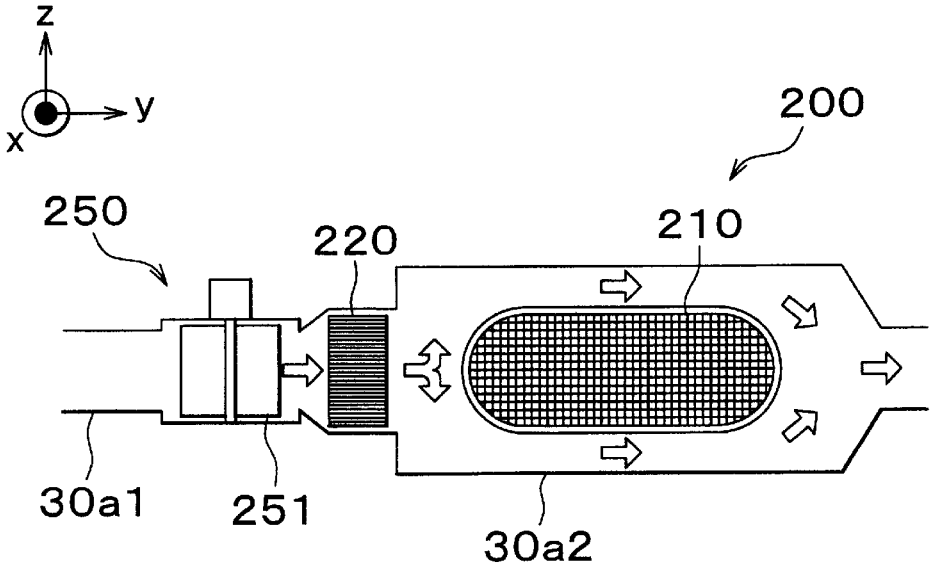
Figure 5A:
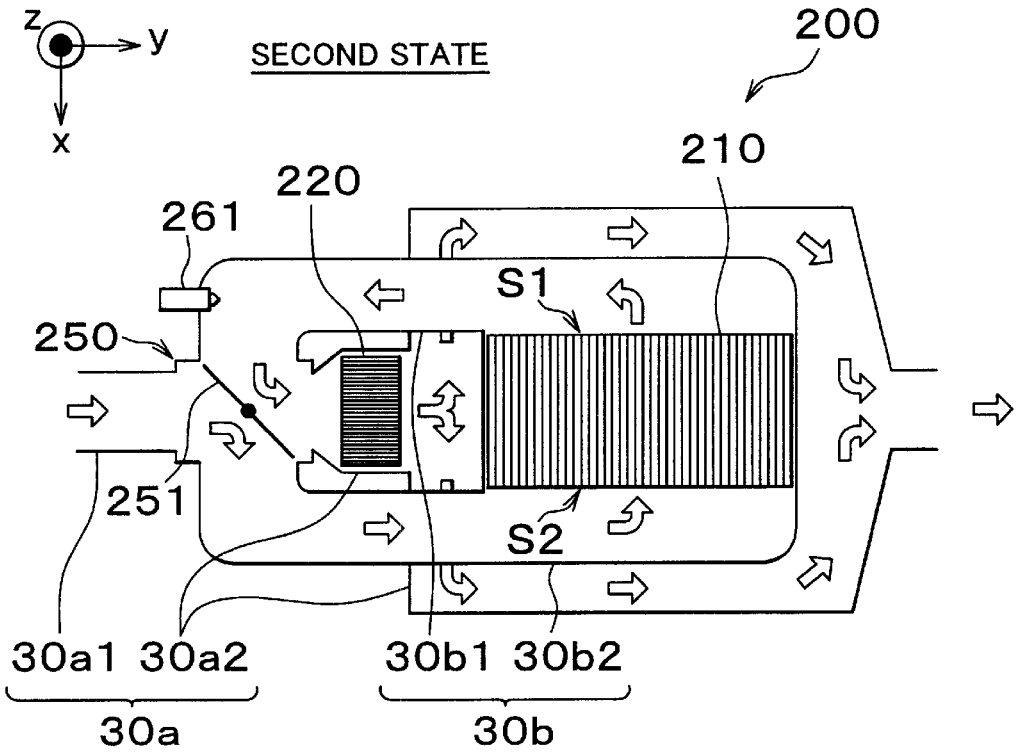
FIGS. 5(A) and 5(B) schematically illustrate flows of exhaust gas where the switching valve is set in a second state.
Figure 5B:
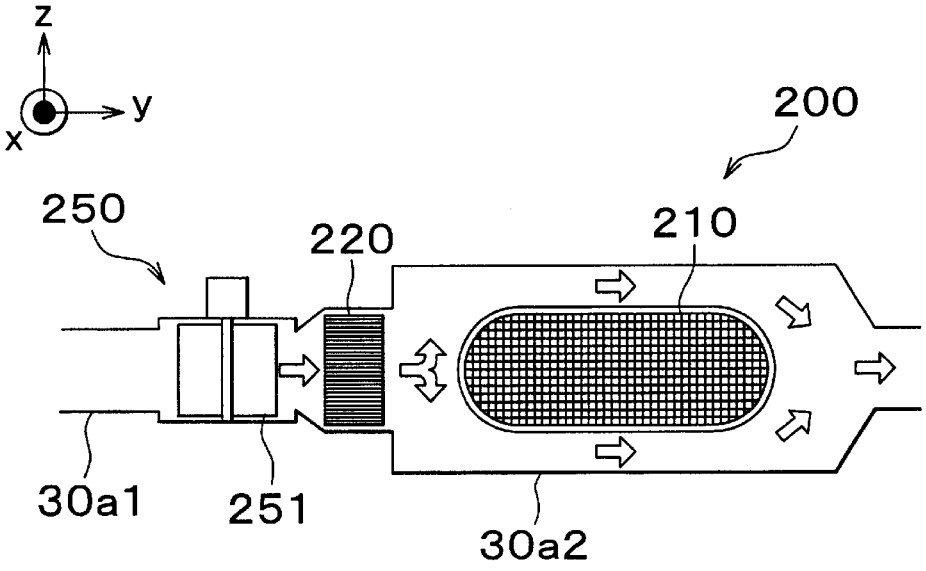
Figure 6A:
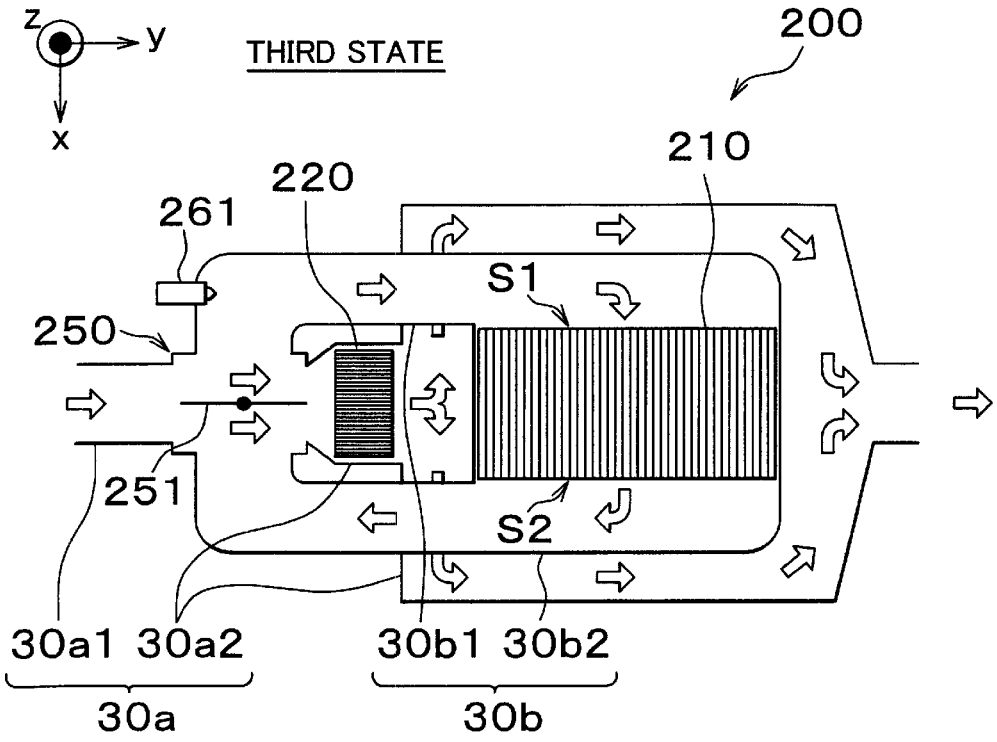
FIGS. 6(A) and 6(B) schematically illustrate flows of exhaust gas where the switching valve is set in a third state.
Figure 6B:
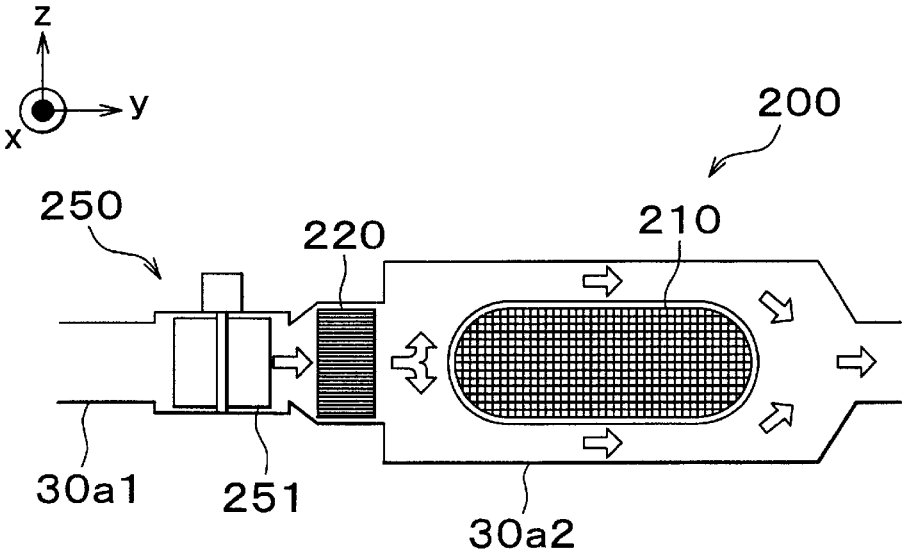

FIGS. 3(A) and 3(B) are diagrams schematically illustrating an external appearance of the emission control unit 200 (FIG. 1). FIGS. 3(A) and 3(B) are a plan view and a side view of the emission control unit 200. FIGS. 4(A), 4(B), 5(A), 5(B), 6(A) and 6(B) are diagrams schematically illustrating flows of exhaust gas within the emission control unit 200. FIGS. 4(A), 5(A) and 6(A) indicate flows of exhaust gas in a section of the emission control unit 200 taken on an x-y plane that contains therein a one-dot chain line B shown in FIG. 3(B). FIGS. 4(B), 5(B) and 6(B) indicate flows of exhaust gas in a section of the emission control unit 200 taken on a y-z plane that contains therein a one-dot chain line A shown in FIG. 3(A).

As shown in FIGS. 3(A) to 6(B), the intake passage 20 has a trunk passage 30*a*, and a loop passage 30*b* connected to the trunk passage 30*a*. The trunk passage 30*a* and the loop passage 30*b* form portions of the exhaust passage 30 shown in FIG. 1. A path change portion 250 is provided in a connection portion between the trunk passage 30*a* and the loop passage 30*b*. The path change portion 250 includes a switching valve 251 for changing the path of exhaust gas, and a drive portion 252 for driving the switching valve 251. The path change portion 250 has two sets of opposite faces to which four passages are connected. Connected to one of the two sets of opposite faces are two partial trunk passages 30*a*1, 30*a*2 that form the trunk passage 30*a*. Connected to the other set of opposite faces are two partial loop passages 30*b*1, 30*b*2 that form the loop passage 30*b*.

The loop passage 30*b* is provided with a first emission control portion 210. The first partial loop passages 30*b*1 connects to a first face S1 of the first emission control portion 210. The second partial loop passage 30*b*2 connects to a second face S2 of the first emission control portion 210. A downstream-side partial trunk passage 30*a*2 is provided with a second emission control portion 220. The downstream-side partial trunk passage 30*a*2 is formed so that a portion of the partial trunk passage 30*a*2 downstream of the second emission control portion 220 surrounds a portion of the loop passage 30*b* extending near the first emission control portion 210.

The first emission control portion 210 has a function of removing or purifying mainly the carbon-containing particles and NOx present in exhaust gas. The second emission control portion 220 has a function of removing or purifying mainly NOx present in exhaust gas. The two emission control portions 210, 220 will be further described below.

The emission control unit 200 has a reducer injecting portion 260 for injecting into the first partial loop passage 30*b*1 a reducing agent for recovering the emission control functions of the two emission control portions 210, 220. The reducer injecting portion 260 has a reducer injection nozzle 261 and a reducer supply pump 268. A reducing agent supplied via the reducer supply pump 268 is injected into the first partial loop passage 30*b*1 by the reducer injection nozzle 261. The reducer may be a hydrocarbon compound, for example, fuel of the diesel engine 100 (i.e., light oil or the like).

As indicated in FIG. 3(A), the path change portion 250 and the reducer injecting portion 260 are controlled by the ECU 90 (FIG. 1). More specifically, the ECU 90 is connected to the drive portion 252 of the path change portion 250. By controlling the drive portion 252, the ECU 90 controls the switching operation of the switching valve 251. The ECU 90 is connected to the reducer injection nozzle 261 of the reducer injecting portion 260. By controlling the reducer injection nozzle 261, the ECU 90 controls the reducer injecting operation of the reducer injection nozzle 261.

Exhaust gas, after flowing into the emission control unit 200, always flows through the trunk passage 30*a*, and then selectively flows through the loop passage 30*b*.

FIGS. 4(A) and 4(B) indicate flows of exhaust gas in the case where the switching valve 251 is set in a first state. After flowing into the emission control unit 200, exhaust gas flows into the path change portion 250 via the upstream-side partial trunk passage 30*a*1. Then, exhaust gas flows through the first partial loop passage 30*b*1 and the second partial loop passage 30*b*2 in that order, and then returns to the path change portion 250. In this case, exhaust gas flows through the first emission control portion 210 from the first face S1 to the second face S2. After returning to the path change portion 250, exhaust gas flows into the downstream-side partial trunk passage 30*a*2, and flows through the second emission control portion 220, and then is discharged from the emission control unit 200. After flowing through the second emission control portion 220, exhaust gas flows through the downstream-side partial trunk passage 30*a*2 formed around the first emission control portion 210, as indicated in FIGS. 4(A) and 4(B).

FIGS. 5(A) and 5(B) indicate flows of exhaust gas in the case where the switching valve 251 is set in a second state. Exhaust gas flows substantially in the same fashion as in FIGS. 4(A) and 4(B), but flows through the loop passage 30*b* in the opposite direction. That is, after flowing into the path change portion 250, exhaust gas flows through the second partial loop passage 30*b*2 and the first partial loop passage 30*b*1 in that order, and then returns to the path change portion 250. In this case, exhaust gas flows through the first emission control portion 210 from the second face S2 to the first face S1.

FIGS. 6(A) and 6(B) indicate flows of exhaust gas in the case where the switching valve 251 is set in a third state. When the switching valve 251 is switched, the switching valve 251 is temporarily set in the third state. In this case, exhaust gas, after flowing into the path change portion 250, immediately flows into the downstream-side partial trunk passage 30*a*2. After flowing through the second emission control portion 220, exhaust gas is discharged from the emission control unit 200.

When the switching valve 251 is in the first or second state, exhaust gas flows through both the first emission control portion 210 and the second emission control portion 220. In contrast, when the switching valve 251 is in the third state, exhaust gas does not flow through the first emission control portion 210, but merely flows through the second emission control portion 220.

Figure 7A:
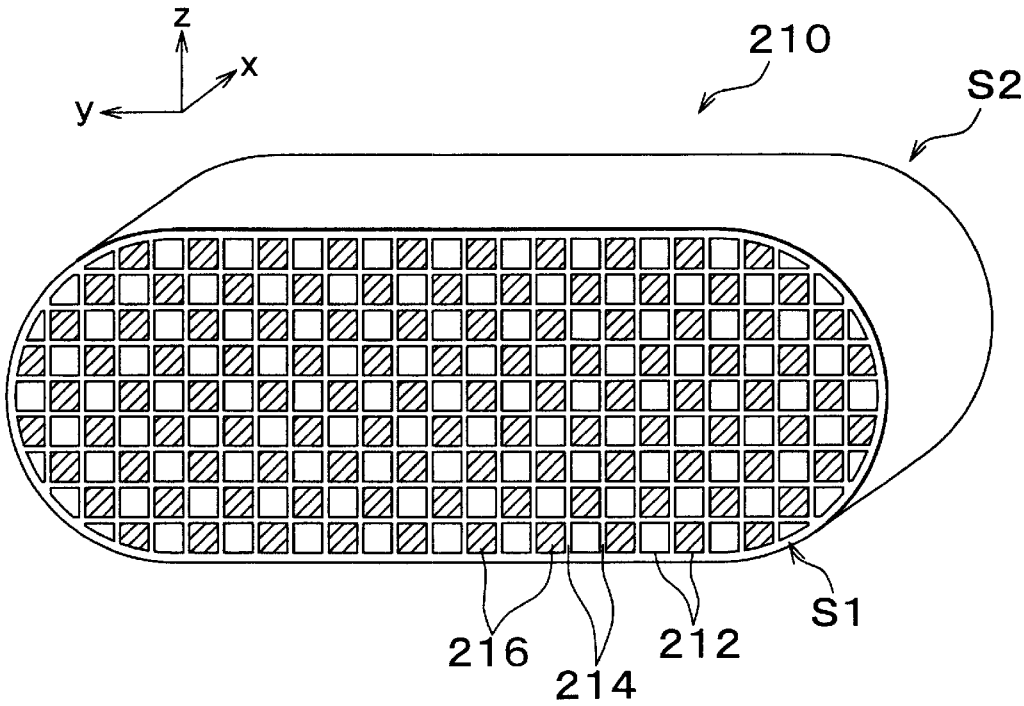
FIGS. 7(A) and 7(B) are diagrams illustrating a first emission control portion (FIGS. 4(A) to 6(B))
Figure 7B:
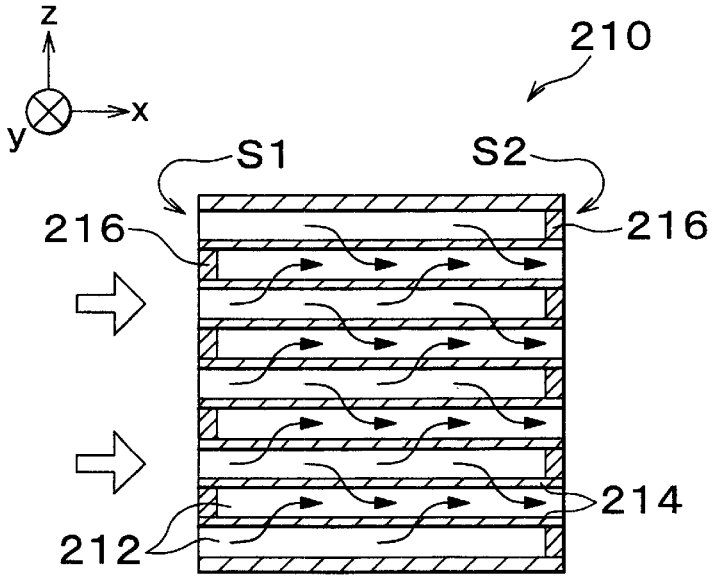

FIGS. 7(A) and 7(B) are diagrams illustrating the first emission control portion 210 (FIGS. 4(A) and 6(B)). FIG. 7(A) shows an external appearance of the first emission control portion 210. FIG. 7(B) shows a schematic sectional view of the first emission control portion 210 taken in a flowing direction of exhaust gas (the x direction indicated in FIG. 7(A)).

The first emission control portion 210 is a monolith type filter capable of occluding carbon-containing particles present in exhaust gas. The first emission control portion 210 is formed from a porous ceramic material. Specifically, the first emission control portion 210 has a plurality of small passages 212 that area arranged in a honeycomb fashion. Partition walls 214 of the small passages 212 have a porous structure that allows exhaust gas to pass through. End portions of the small passages 212 are provided with seal plates 216 alternately at either one of two end sides. More specifically, one of two adjacent small passages 212 has a seal plate 216 at the side of the first face S1 of the first emission control portion 210, and the other small passage 212 has a seal plate 216 at the side of the second face S2 of the first emission control portion 210. Exhaust gas flows into small passages whose inlet side ends are not closed by seal plates. These small passages are closed with seal plates at the outlet side ends. Therefore, exhaust gas flows through the partition walls, and flows out via the adjacent small passages whose outlet side ends are not closed with seal plates. Thus, exhaust gas inevitably flows through the partition walls 214 when passing through the first emission control portion 210. Therefore, the first emission control portion 210 is able to efficiently occlude carbon-containing particles in exhaust gas.

The ceramic material may be cordierite, silicon carbide, silicon nitride, etc.

The partition walls 214 of the first emission control portion 210 is loaded with active ingredients formed by a base material layer, an active metal and a promoter. Specifically, the partition walls 214 have a base material layer that contains alumina as a major component. The base material layer carries thereon platinum Pt as an active metal, and potassium K as a promoter. Therefore, the first emission control portion 210 is able to oxidize the occluded carbon-containing particles, and absorbs and stores NOx from exhaust gas.

As for the active metal, it is possible to use not only platinum Pt, but also a precious metal having an oxidation activity, such as palladium Pd or the like. As for the promoter, it is possible to use not only potassium K but also at least one element selected from the group consisting of alkali metals, such as lithium Li, sodium Na, rubidium Rb, cesium Cs, etc., alkaline-earth metals, such as calcium Ca, strontium Sr. barium Ba, etc., rare earths, such as yttrium Y, lanthanum La, cerium Ce, etc., transition metals, etc. It is preferable that the promoter be an alkali metal or an alkaline-earth metal that is higher in ionization tendency than calcium Ca.

Figure 8:
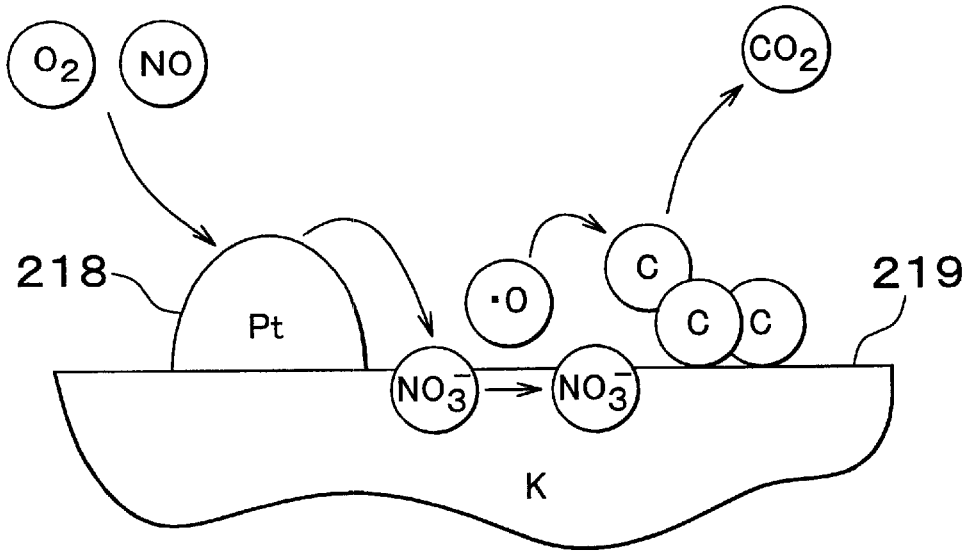
FIG. 8 is a diagram schematically illustrating the functions of an active metal and a promoter supported by partition walls of the first emission control portion in a case where the oxygen concentration in exhaust gas is relatively high.

FIG. 8 is a diagram schematically illustrating the functions of an active metal 218 and a promoter 219 supported by the partition walls 214 of the first emission control portion 210 in a case where the oxygen concentration in exhaust gas is relatively high. This state is brought about if the normal combustion as indicated in FIG. 2 is performed. If the normal combustion is performed, exhaust gas mainly contains carbon-containing particles and NOx, and contains substantially no HC and no CO. If the normal combustion is performed, the exhaust gas air-fuel ratio is at a fuel-lean side, so that exhaust gas contains excess oxygen.

In FIG. 8, "NO" represents nitrogen monoxide, which forms nearly the whole amount of NOx, and "C" represents carbon-containing particles.

As indicated in FIG. 8, nitrogen monoxide NO in exhaust gas reacts with oxygen $O_2$ in exhaust gas on the active metal 218 so as to produce nitrate ions $NO^{3-}$. Nitrate ions move to the promoter 219 due to a phenomenon termed "spillover". The promoter 219 stores nitrate ions in the form of a nitrate acid salt ($KNO_3$), and thus releasing active oxygen. Active oxygen has very high reactivity. Therefore, occluded carbon-containing particles C are oxidized into carbon dioxide $CO_2$ by active oxygen (and oxygen from exhaust gas).

Thus, the first emission control portion 210 is able to absorb and store NOx from exhaust gas in a condition where the oxygen concentration in exhaust gas is relatively high. Then, the first emission control portion 210 is able to remove occluded carbon-containing particles C through the use of active oxygen, which is produced in the process of storing NOx.

The NOx storage of the promoter 219 is limited. Therefore, if the normal combustion is performed for a long period of time, the NOx control performance of the first emission control portion 210 gradually decreases. In this embodiment, the oxygen concentration in exhaust gas is relatively reduced, so as to recover the NOx control function of the first emission control portion 210.

Figure 9:
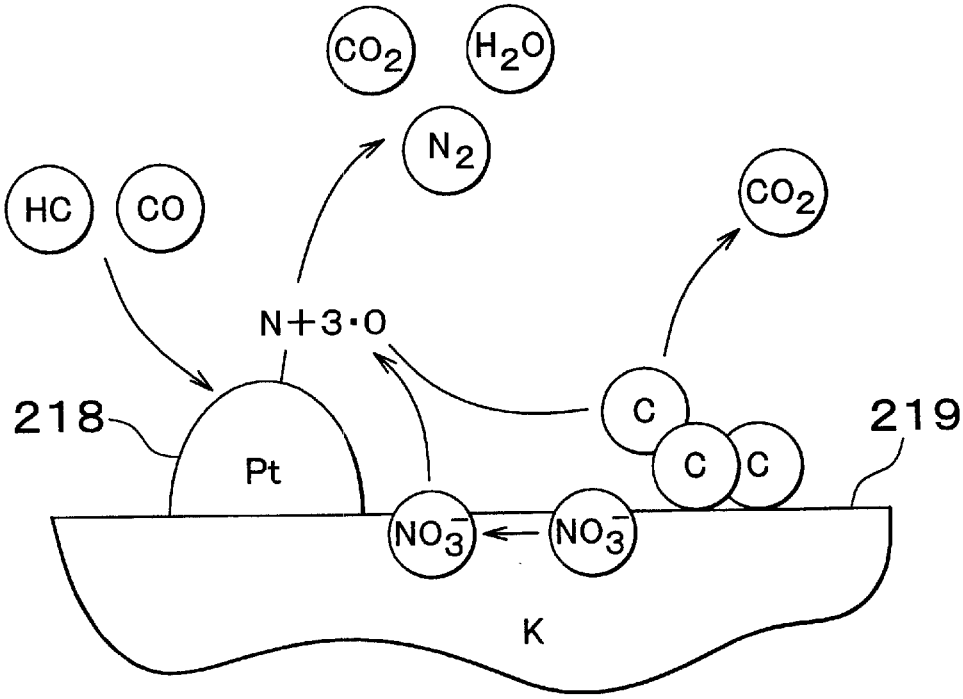
FIG. 9 is a diagram schematically illustrating the functions of the active metal and the promoter supported by the partition walls of the first emission control portion in a state when the oxygen concentration in exhaust gas is relatively low.

FIG. 9 is a diagram schematically illustrating the functions of the active metal 218 and the promoter 219 supported by the partition walls 214 of the first emissions control portion 210 in a state where the oxygen concentration in exhaust gas is relatively low. This condition is realized if, for example, the low-temperature combustion as indicated in FIG. 2 is performed. If the low-temperature combustion is performed, exhaust gas mainly contains HC and CO, and contains substantially no carbon-containing particles and no NOx. Furthermore, if the low-temperature combustion is performed, the exhaust gas air-fuel ratio shifts toward the rich side (reaches the stoichiometric ratio or a rich ratio, and exhaust gas contains no surplus oxygen.

As indicated in FIG. 9, if the oxygen concentration in exhaust gas becomes relatively low, the active metal 218 decomposes nitrate ions $NO_3^-$ stored in the promoter 219, and therefore releases active oxygen. Specifically, the nitrate ions $NO_3^-$ storage of the promoter 219 migrate onto the active metal 218. On the active metal 218, the bonds between the oxygen atoms and the nitrogen atoms of each nitrate ion are likely to break. This state is indicated by "N+3·N" in FIG. 9. If in this state, a reducing substance, such as HC, CO or the like, exists, the bonds between the nitrogen atom and the oxygen atoms are broken, so that nitrogen $N_2$ and active oxygen are produced. Active oxygen oxidizes reducing substances HC, CO in exhaust gas, and therefore produces carbon dioxide $CO_2$ and water (vapor) $H_2O$. Active oxygen also oxidizes occluded carbon-containing particles C, and therefore produces carbon dioxide $CO_2$. This phenomenon can locally occur in FIG. 8 as well. That is, a phenomenon similar to the one described above occurs in a case where the oxygen concentration in exhaust gas is relatively high but oxygen shortage occurs around occluded carbon-containing particles C.

Thus, the first emission control portion 210 is able to recover the NOx control function by reducing stored NOx and thereby releasing nitrogen $N_2$ in a condition where the oxygen concentration in exhaust gas is relatively low. Then, using active oxygen produced through the recovery of the NOx control function, the first emission control portion 210 is able to oxidize and thereby remove occluded carbon-containing particles C.

Figure 10A:
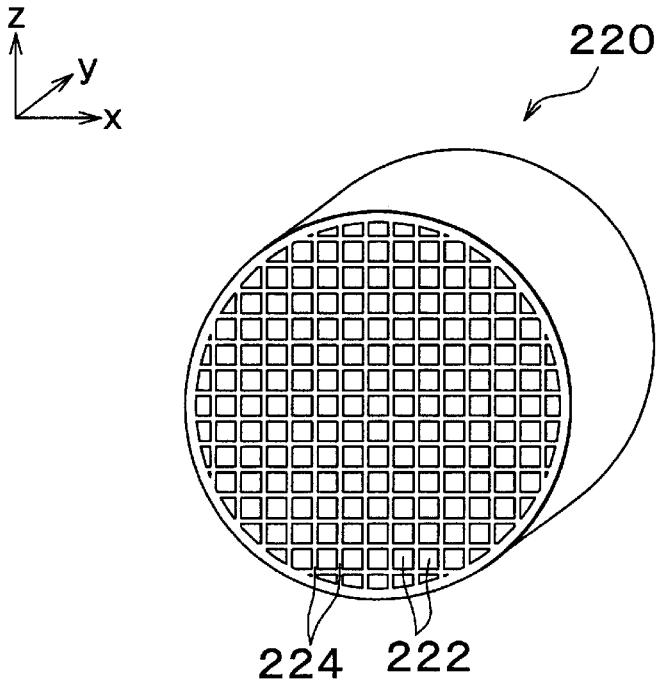
FIGS. 10(A) and 10(B) illustrate a second emission control portion (FIGS. 4(A) to 6(B))
Figure 10B:
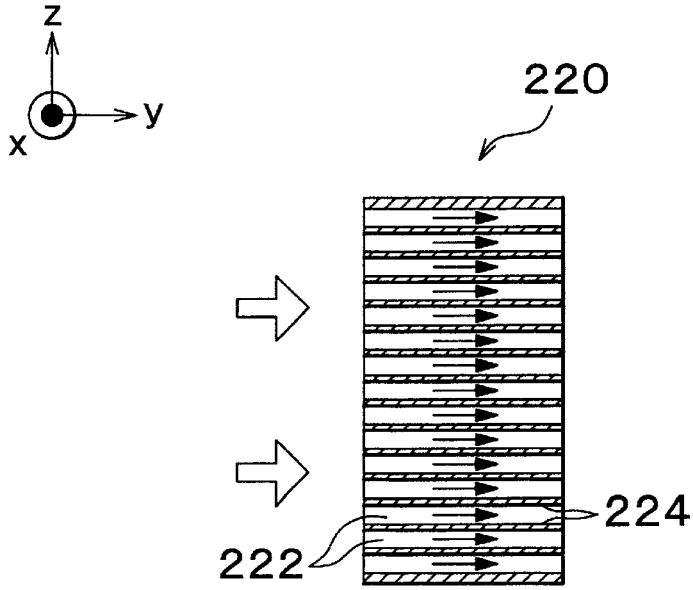

FIGS. 10(A) and 10(B) illustrate the second emission control portion 220 (FIGS. 4(A) to 6(B)). FIG. 10(A) shows an external appearance of the second emission control portion 220. FIG. 10(B) shows a schematic sectional view taken along the direction of flow of exhaust gas in the second emission control portion 220 (y direction indicated in FIG. 10(A)).

Similarly to the first emission control portion 210 shown in FIGS. 7(A) and 7(B), the second emission control portion 220 is formed from a ceramic material, and has a plurality of small passages 222 in a honeycomb arrangement. However, the second emission control portion 220 differs from the first emission control portion 210 in that the end portion of the small passages 222 are not provided with a seal plate, but are left open. This structure is adopted because the exhaust gas that flows into the second emission control portion 220 does not contain a significant amount of carbon-containing particles. That is, exhaust gas normally flows through the first emission control portion 210. When the switching valve 251 is in the third state as indicated in FIGS. 6(A) and 6(B), exhaust gas directly flows into the second emission control portion 220 without passing through the first emission control portion 210. However, the time during which exhaust gas directly flows into the second emission control portion 220 at the time of switching the switching valve 251 is short. Therefore, the second emission control portion 220 does not employ a seal plate The omission of a seal plate relatively reduces the pressure loss caused by the second emission control portion 220, and therefore makes it possible to reduce deterioration in engine performance.

A NOx catalyst is supported by partition walls 224 between the small passages 222 of he second emission control portion 220. As a NOx catalyst, this embodiment employs a NOx storage-reduction catalyst. As for the NOx storage-reduction catalyst, it is possible to use platinum Pt as an active metal and a promoter as potassium K, as in the case of the first emission control portion 210.

Thus, the second emission control portion 220 has a construction similar to that of the first emission control portion 210. Therefore, the second emission control portion 220 is able to absorb and store NOx from exhaust gas if the oxygen concentration in exhaust gas is relatively high, as illustrated in FIG. 8. Furthermore, as illustrated in FIG. 9, the second emission control portion 220 is able to recover the NOx control function by releasing nitrogen $N_2$ through reduction of stored NOx in a condition where the oxygen concentration in exhaust gas is relatively low.

Although in this embodiment, the second emission control portion 220 is provided with the NOx storage reduction catalyst as a NOx catalyst, the NOx storage-reduction catalyst may be replaced by a NOx selective reduction catalyst.

A-4. REVERSAL OF FLOW OF EXHAUST GAS IN EMISSION CONTROL UNIT

In the emission control unit 200, the amount of carbon-containing particles that can be oxidized and removed per unit time by the first emission control portion 210 is limited. Therefore, if the amount of carbon-containing particles present in exhaust gas is greater than the oxidizable amount, carbon-containing particles gradually deposit on the partition walls 214 of the first emission control portion 210. If carbon-containing particles deposit in a large amount, pores in the partition walls 214 are closed. In that case, the pressure loss caused by the first emission control portion 210 increases, and thus degrading the engine performance.

Therefore, in order to reduce the amount of carbon-containing particles that deposit in the first emission control portion 210 of the emission control unit 200 of this embodiment, the flowing direction of exhaust gas through the first emission control portion 210 is reversed. Specifically, the emission control unit 200 reverse the direction of flow of exhaust gas through the partition walls 214 of the first emission control portion 210 by switching the switching valve 251 as indicated in FIGS. 4(A) to 5(B).

Figure 11A:
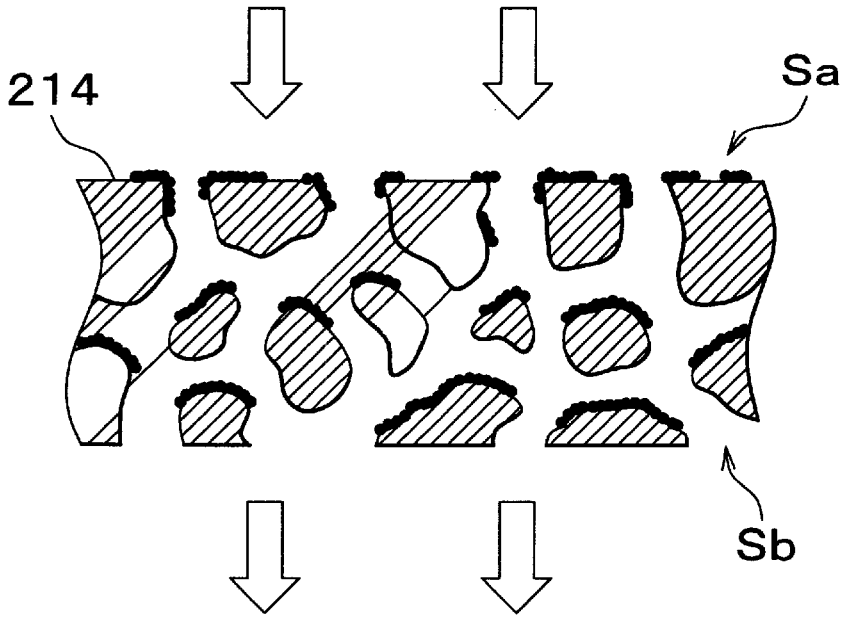
FIGS. 11(A) and 11(B) are enlarged diagrams of partition walls of the first emission control portion (FIGS. 7(A) and 7(B))
Figure 11B:
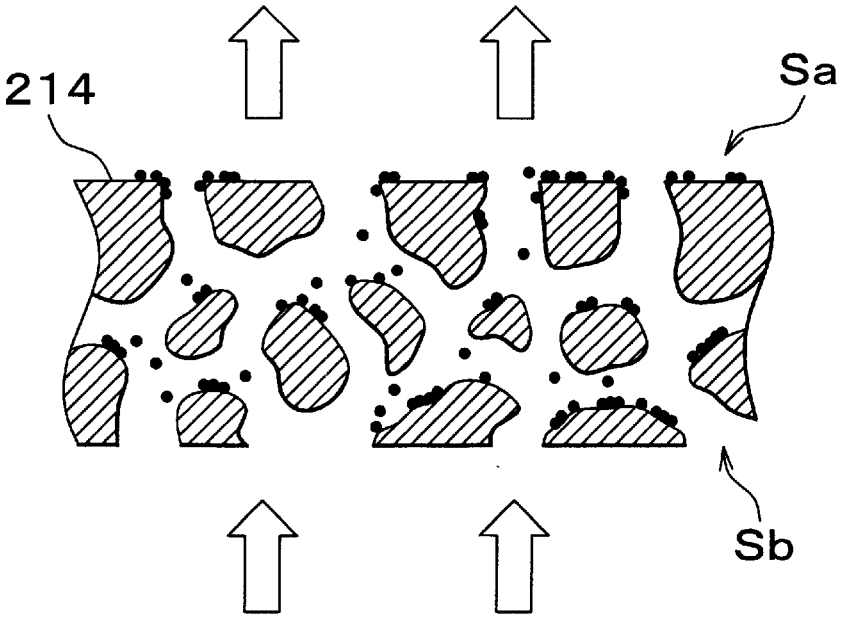

FIGS. 11(A) and 11(B) are enlarged diagrams of the partition walls 214 of the first emission control portion 210 (FIGS. 7(A) and 7(B)). In FIGS. 11(A) and 11(B), ceramic portions forming the partition walls 214 are indicated by hatching.

In FIG. 11(A), exhaust gas flows through a partition wall 214 from a first face Sa toward a second face Sb. Since exhaust gas strikes the first face Sa-side of each ceramic portion, carbon-containing particles from exhaust gas deposit mainly on the first face Sa-side of each ceramic portion. In FIG. 11(B), exhaust gas flows through a partition wall 214 from the second face Sb toward the first face Sa. As indicated in FIGS. 11(A) and 11(B), the deposit of carbon-containing particles on the first face Sa side of each ceramic portion can easily be broken by reversing the flowing direction of exhaust gas. If the flowing direction of exhaust gas is reversed, exhaust gas strikes the second face Sb-side of each ceramic portion, which does not carry thereon a large amount of deposit of carbon-containing particles. Thus, active oxygen is actively released. A portion of the active oxygen produced oxidizes carbon-containing particles deposited on the first face Sa-side of each ceramic portion.

Thus, the amount of deposit of carbon-containing particles in the first emission control portion 210 can be reduced by reversing the direction of flow of exhaust gas through the first emission control portion 210.

A-5. INJECTION OF REDUCER IN EMISSION CONTROL UNIT

However, in some cases, carbon-containing particles deposited in the first emission control portion 210 cannot be sufficiently removed despite the reversal of the direction of flow of exhaust gas through the first emission control portion 210. Furthermore, if carbon-containing particles deposit in large amounts, the function of the active metal is inhibited by carbon poisoning. The deposit of carbon-containing particles is initially amorphous carbon, and then alters into graphite, which causes more serious poisoning. In this case, the NOx control function of the first emission control portion 210 is inhibited. Although the emission control functions of the first emission control portion 210 and the second emission control portion 220 can normally be recovered by performing the low-temperature combustion, there are cases where it is difficult to perform the low-temperature combustion depending on the operation condition of the engine 100. In the emission control unit 200 of this embodiment, it is possible to actively recover the emission control functions of the first and second emission control portions 210, 220 by injecting a reducing agent into the first partial loop passage 30*b*1 via the reducer injection portion 260.

Figure 12:
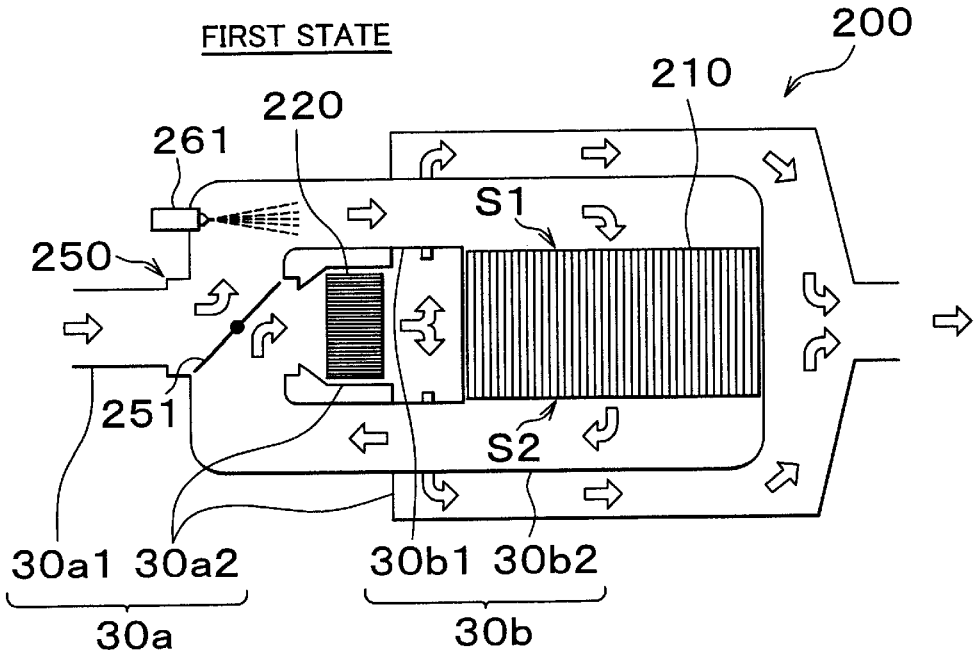
FIG. 12 is a diagram illustrating how a reducing agent is injected from a reducer injection nozzle.
Figure 13:
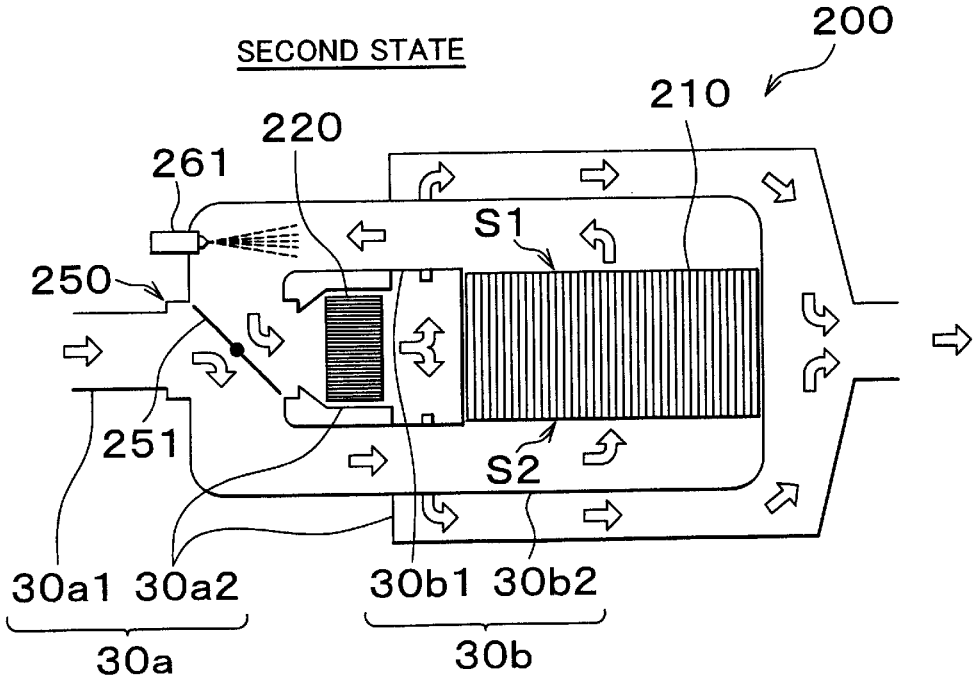
FIG. 13 is a diagram illustrating how a reducing agent is injected from a reducer injection nozzle.

FIGS. 12 and 13 are diagrams illustrating how a reducing agent is injected by the reducer injection nozzle 261. It should be noted herein that FIGS. 12 and 13 correspond to FIGS. 4(A) and 5(A), respectively.

Referring to FIG. 12, the reducer injection nozzle 216 injects the reducing agent into the first partial loop passage 30*b*1 while the switching valve 251 is set in the first state. The oxygen concentration in exhaust gas within the first emission control portion 210 remains relatively high (i.e., the exhaust gas air-fuel ratio is on the lean side) as indicated in FIG. 8 until the reducer is injected. As the reducer injected is supplied to the first emission control portion 210 by flow of exhaust gas, the reducer HC reacts with oxygen $O_2$ in exhaust gas, that is, burns, due to the action of the active metal 218 supported by the first emission control portion 210. Therefore, the oxygen concentration in exhaust gas within the first emission control portion 210 becomes relatively low (i.e., the exhaust gas air-fuel ratio shifts to the rich side) as indicated in FIG. 9. In that case, the first emission control portion 210 recovers the NOx control function by reducing stored NOx into nitrogen $N_2$ and releasing nitrogen $N_2$, as described above with reference to FIG. 9. Then, using active oxygen produced by the recovery process, the first emission control portion 210 oxidizes and removes occluded carbon-containing particles C.

Similarly, the oxygen concentration in exhaust gas within the second emission control portion 220 is relatively high (i.e., the exhaust gas air-fuel ratio in on the lean side) as indicated in FIG. 8 until the reducer is injected into the first partial loop passage 30*b*1. Then, since exhaust gas flows into the second emission control portion 220 after flowing through the first emission control portion 210, the oxygen concentration in exhaust gas within the second emission control portion 220 is relatively low (i.e., the exhaust gas air-fuel ratio is on the rich side) as indicated in FIG. 9. In that case, the second emission control portion 220 recovers the NOx control function by reducing stored NOx into nitrogen $N_2$ and releasing nitrogen $N_2$. The second emission control portion 220 uses active oxygen produced during the recovery process to oxidize and remove the reducing substances, such as the reducer CH, the carbon-containing particles C contained in exhaust gas, etc.

In FIG. 13, the reducer injection nozzle 261 injects the reducer into the first partial loop passage 30*b*1 while the switching valve 251 is set in the second state. The oxygen concentration in exhaust gas within the second emission control portion 220 is relatively high (i.e., the exhaust gas air-fuel ratio is on the lean side) until the reducer is injected. As the injected reducer is supplied to the second emission control portion 220 by flow of exhaust gas, the reducer HC reacts with oxygen $O_2$ in exhaust gas, that is, burns, due to the action of the active metal supported by the second emission control portion 220. Therefore, the oxygen concentration in exhaust gas within the second emission control portion 220 becomes relatively low (i.e., the exhaust gas air-fuel ratio shifts to the rich side). In that case, the second emission control portion 220 recovers the NOx control function by reducing stored NOx into nitrogen $N_2$ and releasing nitrogen $N_2$. Then, using active oxygen produced by the recovery process, the second emission control portion 220 oxidizes and removes the reducing substances, such as the reducer CH, the carbon-containing particles C present in exhaust gas, etc.

As indicated in FIGS. 12 and 13, it is possible to recover the emission control functions of the first and second emission control portions 210, 220 by the reducer injection portion 260 supplying the reducer into the first partial loop passage 30*b*1 while the switching valve 251 is set in the first state. It is also possible to recover only the emission control function of the second emission control portion 220 by the reducer injecting portion 260 supplying the reducer into the first partial loop passage 30*b*1 while the switching valve 251 is set in the second state.

A-6. INJECTION OF REDUCER AT THE TIME OF SWITCHING SWITCHING VALVE

If the reducing agent is injected while the switching valve 251 is set in the first state as indicated in FIG. 12, the emission control function of the first emission control portion 210 can be recovered. However, if the reducer is injected while the switching valve 251 is set in the second state as indicated in FIG. 13, the emission control function of the first emission control portion 210 cannot be recovered.

If the reducer is injected in order recover the emission control function of the first emission control portion 210 while the switching valve 251 is set in the first state, the reducer is needed in a relatively great amount. That is, when the switching valve 251 is set in the first state, the flow of exhaust gas in the first partial loop passage 30*b*1 is the fastest. If the reducer is injected during this state, a great portion of the reducer immediately passes through the emission control portions 210, 220 without being used for the recovery process. Furthermore, since the amount of exhaust gas flow is great (i.e., the amount oxygen in exhaust gas is great), it becomes relatively difficult to achieve a rich exhaust gas air-fuel ratio. Still further, a great portion of the reducer passes through the emission control portions 210, 220 before sufficiently diffusing into exhaust gas. Therefore, in this embodiment, there is a contrivance for reducing the amount of the reducer injected. Hence, a relatively large amount of the reducer is needed in order to sufficiently recover the emission control function of the first emission control portion 210. If fuel is used as a reducer, fuel economy deteriorates.

A construction described below has a contrivance that makes it possible to recover the emission control function of the first emission control portion 210 independently of the state prior to the switching of the switching valve 251, by injecting the reducer when the switching valve 251 is switched. The injection of the reducer at the time of switching the switching valve 251 makes it possible to reduce the amount of the reducer that needs to be injected in order to sufficiently recover the emission control function of the first emission control portion 210.

Figure 14A:
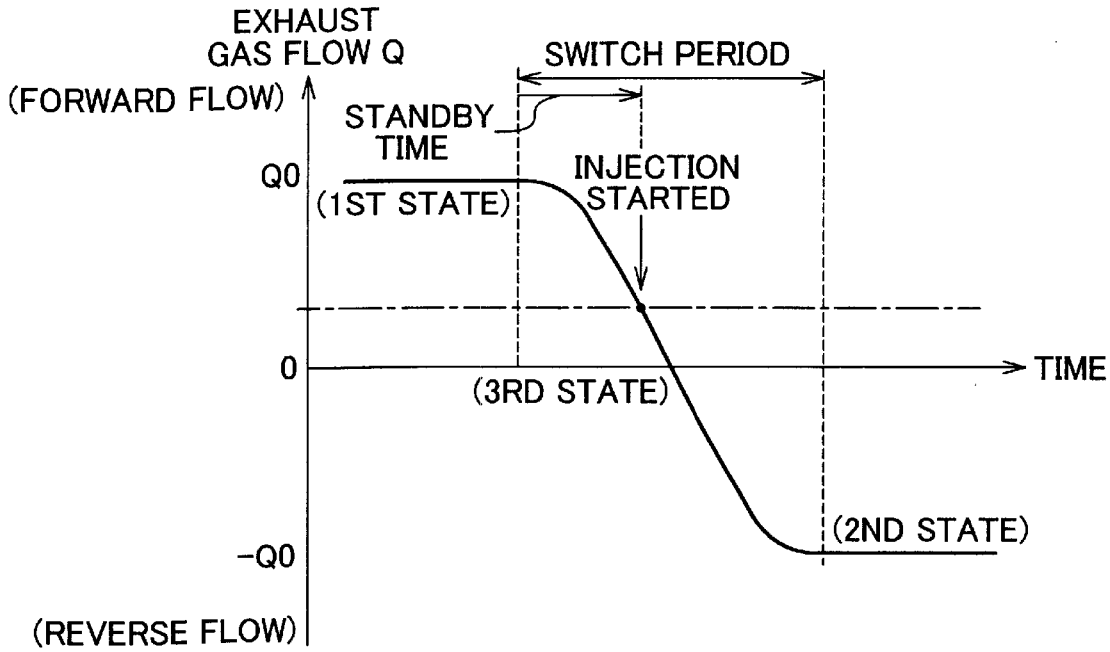
FIGS. 14(A) and 14(B) are diagrams indicating changes in the amount Q of flow of exhaust gas near the first emission control portion and the starting time point of injection of the reducer
Figure 14B:
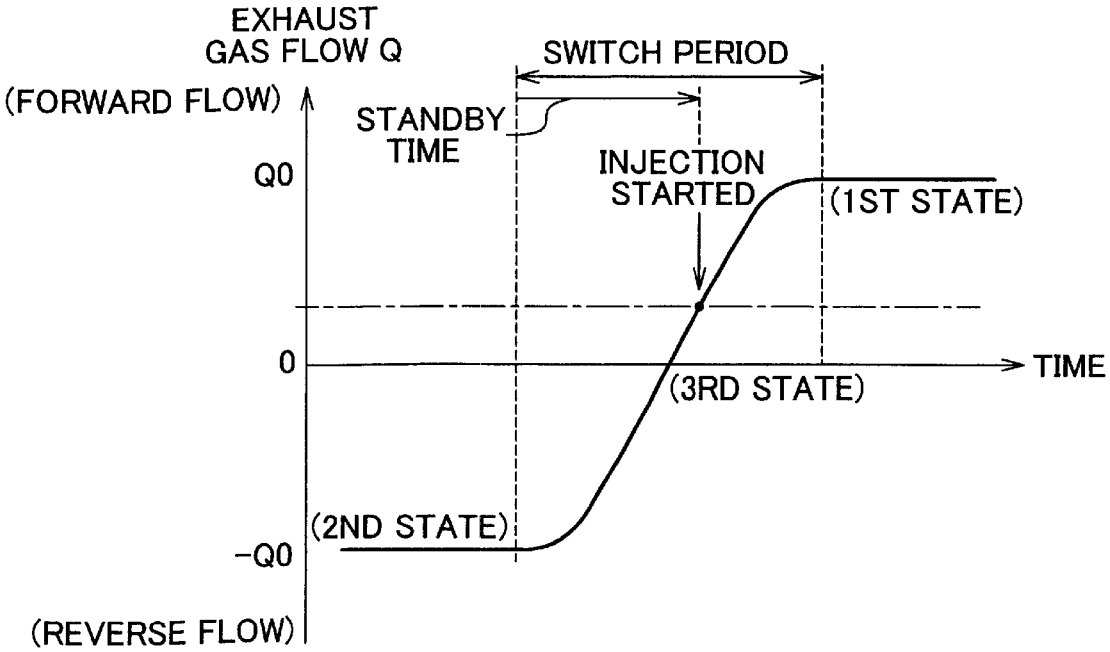

FIGS. 14(A) and 14(B) are diagrams indicating changes in the amount Q of flow of exhaust gas near the first emission control portion 210 and the starting time point of the injection of the reducer. The amount of flow herein refers to the volume of a fluid (exhaust gas) that flows per unit time.

FIG. 14(A) indicates changes in the exhaust gas flow amount Q and the reducer injection start time point in the case where the switching valve 251 is switched from the first state to the second state. As indicated in FIG. 14(A), while the switching valve 251 is set in the first state, an amount Q0 of flow of exhaust gas flows in the direction while the switching valve 251 is set in the first state. During the switching period of the switching valve 251, the amount of flow of exhaust gas in the forward direction gradually decreases, and then the amount of flow of exhaust gas in the reverse direction gradually increases. When the switching valve 251 assumes the third state at an intermediate point during the switching period, the amount Q of flow of exhaust gas becomes substantially "0". Then, as the switching valve 251 is set in the second state, a certain amount Q0 of flow of exhaust gas flows in the reverse direction.

When the switching valve 251 switches from the first state to the second state, more specifically, during a predetermined period following a time point before the switching valve 251 assumes the third state, the reducer is injected into the first partial loop passage 30*b*1. At this moment, the amount Q of flow of exhaust gas is relatively small. Therefore, the reducer sufficiently diffuses into exhaust gas in the first partial loop passage 30*b*1 and relatively slowly flows through the first emission control portion 210 as the switching valve 251 assumes the third state. A predetermined amount Q0 of exhaust gas constantly flows through the downstream-side partial trunk passage 30*a*2 independently of the state of the switching valve 251. Exhaust gas that slowly flows through the first emission control portion 210 gradually flows through the second emission control portion 220 as the switching valve 251 assumes the third state.

FIG. 14(B) indicates changes in the exhaust gas flow amount Q and the reducer injection starting time point in the case where the switching valve 251 is switched from the second state to the first state. FIG. 14(B) is substantially the same as FIG. 14(A), except that the changing pattern of the exhaust gas flow amount Q is reversed. During the switching period of the switching valve 251, the amount of flow of exhaust gas in the reverse direction gradually decreases, and then the amount of flow of exhaust gas in the forward direction gradually increases. When the switching valve 251 assumes the third state during the switching period, the amount Q of flow of exhaust gas becomes substantially "0".

The reducer is injected into the first partial loop passage 30*b*1, when the switching valve 251 switches from the second state to the first state, more specifically, during a predetermined period following a time point after the switching valve 251 assumes the third state. At this time, the exhaust gas flow amount Q is relatively small. Therefore, as the switching valve 251 assumes the first state, the reducer diffuses into exhaust gas in the first partial loop passage 30*b*1, and relatively slowly flows through the first emission control portion 210. In this case, too, exhaust gas that relatively slowly flows through the first emission control portion 210 gradually flows through the second emission control portion 220 as the switching valve 251 assumes the first state.

In FIGS. 14(A) and 14(B), the reducer is injected when the flowing direction of exhaust gas is the forward direction. Therefore, the reducer can be supplied to the first emission control portion 210 independently of the state of the switching valve 251 prior to the switching thereof. As a result, the emission control function of the first emission control portion 210 can be recovered. Furthermore, since the reducer is injected when the amount Q of flow of exhaust gas is relatively small, exhaust gas having a rich exhaust gas air-fuel ratio slowly flows through the first emission control portion 210 consuming a relatively long time. Therefore, the reducer is efficiently used for the recovery of the emission control function of the first emission control portion 210. As a result, it becomes possible to reduce the amount of the reducer that needs to be injected in order to sufficiently recover the emission control function of the first emission control portion 210.

In FIGS. 14(A) and 14(B), the reducer injection starting time point is set at a time point at which the exhaust gas flow amount Q is substantially the same regardless of the switching direction of the switching valve.

Figure 15A:
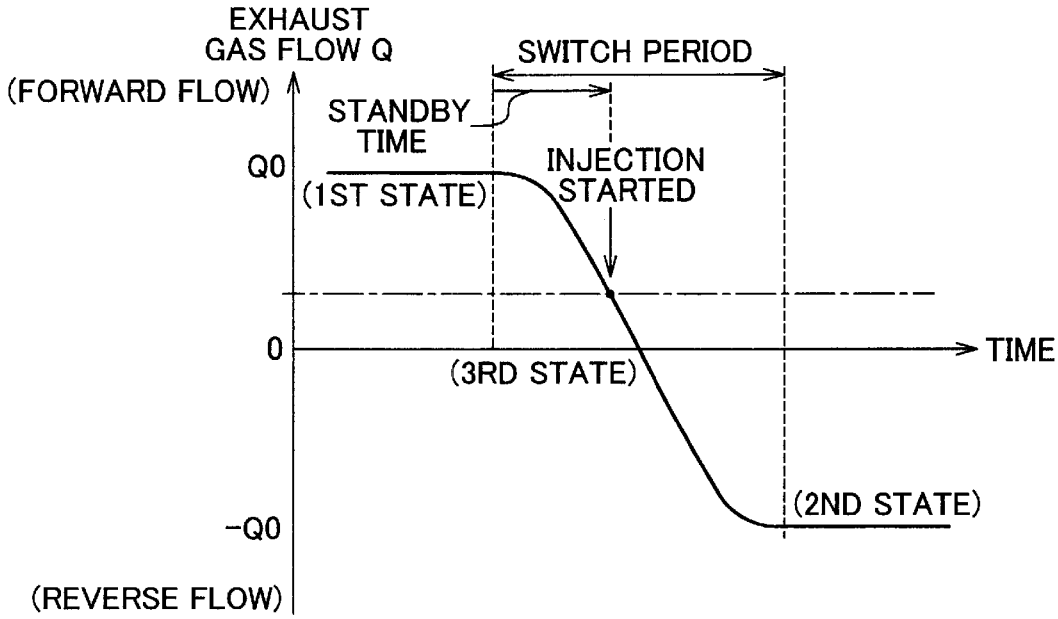
FIGS. 15(A) and 15(B) are diagrams indicating changes in the exhaust gas flow amount near the first emission control portion and the reducer injection start time point.
Figure 15B:
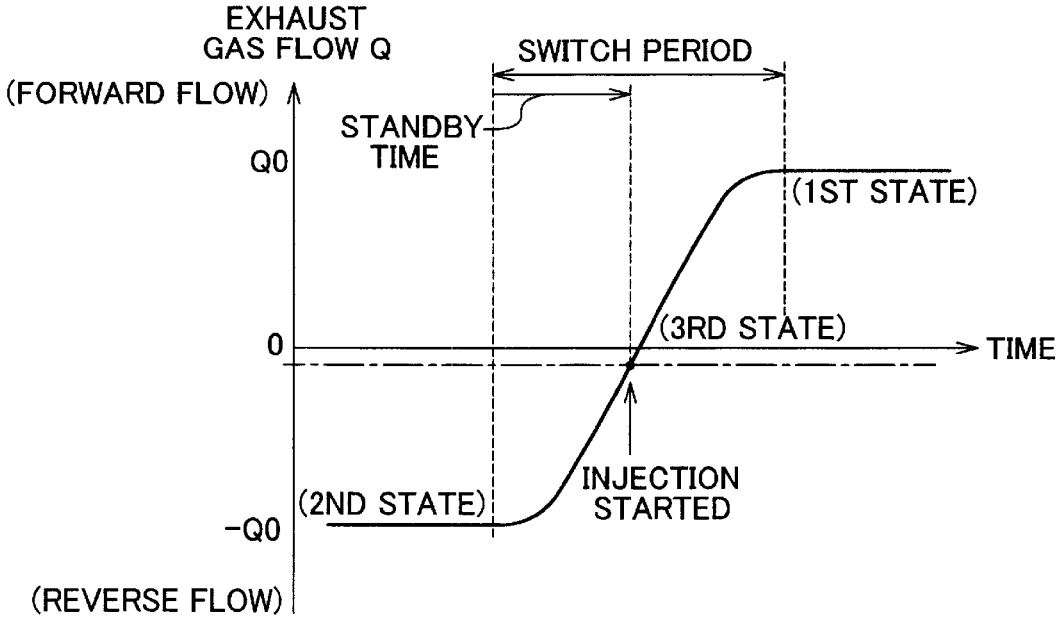

FIGS. 15(A) and 15(B) are diagrams indicating changes in the exhaust gas flow amount near the first emission control portion 210 and the reducer injection start time point. FIG. 15(A) is the same as FIG. 14(A). FIG. 15(B) is substantially the same as FIG. 15(B), except that the reducer injection starting time point is altered.

In FIG. 14(B), the reducer is injected at a time point after the switching valve 251 assumes the third state. In FIG. 15(B), the reducer is injected at a time point immediately before the switching valve 251 assumes the third state. At this moment, exhaust gas flows in the reverse direction, and the exhaust gas flow amount Q is considerably small. Therefore, the reducer slowly moves toward the second emission control portion 220 while diffusing into exhaust gas in the first partial loop passage 30*b*1. The direction of exhaust gas flow reverses, that is, exhaust gas comes to flow in the forward direction, as the switching valve 251 approaches the first state via the third state. Therefore, the reducer moves toward the first emission control portion 210. This allows the reducer to diffuse into exhaust gas to a greater extent than in the case of FIG. 14(B). Furthermore, the reducer slowly flows through the first emission control portion. Therefore, it becomes possible to efficiently recover the emission control function of the first emission control portion 210.

In FIGS. 15(A) and 15(B), the reducer injection starting time point is set so that the amount Q of flow of exhaust gas differs in accordance with the switching direction of the switching valve.

As mentioned above, the switching operation of the switching valve 251 and the reducer injection operation of the reducer injection nozzle 261 are controlled by the ECU 90 (FIG. 3(A)). Specifically, the ECU 90 estimates the amount of emission of carbon-containing particles, NOx, etc., from the history of the operation condition of the engine 100. Then, the engine 100 determines whether there is a need for the switching operation of the switching valve 251, and determines whether there is a need for the reducer injecting operation of the reducer injection nozzle 261. If there is such a need, the switching operation of the switching valve 251 and the reducer injecting operation of the reducer injection nozzle 261 are executed.

In FIGS. 14(A) to 15(B), the ECU 90 changes the standby time from the switching valve switching start time point to the reducer injection start time point, in accordance with the switching direction of the switching valve 251. That is, the standby time is set shorter for the case where the switching valve switches from the first state to the second state than for the case where the switching valve switches from the second state to the first state.

If the state of the switching valve prior to the switching (hereinafter, referred to as "start state") is the first state, the standby time may be set shorter than the time indicated in FIGS. 14(A) and 15(A). For example, the reducer injection start time point may be set at a time point immediately after the switching valve switching start time point. Furthermore, if the start state of the switching valve is the second state, the standby time may be set longer than the time indicated in FIG. 14(B). For example, the reducer injection start time point may be set at a time point slightly prior to the switching valve end time point.

Normally, as for the case where the switching valve switches from the first state to the second state, it is appropriate to set the standby time at a time that elapses until the time point of reversal of the flowing direction of exhaust gas. As for the case where the switching valve switches from the second state to the first state, it is appropriate to set the standby time as a time that elapses until a time point that follows a time point immediately preceding the time point of reversal of the flowing direction of exhaust gas. This makes it possible to reliably supply the injected reducer to the first emission control portion 210 by the flow of exhaust gas, regardless of the switching direction of the switching valve 251. Therefore, the emission control function of the first emission control portion 210 can be recovered without fail.

The time point of reversal of the flowing direction of exhaust gas is substantially the same as the time as which the switching valve is set in the third state. The time point of reversal of the flowing direction may be determined, for example, based on a time point at which an inversion occurs in the magnitude relationship between the pressure in the first partial loop passage **30*b*1 and the pressure in the second partial loop passage 30*b*2**.

A-7. INJECTION OF REDUCER IN ACCORDANCE WITH ENGINE OPERATION CONDITION

Although in FIGS. 14(A) to 15(B), the exhaust gas flow amount Q during the start state of switching valve is Q0, the amount of flow Q0 in reality varies depending on the operation condition of the engine 100. Assuming that the standby time is constant, the exhaust gas flow amount Q near the first emission control portion 210 at the reducer injection start time point varies in accordance with the exhaust gas flow amount Q0 occurring during the start state of the switching valve. If the exhaust gas flow amount Q becomes relatively great, it becomes difficult to efficiently recover the emission control function of the first emission control portion 210. Therefore, it is preferable that the standby time be changed in accordance with the exhaust gas flow amount Q0 that occurs during the start state of the switching valve.

Figure 16A:
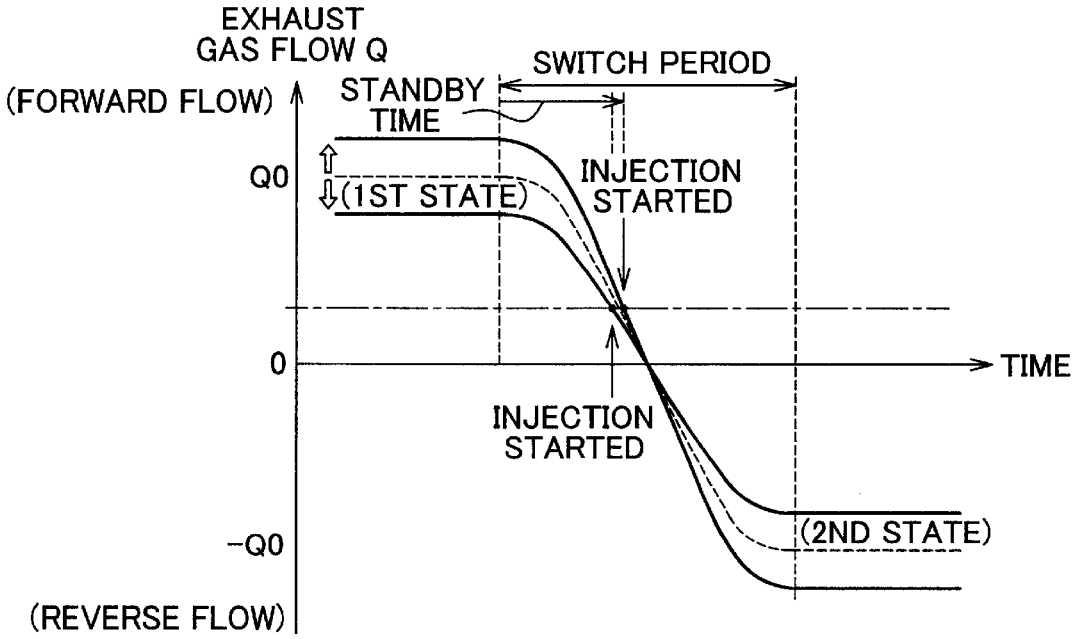
FIGS. 16(A) and 16(B) arc diagrams indicating changes in the exhaust gas flow amount Q and the reducer injection start time point in a case where the exhaust gas flow amount Q0 during the start state of the switching valve changes.
Figure 16B:
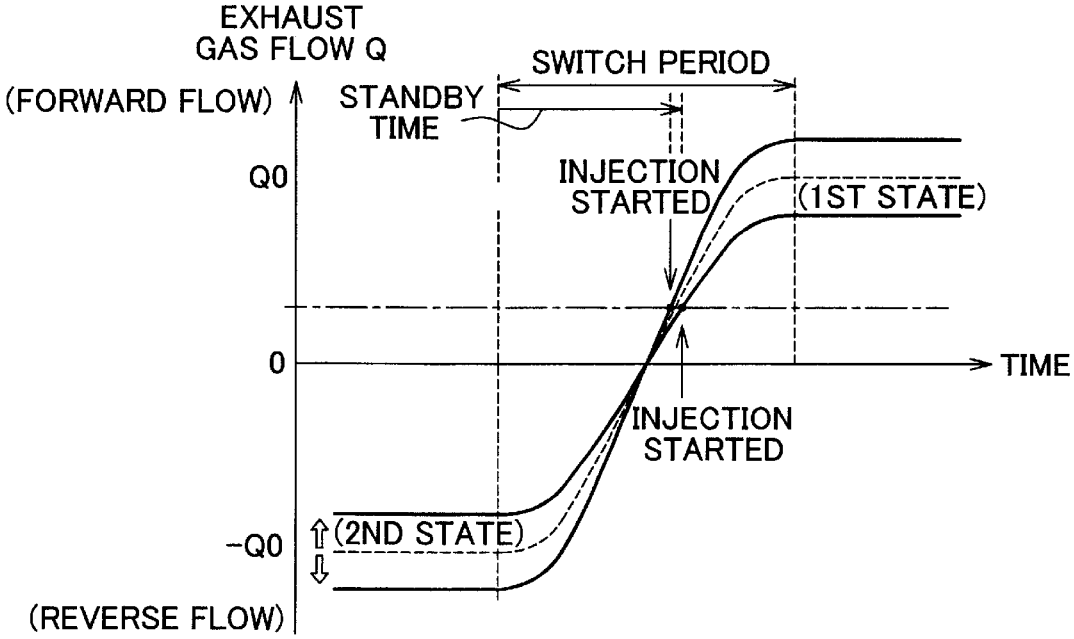

FIGS. 16(A) and 16(B) are diagrams indicating changes in the exhaust gas flow amount Q and the reducer injection start time point in a case where the exhaust gas flow amount Q0 during the start state of the switching valve changes. FIGS. 16(A) and 16(B) correspond to FIGS. 14(A) and 14(B). In FIGS. 16(A) and 16(B), the standby time is changed in accordance with the switching direction of the switching valve 251, and is also changed in accordance with the exhaust gas flow amount Q0 occurring during the start state of the switching valve 251.

As indicated in FIG. 16(A), the standby time in the case where the switching valve switches from the first state to the second state is set longer as the exhaust gas flow amount Q0 during the start state of the switching valve is greater. As indicated in FIG. 16(B), the standby time in the case where the switching valve switches from the second state to the first state is set shorter as the exhaust gas flow amount Q0 during the start state of the switching valve is greater.

Figure 17A:
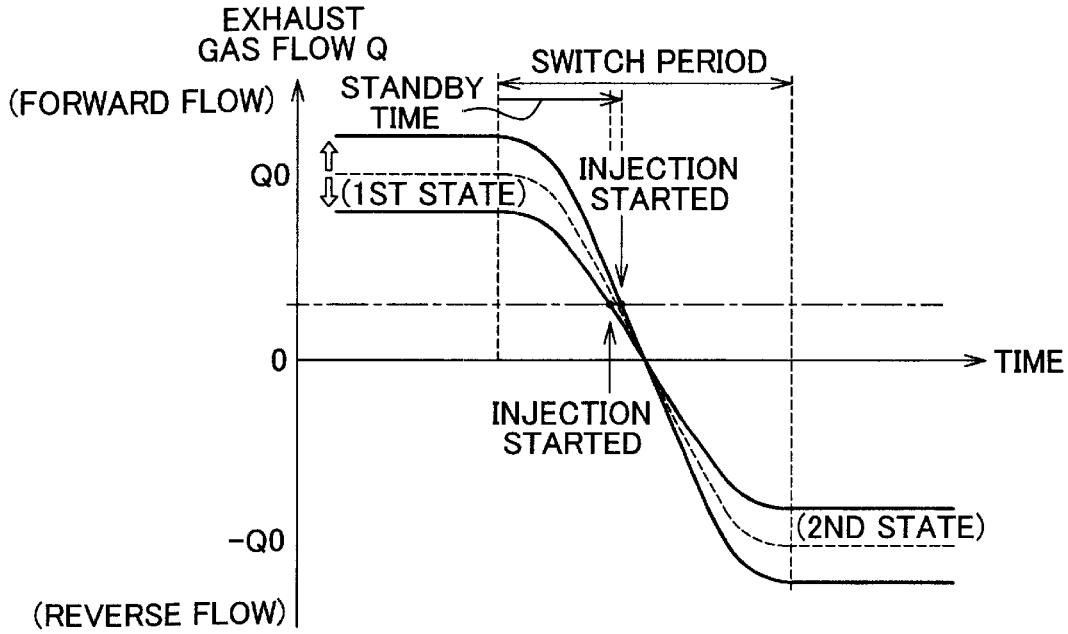
FIGS. 17(A) and 17(B) are diagrams indicating changes in the exhaust gas flow amount Q and the reducer injection start time point in a case where the exhaust gas flow amount Q0 during the start state of the switching valve changes.
Figure 17B:
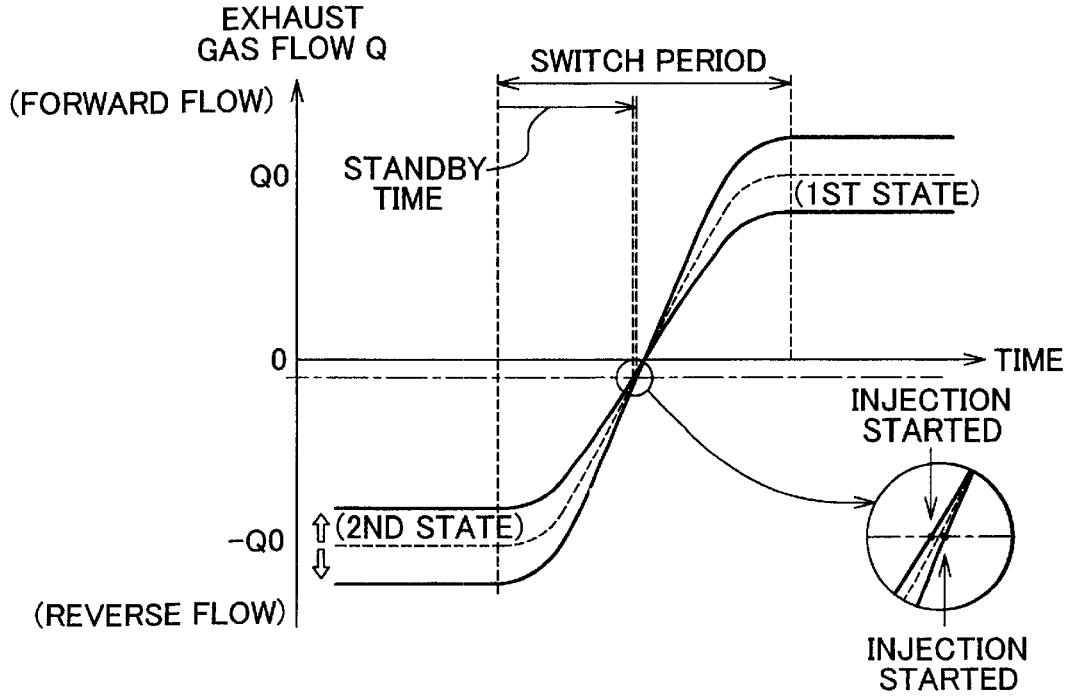

FIGS. 17(A) and 17(B) are also diagrams indicating changes in the exhaust gas flow amount Q and the reducer injection start time point in a case where the exhaust gas flow amount Q0 during the start state of the switching valve changes. FIGS. 17(A) and 17(B) correspond to FIGS. 15(A) and 15(B). FIG. 17(A) is the same as FIG. 16(A). FIG. 17(B) is substantially the same as FIG. 16(B), except that the reducer is injected at a time point immediately before the switching valve 251 assumes the third state. Therefore, the standby times in FIGS. 16(B) and FIG. 17(B) are in an inverse relationship. That is, in FIG. 17(B), the standby time in the case where the switching valve switches from the second stat to the first state is set longer as the exhaust gas flow amount Q0 during the start state of the switching valve is greater.

If the reducer injection start time point is changed in accordance with the exhaust gas flow amount Q0 occurring during the start state of the switching valve as indicated in FIGS. 16(A) to 17(B), the reducer can be injected at such a time point that the exhaust gas flow amount Q near the first emission control portion 210 becomes substantially equal to a predetermined amount, regardless of the operation state of the engine 100. As a result, it becomes possible to efficiently recover the emission control function of the first emission control portion 210.

Normally, it is appropriate for the ECU 90 to change the standby time that elapses from the switching valve switching start time point to the reducer injection start time point in accordance with the switching direction of the switching valve 251, and change the standby time in accordance with the amount of flow Q0 of exhaust gas through the first emission control portion 210 prior to the switching of the switching valve.

The ECU 90 is able to change the standby time for determining the reducer injection start time point in accordance with the exhaust gas flow amount Q0, using any one of various techniques described below.

(A1) FIRST TECHNIQUE

In a first technique, the ECU 90 determines the standby time through the use of the operation condition of the engine. If the operation condition of the engine, such as the engine rotation speed, the amount of accelerator operation, etc., changes, the mass flow and the temperature of exhaust gas discharged from the engine body 10 change, so that the exhaust gas flow amount Q0 during the start state of the switching valve changes. The ECU 90 stores, in an internal memory (not shown), a map that indicates a relationship between the standby time and the engine operation condition such as the engine rotation speed, the amount of accelerator operation, etc. The map is arranged beforehand through experiments or the like. The ECU 90 determines the standby time by detecting the engine operation condition as indicated in FIG. 1 and referring to the map.

(A2) SECOND TECHNIQUE

In a second technique, the ECU 90 determines the standby time through the use of the amount of intake air taken into the combustion chambers #1 to #4. The amount of intake air herein refers to the mass (mass flow) of air taken into the combustion chambers #1 to #4 per unit time. Normally, the amount of intake air is measured via a hot-wire air flow meter (hot-wire anemometer) (not shown) mounted upstream of the throttle valve 26 (FIG. 1). The amount of intake air may instead by estimated from the degree of opening of the throttle valve 26. The amount of intake air changes in accordance with the engine operation condition. Specifically, as the engine load increases, the amount of intake increases, so that the exhaust gas flow amount Q0 during the start state of the switching valve increases. The ECU 90 stores a map that indicates a relationship between the amount of intake air and the standby time, in the internal memory (not shown). The ECU 90 determines the standby time by detecting the amount of intake air and referring to the map.

(A3) THIRD TECHNIQUE

Figure 18:
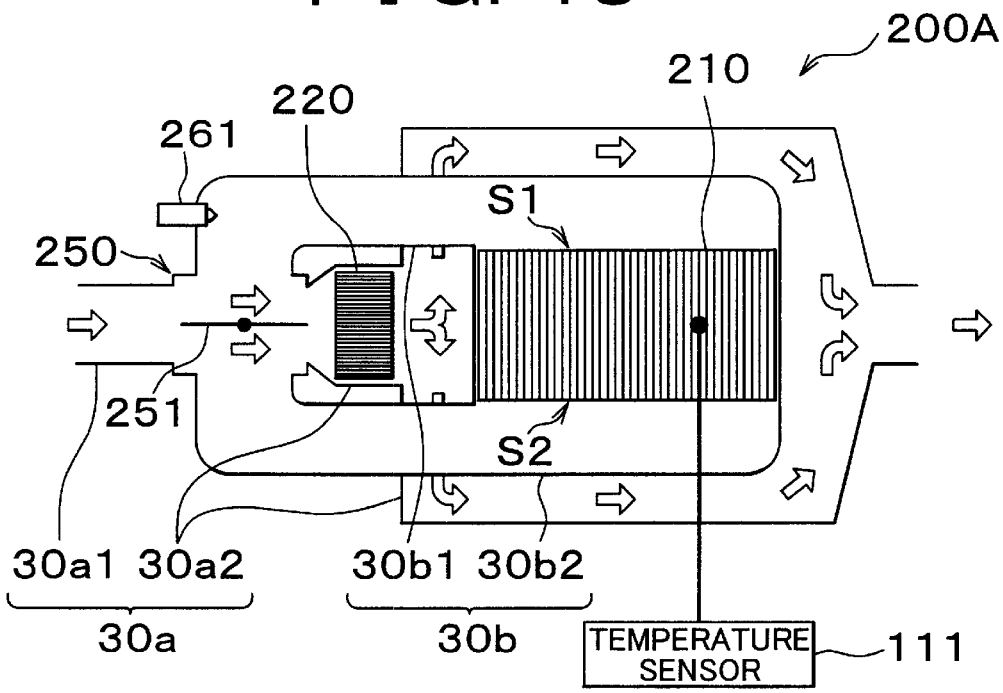
FIG. 18 is a diagram illustrating an emission control unit capable of measuring the exhaust gas temperature.

In a third technique, the ECU 90 determines the standby time through the use of the amount of intake air and the exhaust gas temperature. Even if the amount of intake air remains unchanged, variation in the exhaust gas temperature changes the exhaust gas flow amount Q0 occurring during the start state of the switching valve. In the third technique, therefore, the exhaust gas temperature is used. FIG. 18 is a diagram illustrating an emission control unit 200A capable of measuring the exhaust gas temperature. FIG. 18 is substantially the same as FIGS. 4(A) to 6(A), except that a temperature of exhaust gas in the first emission control portion 210. The temperature sensor 111 is connected to ECU 90, and provides the ECU 90 with measurement results. The ECU 90 stores a map that indicates a relationship among the amount of intake air, the exhaust gas temperature and the standby time, in an internal memory (not shown). The ECU 90 determines the standby time by detecting the amount of intake air and the exhaust gas temperature and referring to the map. This technique makes it possible to more accurately maintain a constant exhaust gas flow amount Q at the time of injection of the reducer, compared with the second technique.

If a mass flow W1 of exhaust gas per unit time passes through the first emission control portion 210 at an exhaust gas temperature T1, a substantially fixed exhaust gas flow amount Q can be maintained at an exhaust gas temperature T2 provided that the mass flow W2 of exhaust gas substantially equals $W1\times(T1/T2)$. That is, if the mass flow of exhaust gas at the time of injection of the reducer is changed in accordance with the exhaust gas temperature, the exhaust gas flow amount Q at the time of injection of the reducer can be kept substantially constant.

As described above, the emission control apparatus of this embodiment has the emission control unit 200. The emission control unit 200 includes the trunk passage 30*a*, the loop passage 30*b* connected to the trunk passage 30*a*, and the path change portion 250 that is provided in a connection portion between the trunk passage and the loop passage and that includes the switching valve 251 for changing the path of exhaust gas. The loop passage 30*b* is provided with the first emission control portion 210 having a filter for removing or purifying NOx and carbon-containing particles present in exhaust gas. The emission control unit 200 is equipped with the reducer supply portion 260 for injecting into the first partial loop passage 30*b*1 a reducing agent for recovering the emission control function of the first emission control portion 210. The path change portion 250 and the reducer injecting portion 260 are controlled by the ECU 90.

Thus, the emission control unit 200 of this embodiment is able to reverse the flow of exhaust gas through the first emission control portion 210 provided in the loop passage 30*b*, by changing the path of exhaust gas through the use of the switching valve 251. Therefore, the emission control unit 200 is able to reduce deposits of carbon-containing particles in the first emission control portion 210. Furthermore, in the emission control unit 200, the provision of the reducer injecting portion 260 makes it possible to recover the emission control function of the emission control unit 200 independently of the operation condition of the internal combustion engine.

Furthermore, the ECU 90 in this embodiment changes the standby time that elapses from the switching valve switching start time point to the reducer injection start time point in accordance with the switching direction of the switching valve 251. Therefore, it is possible to supply the reducer to the first emission control portion 210 regardless of the state of the switching valve 251 prior to the switching. Hence, it becomes possible to recover the emission control function of the first emission control portion 210.

As is apparent from the foregoing description, the first emission control portion 210 in this embodiment corresponds to the emission control portion in the invention, and the ECU 90 in the embodiment corresponds to the control portion in the invention. If the emission control unit 200A illustrated in FIG. 18 is employed, the ECU 90 and the temperature sensor 111 correspond to the control portion.

B. SECOND EMBODIMENT

Figure 19:
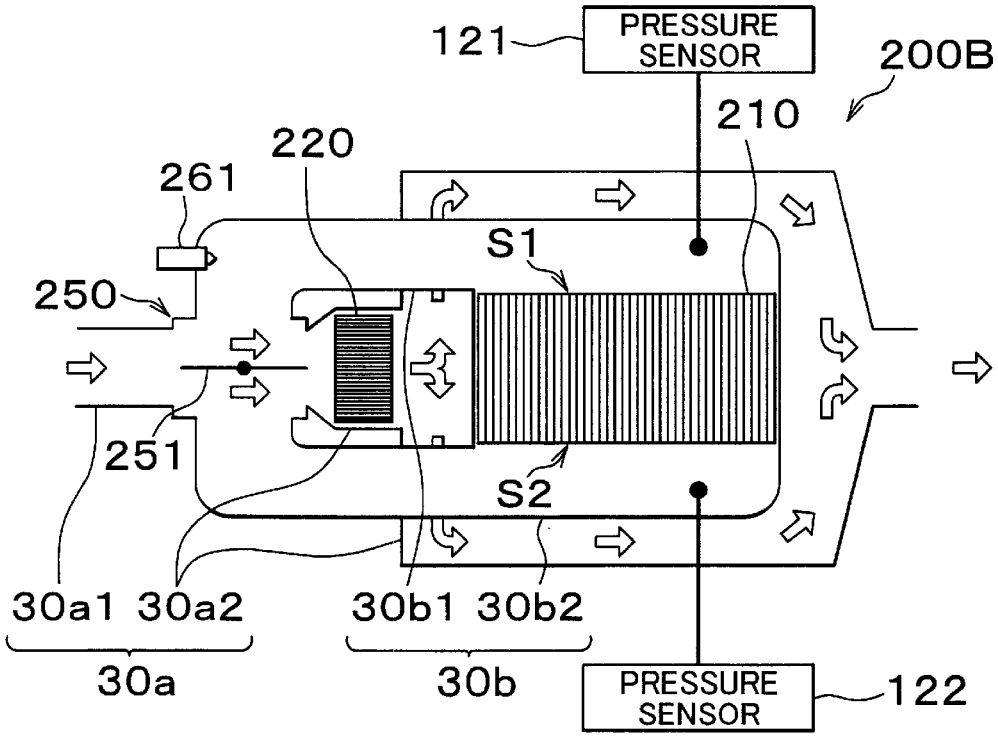
FIG. 19 is a diagram illustrating an emission control unit in a second embodiment.

FIG. 19 is a diagram illustrating an emission control unit 200B in a second embodiment. FIG. 19 is substantially the same as FIGS. 4(A) to 6(A), except that two pressure sensors 121, 122 are added. A first pressure sensor 121 measures the pressure p1 in the first partial loop passage 30*b*1. A second pressure sensor 122 measures the pressure P2 in the second partial loop passage 30*b*2. The two pressure sensors 121, 122 are connected to the ECU 90, and provide the ECU 90 with measurement results. Using the measurement results, the ECU 90 determines a reducer injection start time point.

Figure 20:
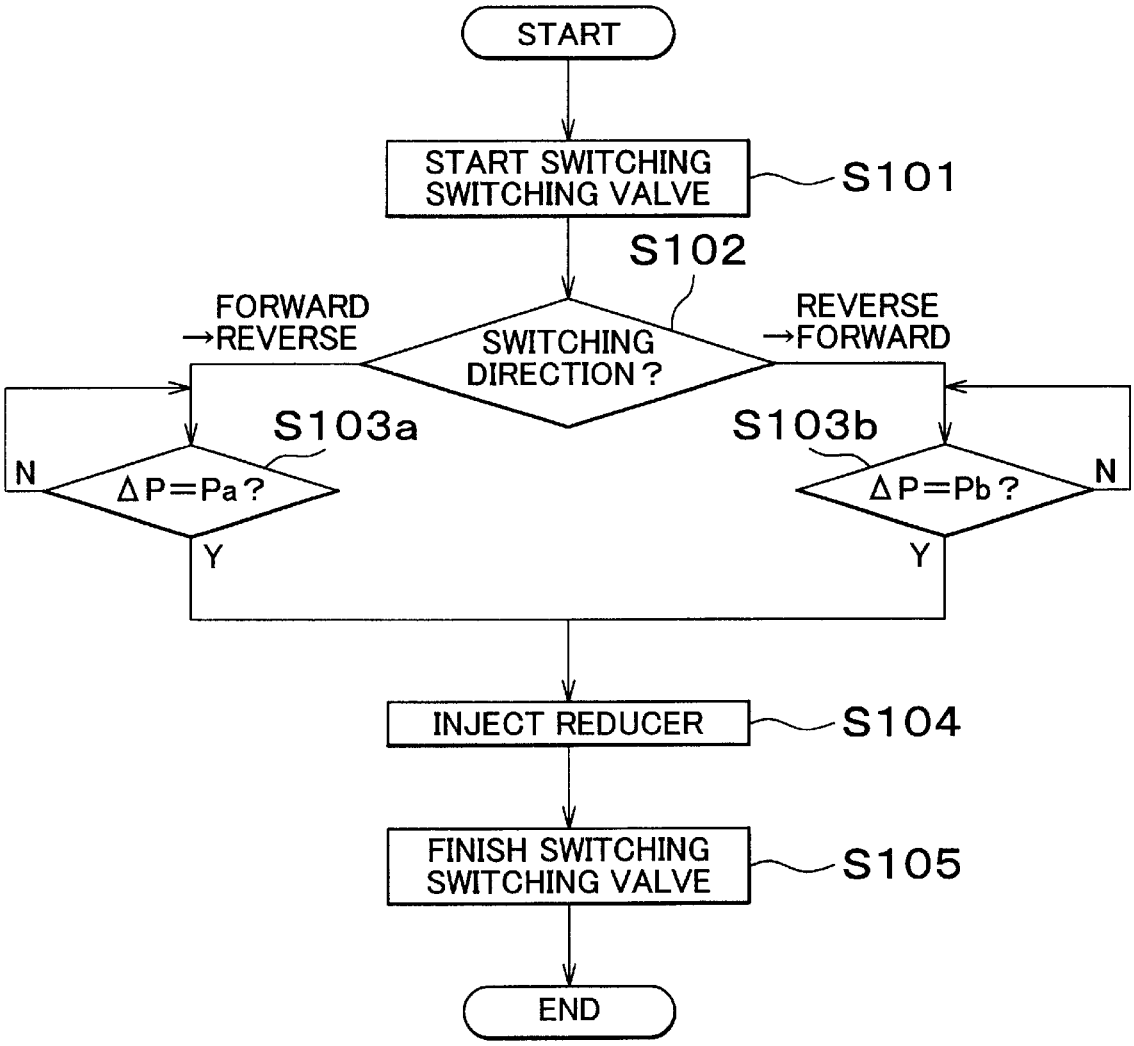
FIG. 20 is a flowchart illustrating a process performed to recover the emission control function of the first emission control portion in the second embodiment.

FIG. 20 is a flowchart illustrating a process performed to recover the emission control function of the first emission control portion 210 in the second embodiment. This process is executed in accordance with an instruction from the ECU 90.

In step S101, the switching operation of the switching valve 251 is started. Subsequently in step S102, the switching direction of the switching valve 251 is determined. The switching direction of the switching valve 251 is designated by the ECU 90, and is therefore known in a normal case. It is also possible for the ECU 90 to determine the switching direction through the use of a signal given to the drive portion 252 of the path change portion 250. If the switching valve switches from the first state to the second state (i.e., if the flow of exhaust gas changes from the forward direction to the reverse direction), the process proceeds to step S103*a*. Conversely, if the switching valve 251 switches from the second state to the first state (i.e., if the flow of exhaust gas changes from the reverse direction to the forward direction), the process proceeds to step S103*b*. In step S103*a*, it is determined whether the difference between measurement results provided by the two pressure sensors 121, 122, that is, the differential pressure ΔP(=P1−P2), equals a pre-set target value Pa. If the differential pressure ΔP equals Pa, the process proceeds to step S104. Likewise, if it is determined in step S103*b* that the differential pressure ΔP(=P1−P2) equals a predetermined set value Pb, the process proceeds to step S104. In step S104, the reducer is injected into the first partial loop passage 30*b*1 for a predetermined time period. Subsequently in step S105, the switching operation of the switching valve 251 ends.

Figure 21:
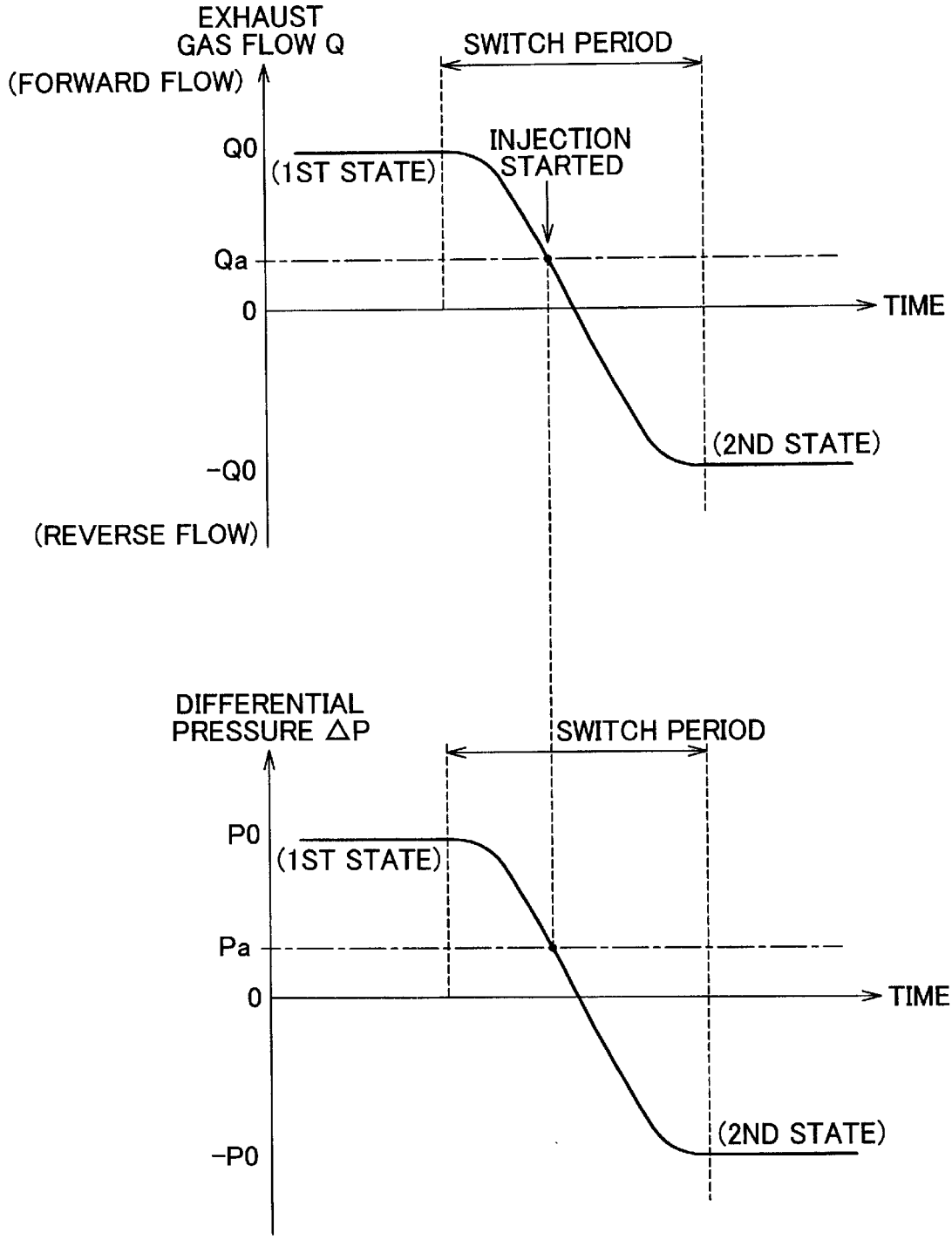
FIG. 21 is diagram indicating changes in the exhaust gas flow amount Q and changes in the differential pressure ΔP.

FIG. 21 is diagram indicating changes in the exhaust gas flow amount Q and changes in the differential pressure ΔP. The upper diagram in FIG. 21 indicates changes in the exhaust gas flow amount Q in a case where the switching valve 251 is switched from the first state to the second state, similar to FIG. 14(A). The lower diagram in FIG. 21 indicates changes in the differential pressure ΔP in a case where the exhaust gas flow amount Q changes as indicated in the upper diagram in FIG. 21.

As indicated in FIG. 21, the differential pressure ΔP is P0 while the switching valve is set in the first state. During the switching period of the switching valve, the differential pressure ΔP gradually decreases. When the switching valve assumes the third state during the switching period, the differential pressure ΔP become substantially equal to "0". When the switching valve is set in the second state, the differential pressure ΔP reaches −P0.

At the time point when it is determined in step S103*a* in FIG. 20 that the differential pressure ΔP has reached the target value Pa, the exhaust gas flow amount Q becomes substantially equal to Qa. Therefore, if injection of the reducer is started when the differential pressure ΔP reaches the target value Pa, the reducer can be injected precisely in timing when the exhaust gas flow amount Q becomes substantially equal to Qa.

Figure 22:
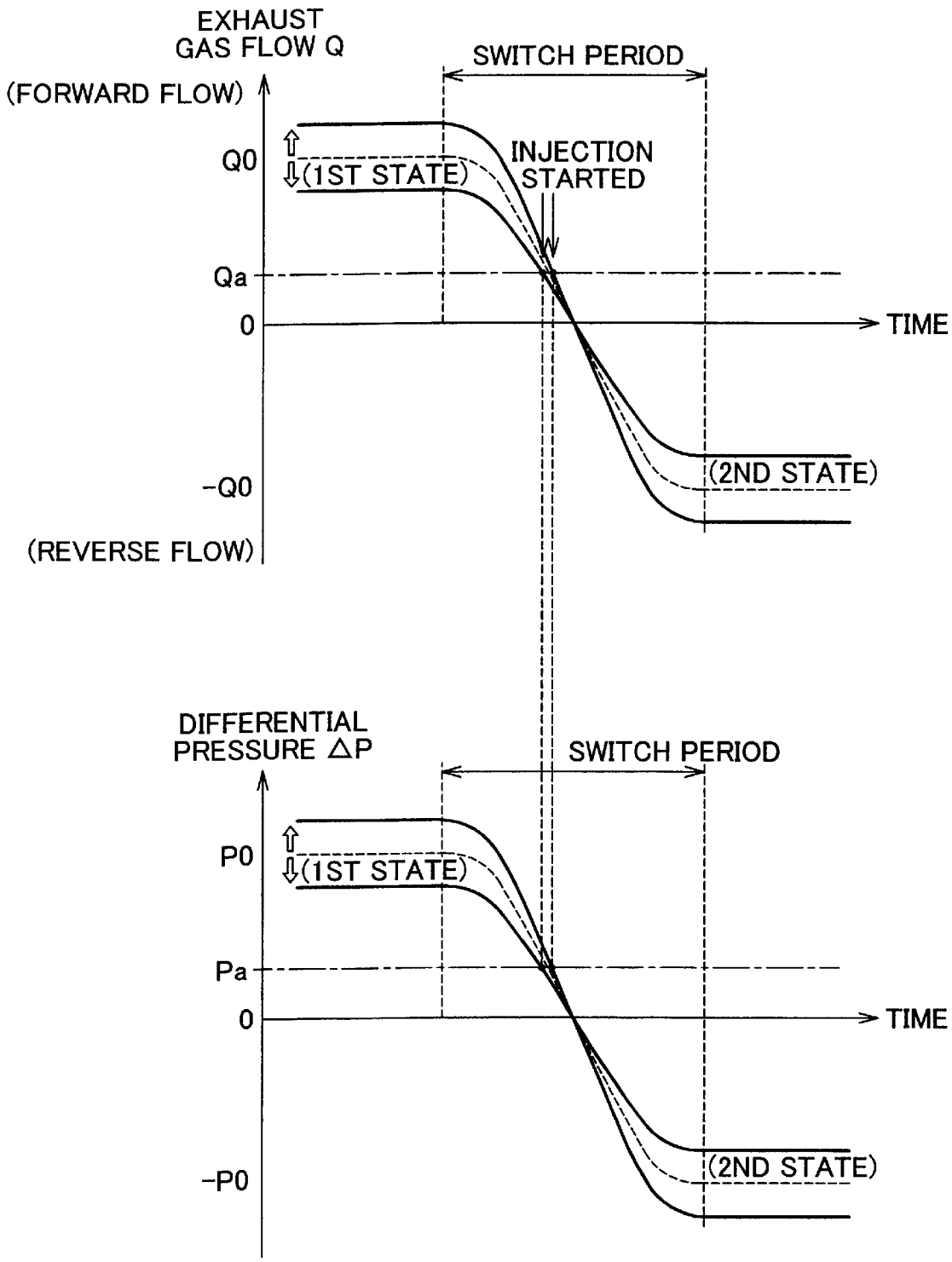
FIG. 22 is diagram indicating changes in the exhaust gas flow amount Q and changes in the differential pressure ΔP in a case where the exhaust gas flow amount Q0 during the start state of the switching valve changes.

As mentioned above, the exhaust gas flow amount Q0 during the start state of the switching valve changes in accordance with the operation condition of the engine 100. FIG. 22 is diagram indicating changes in the exhaust gas flow amount Q and changes in the differential pressure ΔP in a case where the exhaust gas flow amount Q0 during the start state of the switching valve changes. The upper diagram and the lower diagram in FIG. 22 correspond to the upper diagram and the lower diagram in FIG. 21. The amount of flow Q of exhaust gas through the first emission control portion 210 is substantially determined by the differential pressure ΔP. That is, if the exhaust gas flow amount Q0 during the start state of the switching valve is relatively great, the differential pressure ΔP0 at that time is also relatively high. Therefore, if the injection of the reducer is started when it is determined in step S103*a* in FIG. 20 that the differential pressure ΔP has become equal to the target value Pa, the reducer can be injected precisely in timing when the exhaust gas flow amount Q becomes substantially equal to Qa, regardless of the exhaust gas flow amount Q0 occurring during the start state of the switching valve.

Although in FIG. 21, the switching valve switches from the first state to the second state, a similar operation applies in the case where the switching valve switches from the second state to the first state. That is, by starting the injection of the reducer when it is determined in step S103*b* in FIG. 20 that the differential pressure ΔP has become equal to the target value Pb, the reducer can be injected precisely in timing when the exhaust gas flow amount Q becomes substantially equal to Qb.

Furthermore, although FIG. 20 illustrates a process performed in the case where the target value of the differential pressure ΔP is changed in accordance with the switching direction of the switching valve, it is also possible to set the target value of the differential pressure ΔP at a fixed value (e.g., Pa) independently of the switching direction of the switching valve. This allows omission of steps S102 and S103*b* in FIG. 20. However, by executing the process of FIG. 20, the exhaust gas flow amount Q through the first emission control portion 210 at the time of injection of the reducer can be changed in accordance with the switching direction of the switching valve.

As described above, the emission control unit 200B in this embodiment includes the two pressure sensors 121, 122 for measuring the pressure P1 in the first partial loop passage 30*b*1 and the pressure P2 in the second partial loop passage 30*b*2. The ECU 90 injects the reducer when the differential pressure ΔP between the pressures P1, P2 becomes equal to a predetermined target value. This makes it possible to inject the reducer precisely in timing when the amount of flow of exhaust gas through the first emission control portion 210 becomes substantially equal to a predetermined amount.

The ECU 90 and the two pressure sensors 121, 122 in this embodiment correspond to the control portion in the invention.

C. THIRD EMBODIMENT

Figure 23:
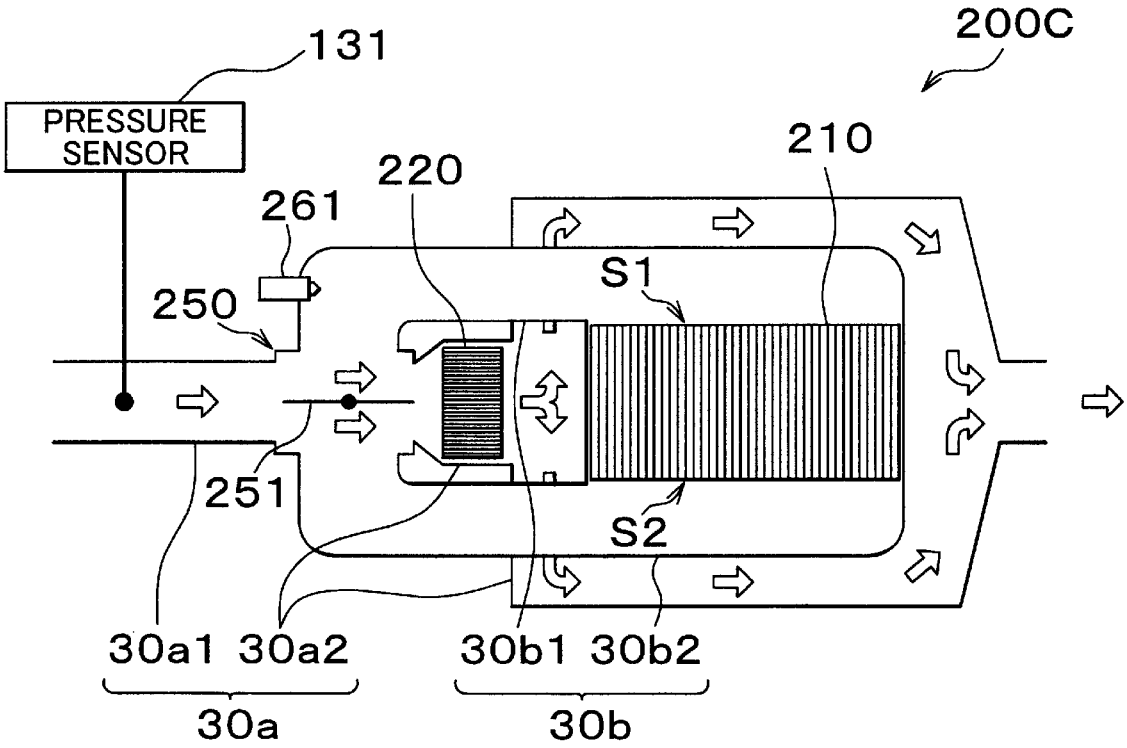
FIG. 23 is a diagram illustrating an emission control unit in a third embodiment.

FIG. 23 is a diagram illustrating an emission control unit 200C in a third embodiment. FIG. 23 is substantially the same as FIG. 19, except that a pressure sensor 131 is provided instead of the two pressure sensors 121, 122. The pressure sensor 131 measures the pressure in the upstream-side partial trunk passage 30*a*1 (hereinafter, simply referred to as "back pressure") PE. The pressure sensor 131 is connected to the ECU 90, and provides the ECU 90 with measurement results. Using the measurement results, the ECU 90 determines a reducer injection start time point.

Figure 24:
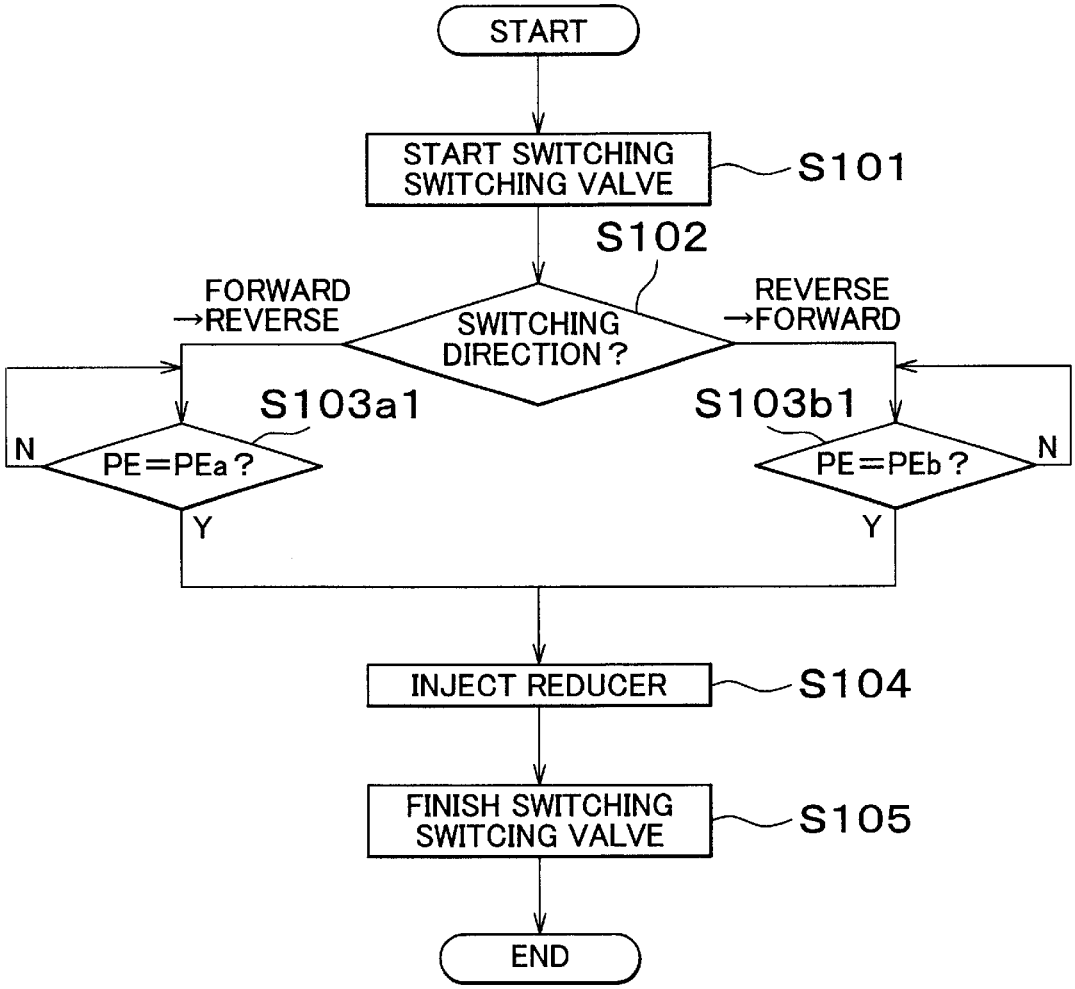
FIG. 24 is a flowchart illustrating a process performed to recover the emission control function of the first emission control portion in the third embodiment.

FIG. 24 is a flowchart illustrating a process performed to recover the emission control function of the first emission control portion 210 in the third embodiment. FIG. 24 is substantially the same as FIG. 20, except that steps S103*a*1 and S103*b*1 are modified.

In step S103*a*1, it is determined whether a measurement result provided by the pressure sensor 131, that is, the back pressure PE, is equal to a pre-set target value PEa. If the back pressure PE equals PEa, the process proceeds to step S104. Likewise, if it is determined in step S103*b*1 that the back pressure PE equals a pre-set target value PEb, the process proceeds to step S104.

Figure 25:
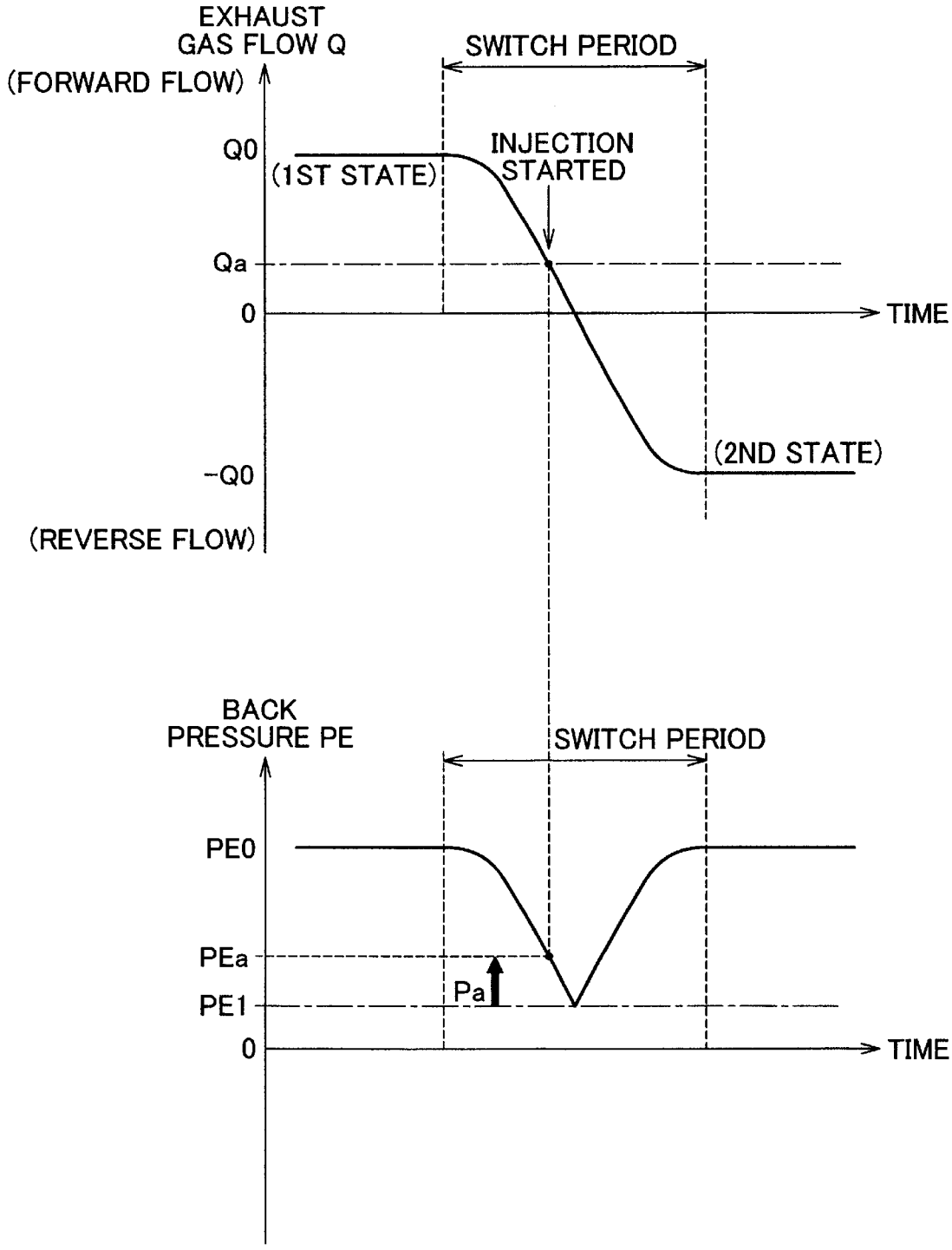
FIG. 25 is diagram indicating changes in the exhaust gas flow amount Q and changes in the back pressure PE.

FIG. 25 is diagram indicating changes in the exhaust gas flow amount Q and changes in the back pressure PE. The upper diagram in FIG. 25 indicates changes in the exhaust gas flow amount Q in a case where the switching valve 251 is switched from the first state to the second state, similar to FIG. 14(A). The lower diagram in FIG. 25 indicates changes in the back pressure PE in a case where the exhaust gas flow amount Q changes as indicated in the upper diagram in FIG. 25.

As indicated in the lower diagram in FIG. 25, the back pressure PE is PE0 while the switching valve is set in the first state. Then, as the switching valve 251 switches from the first state to the third state, the back pressure PE decreases to PE1. As switching valve 251 switches from the third state to the second state, the back pressure PE increases again to PE0. The minimum value of back pressure (minimum back pressure) PE1 is ascribable to a pressure loss that occurs in a passage portion downstream of the second emission control portion 220.

The exhaust gas flow amount Q becomes substantially equal to Qa at a time point when it is determined in step S103*a*1 in FIG. 24 that the back pressure PE equals the target value PEa. Therefore, if the injection of the reducer is started when the back pressure PE equals the target value PEa, it becomes possible to inject the reducer precisely in timing when the exhaust gas flow amount Q becomes substantially equal to Qa.

As mentioned above, the exhaust gas flow amount Q0 during the start state of the switching valve varies depending on the operation condition of the engine 100. The emission control unit 200B in the second embodiment (FIG. 19) is able to inject the reducer when the exhaust gas flow amount Q becomes substantially equal to the predetermined amount, independently of the operation state of the engine, due to the use of the differential pressure ΔP obtained from the two pressure sensors 121, 122. In contrast, the emission control unit 200C shown in FIG. 23 uses the back pressure PE obtained from the pressure sensor 131. Therefore, in the case of the emission control unit 200C, it becomes relatively difficult to inject the reducer when the exhaust gas flow amount Q becomes substantially equal to the predetermined amount, if the engine operation state changes.

Therefore, the ECU 90 changes a target value of back pressure (target back pressure) for determining the reducer injection start time point in accordance with the exhaust gas flow amount Q0 through the use of any one of various techniques described below.

(C1) FIRST TECHNIQUE

In a first technique, the ECU 90 determines the back pressure through the use of the operation condition of the engine. The ECU 90 stores, in an internal memory (not shown), a map that indicates a relationship between the back pressure and the engine operation condition such as the engine rotation speed, the amount of accelerator operation, etc. The ECU 90 determines the back pressure by detecting the engine operation condition and referring to the map.

(C2) SECOND TECHNIQUE

Figure 26:
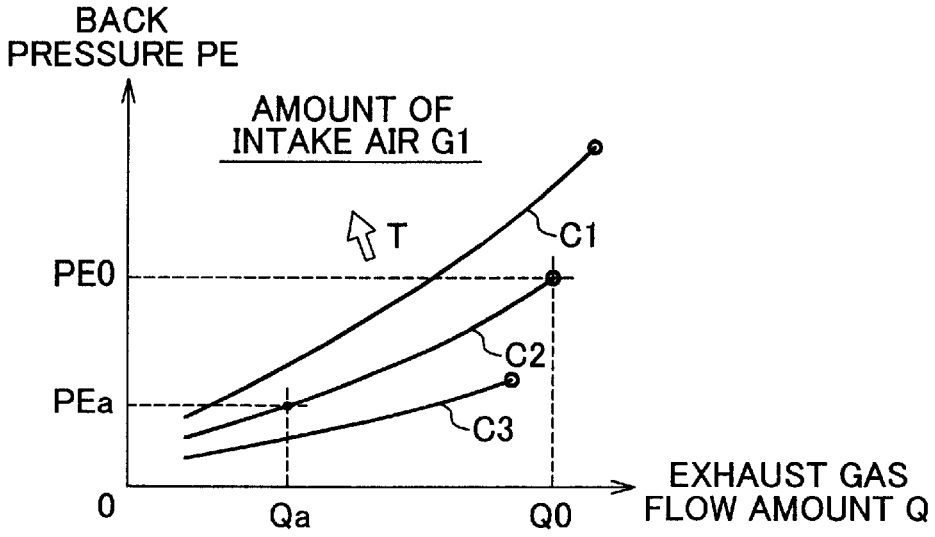
FIG. 26 is a diagram indicating a relationship between the back pressure PE and the amount of flow Q of exhaust gas that flows through the first emission control portion in the case of a specific amount of intake air.

In a second technique, the ECU 90 determines a target back pressure by using the back pressure that occurs during the start state of the switching valve (hereinafter, also referred to as "initial back pressure"), and the amount of intake air taken into the combustion chambers #1 to #4. FIG. 26 is a diagram indicating a relationship between the back pressure PE and the amount of flow Q of exhaust gas that flows through the first emission control portion 210 in the case of a specific amount of intake air. FIG. 26 indicates a case where the amount of intake air G is G1. In FIG. 26, relationship between the back pressure PE and the exhaust gas flow amount Q in accordance with the exhaust gas temperature T are exemplified by three curves C1 to C3. The curve C1 indicates a case where the exhaust gas temperature T is relatively high. For example, if the back pressure PE during the start state of the switching valve is PE0, the second curve C2 is selected. On the second curve C2, the target value of back pressure PE at which the exhaust gas flow amount Q becomes equal to the target amount of flow Qa is PEa. In this case, therefore, it is appropriate to start injecting the reducer when the back pressure PE reaches PEa. The relationship indicated in FIG. 26 varies in accordance with the value of the amount of intake air G. Therefore, the ECU 90 stores, in its internal memory (not shown), a map corresponding to values of the amount of intake air G as indicated in FIG. 26. Then, the ECU 90 determines a target back pressure by detecting the amount of intake air and the initial back pressure and referring to the map.

(C3) THIRD TECHNIQUE

Figure 27:
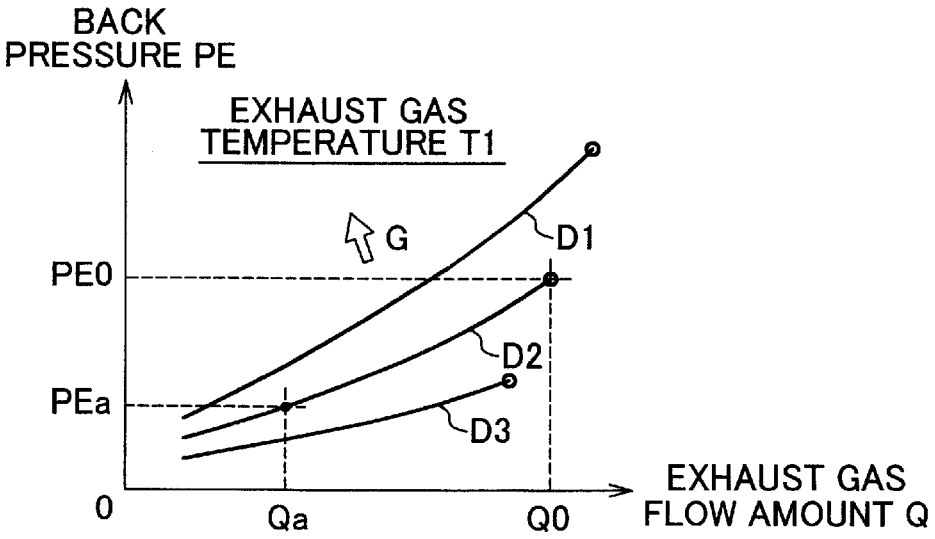
FIG. 27 is a diagram indicating a relationship between the back pressure PE and the exhaust gas flow amount Q through the first emission control portion in the case of a specific exhaust gas temperature.

In a third technique, the ECU 90 determines a target back pressure by using the initial back pressure and the exhaust gas temperature. FIG. 27 is a diagram indicating a relationship between the back pressure PE and the exhaust gas flow amount Q through the first emission control portion 210 in the case of a specific exhaust gas temperature. FIG. 27 indicates a case where the exhaust gas temperature T is T1. In FIG. 27, three curves D1 to D3 exemplify relationships between the back pressure PE and the exhaust gas flow amount Q in accordance with the amount of intake air G. The curve D1 indicates a case where the amount of intake air G is relatively high. For example, if the back pressure PE during the start state of the switching valve is PE0, the second curve D2 is selected. On the second curve D2, the target value of back pressure PE at which the exhaust gas flow amount Q becomes equal to the target amount of flow Qa is PEa. In this case, therefore, it is appropriate to start injecting the reducer when the back pressure PE reaches PEa. The relationship indicated in FIG. 27 varies in accordance with the value of the exhaust gas temperature T. Therefore, the ECU 90 stores, in its internal memory (not shown), a map corresponding to values of the exhaust gas temperature T as indicated in FIG. 27. Then, the ECU 90 determines a target back pressure by detecting the exhaust gas temperature and the initial back pressure and referring to the map.

If the third technique is adopted, the temperature sensor 111 as shown in FIG. 18 is added to the emission control unit 200C shown in FIG. 23.

(C4) FOURTH TECHNIQUE

Although the target back pressure indicated in FIGS. 26 and 27 are values determined on the assumption that the first emission control portion 210 has no deposit of carbon-containing particles, there are actual cases where the first emission control portion 210 has a small amount of carbon-containing particles deposited. In such a case, the pressure loss in the first emission control portion 210 becomes great. Therefore, the exhaust gas flow amount Q through the first emission control portion 210 varies depending on the amount of deposit of carbon-containing particles, even though the target back pressure remains unchanged. Hence, in the fourth technique, the target back pressure is determined, taken the amount of deposit of carbon-containing particles into account.

Figure 28A:
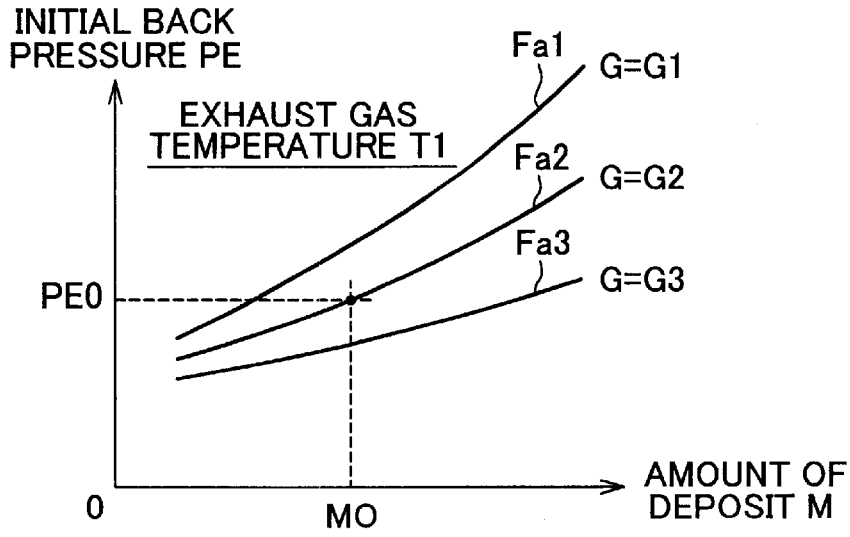
FIGS. 28(A) and 28(B) are diagrams indicating the back pressure PE and the amount of deposit M of carbon-containing particles in the first emission control portion in the case of a specific exhaust gas temperature.
Figure 28B:
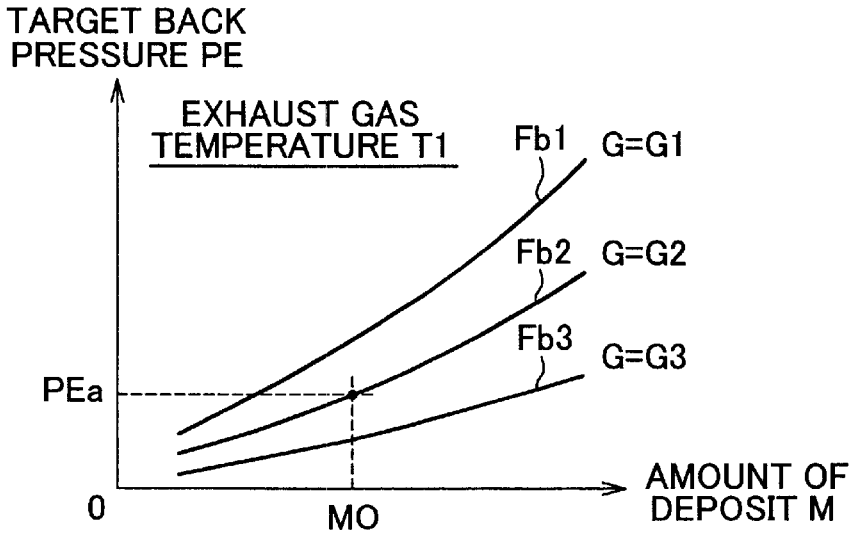

That is, in the fourth technique, the ECU 90 determines a target back pressure by using the initial back pressure, the amount of intake air and the exhaust gas temperature. FIGS. 28(A) and 28(B) are diagrams indicating the back pressure PE and the amount of deposit M of carbon-containing particles in the first emission control portion 210 in the case of a specific exhaust gas temperature. In FIGS. 28(A) and 28(B), the exhaust gas temperature T is T1. In FIG. 28(A), three curves Fa1 to Fa3 exemplify relationships between the initial back pressure PE and the amount of deposit M in accordance with the amount of intake air G. In FIG. 28(B), three curves Fb1 to Fb3 exemplify relationships between the target back pressure PE and the amount of deposit M corresponding to the amounts of intake air G indicated in FIG. 28(A). The curves Fa1, Fb1 indicate a case where the amount of intake air G is relatively high. For example, if the amount of intake air G is G2, the second curve Fa2 in FIG. 28(A) is selected. Then, if the initial back pressure PE is PE0, the amount of deposit M is estimated at M0. Furthermore, since the amount of intake air G is G2 as mentioned above, the second curve Fb2 is selected in FIG.

28(B). Then, on the second curve Pb2, the back pressure PE is determined as PEa through the use of the estimated amount of deposit M0. Therefore, in this case, it is appropriate to start injecting the reducer when the back pressure PE becomes equal to PEa. The relationship indicated in FIGS. 28(A) and 28(B) varies depending on the value of the exhaust gas temperature T. Therefore, the ECU 90 stores, in an internal memory (not shown), a map as indicated in FIGS. 28(A) and 28(B) in accordance with the value of exhaust temperature T. Then, the ECU 90 determines a target back pressure by detecting the exhaust gas temperature, the amount of intake air and the initial back pressure and referring to the map. Although in FIGS. 28(A) and 28(B), the amount of deposit M of carbon-containing particles is estimated for the convenience in illustration, it is also possible to directly determine a target back pressure without estimating an amount of deposit M.

If the fourth technique is adopted, the temperature sensor 111 shown in FIG. 18 is added to the emission control unit 200C shown in FIG. 23.

Although in the second to fourth techniques described above, the target back pressure is determined through the use of various parameters, it is also possible to combine the first technique with any of the second to fourth technique so that the target back pressure obtained by the first technique is corrected. In this case, the map as indicated in FIGS. 26 to 28(B) contains corrected values of target back pressure instead of simple target back pressure.

(C5) FIFTH TECHNIQUE

Figure 29:
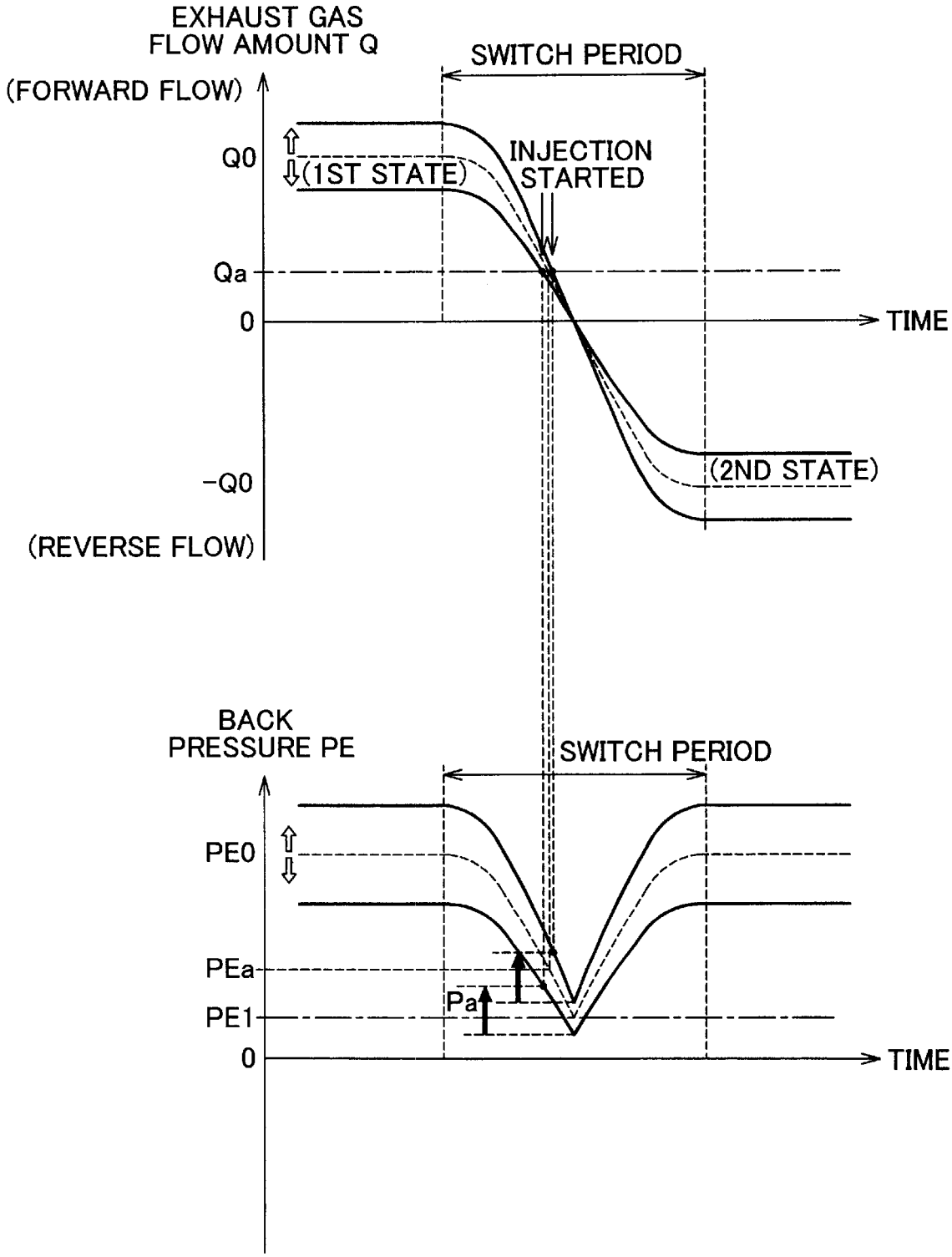
FIG. 29 is diagrams indicating changes in the back pressure PE and changes in the exhaust gas flow amount Q in a case where the exhaust gas flow amount Q0 during the start state of the switching valve changes.

In a fifth technique, the ECU 90 determines a target back pressure by using only the initial back pressure. FIG. 29 is diagram indicating changes in the back pressure PE and changes in the exhaust gas flow amount Q in a case where the exhaust gas flow amount Q0 during the start state of the switching valve changes. The upper diagram and the lower diagram in FIGS. 29 correspond to the upper diagram and the lower diagram in FIG. 25. As indicated in FIG. 29, if the exhaust gas flow amount Q0 occurring during the start state of the switching valve changes, the initial back pressure PE0 changes. Furthermore, the minimum back pressure PE1 occurring when the switching valve 251 assumes the third state also changes. In FIG. 25, the target back pressure PEa is set at a value that is a predetermined pressure Pa higher than the minimum back pressure PE1. In this case, the difference between the pressure in the first partial loop passage 30*b*1 and the pressure in the second partial loop passage 30*b*2 (i.e., the differential pressure ΔP in the second embodiment) is Pa. Therefore, if the minimum value PE1 of back pressure corresponding to the initial back pressure PE0 is determined beforehand and a target back pressure is determined by adding Pa to the minimum value PE1, it is considered possible to start injecting the reducer when the exhaust gas flow amount Q becomes substantially equal to Qa, even in a case where the exhaust gas flow amount Q0 during the start state of the switching valve changes as indicated in the upper diagram in FIG. 29. If this technique is adopted, the ECU 90 stores in its internal memory (not shown) a map that indicates a relationship between the initial back pressure and the target back pressure. Then, the ECU 90 determines a target back pressure by detecting the initial back pressure and referring to the map.

Although this embodiment has been described in conjunction with the case where the switching valve switches from the first state to the second state, a similar operation applies in the case where the switching valve switches from the second state to the first state. That is, by starting the injection of the reducer when it is determined in step S103*b*1 in FIG. 24 that the back pressure PE has become equal to the target value PEb, the reducer can be injected precisely in timing when the exhaust gas flow amount of Q becomes substantially equal to Qb.

However, one switching period of the switching valve includes two time points at which the back pressure PE becomes equal to the target back pressure as indicated in the lower diagram in FIG. 25. Therefore, it is necessary to inject the reducer precisely in timing at one of the time points. Specifically, if the reducer is to be injected within a period from the start state of the switching valve (e.g., the second state) to the third state during the switching period of the switching valve, it is appropriate to inject the reducer at the first (earlier) time point at which the back pressure PE becomes equal to the target back pressure. Conversely, if the reducer is to be injected within a period from the third state of the switching valve to the end state (e.g., the first state), it is appropriate to inject the reducer at the second time point at which the back pressure PE becomes equal to the target back pressure.

Although in the process illustrated in FIG. 24, the target value of back pressure PE is changed in accordance with the switching direction of the switching valve, it is also possible to set the target value of back pressure PE at a fixed value (e.g., PEa) regardless of the switching direction of the switching valve. This allows omission of steps S102 and S103*b*1 from the process illustrated in FIG. 24. However, execution of the process illustrated in FIG. 24 makes it possible to change the amount Q of exhaust gas flowing through the first emission control portion 210 at the time of injection of the reducer in accordance with the switching direction of the switching valve.

If the foregoing technique is employed, the ECU 90 is able to relatively accurately determine such a target value that the exhaust gas flow amount Q through the first emission control portion 210 at an intermediate point during the switching period of the switching valve becomes substantially equal to a predetermined amount.

As described above, the emission control unit 200C in this embodiment includes the pressure sensor 131 for measuring the pressure (back pressure) in the upstream-side partial trunk passage 30*a*1 provided upstream of the path change portion 250. Then, the ECU 90 injects the reducer when the back pressure becomes equal to a predetermined target value. This manner of operation makes it possible to inject the reducer precisely in timing when the amount of exhaust gas flowing through the first emission control portion 210 becomes substantially equal to a predetermined amount.

The ECU 90 and the pressure sensor 131 in this embodiment correspond to the control portion in the invention.

D. FOURTH EMBODIMENT

While in the second embodiment, the reducer is injected during the switching operation of the switching valve based on the differential pressure ΔP, the fourth embodiment temporarily stops the switching operation of the switching valve to inject the reducer on the basis of the differential pressure ΔP.

Figure 30:
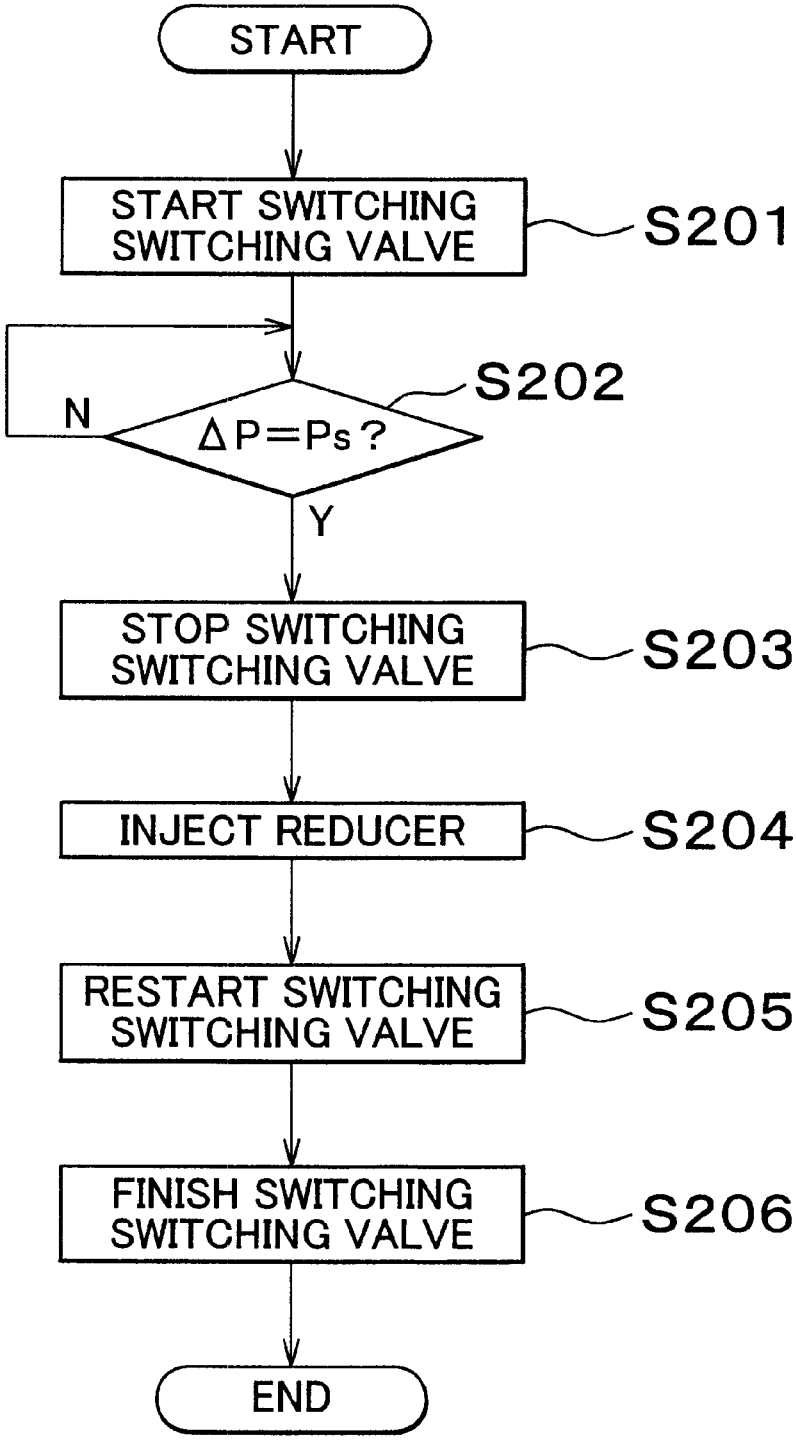
FIG. 30 is a flowchart illustrating a process performed to recover the emission control function of the first emission control portion in a fourth embodiment.

FIG. 30 is a flowchart illustrating a process performed to recover the emission control function of the first emission control portion 210 in the fourth embodiment. The process illustrated in FIG. 30 is executed in the emission control unit 200B shown in FIG. 19.

In step S201, the switching operation of the switching valve 251 is started. Subsequently in step S202, it is determined whether the difference between the measurement results provided by the two pressure sensors 121, 122 (FIG. 19), that is, the differential pressure ΔP(=P1−P2), is equal to a pre-set target value Ps. If the differential pressure ΔP equals Ps, the process proceeds to step S203. In step S203, the switching operation of the switching valve 251 is stopped for a predetermined period. Subsequently in step S204, the reducer is injected into the first partial loop passage 30*b*1 for a predetermined period. After the reducer is injected, the switching operation of the switching valve 251 is restarted in step S205. Subsequently in step S206, the switching operation of the switching valve 251 ends.

In FIG. 30, the switching valve is stopped at an intermediate point during the switching operation in step S203. Therefore, a process of determining the switching direction of the switching valve as in step S102 in FIG. 20 is omitted. If the switching valve is stopped halfway during the switching operation, it is possible to inject the reducer substantially at the time of a predetermined direction and a predetermined amount of flow of exhaust gas near the first emission control portion 210, regardless of the switching direction of the switching valve.

Figure 31A:
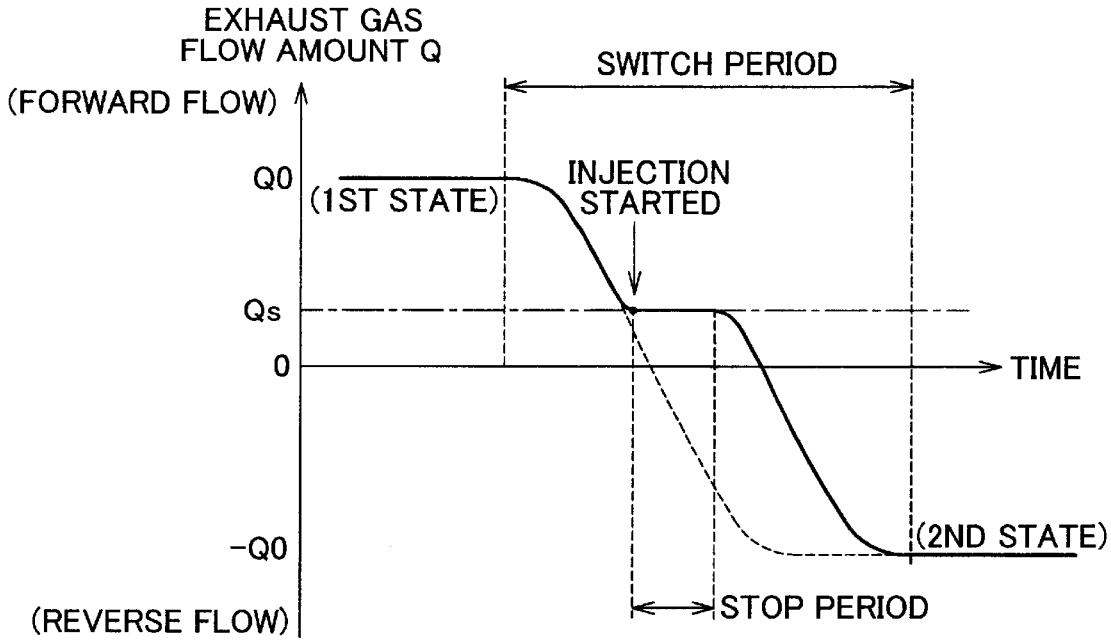
FIGS. 31(A) and 31(B) are diagrams indicating the reducer injection start time point and changes in the exhaust gas flow amount Q in a case where the switching valve is stopped halfway during the switching of the valve.
Figure 31B:
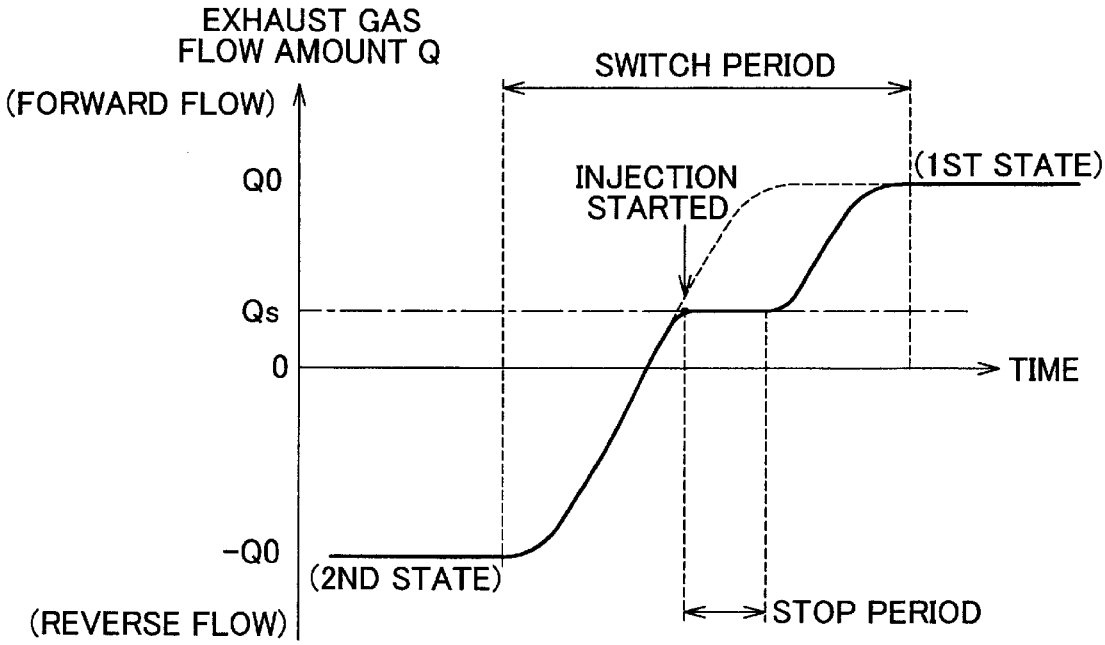

FIGS. 31(A) and 31(B) are diagrams indicating the reducer injection start time point and changes in the exhaust flow amount Q in a case where the switching valve is stopped halfway during the switching of the valve. FIGS. 31(A) and 31(B) correspond to FIGS. 14(A) and 14(B). The exhaust gas flow amount Q becomes substantially equal to Qs at a time point when it is determined in step S202 in FIG. 30 that the differential pressure ΔP becomes equal to the target value Ps. Therefore, if the switching operation of the switching valve is stopped and the injection of the reducer is started when the differential pressure ΔP becomes equal to the target value Ps, it becomes possible to inject the reducer while the exhaust gas flow amount Q is substantially kept at Qs.

Figure 32A:
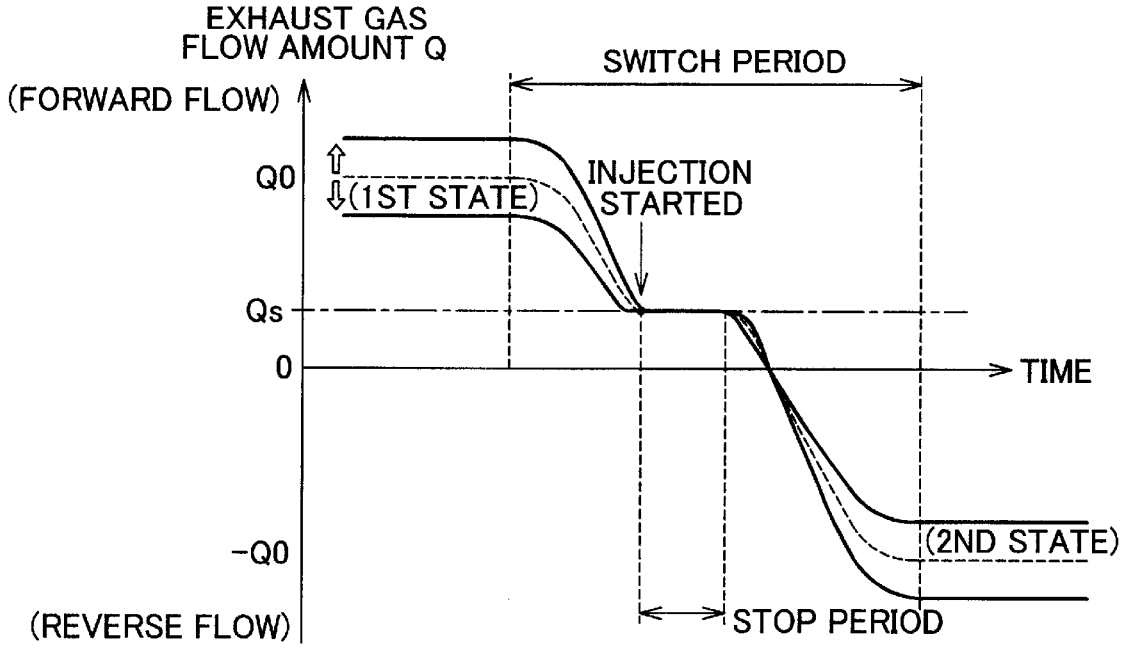
FIGS. 32(A) and 32(B) are diagrams indicating a case where the exhaust gas flow amount Q0 during the start state of the switching valve changes.
Figure 32B:
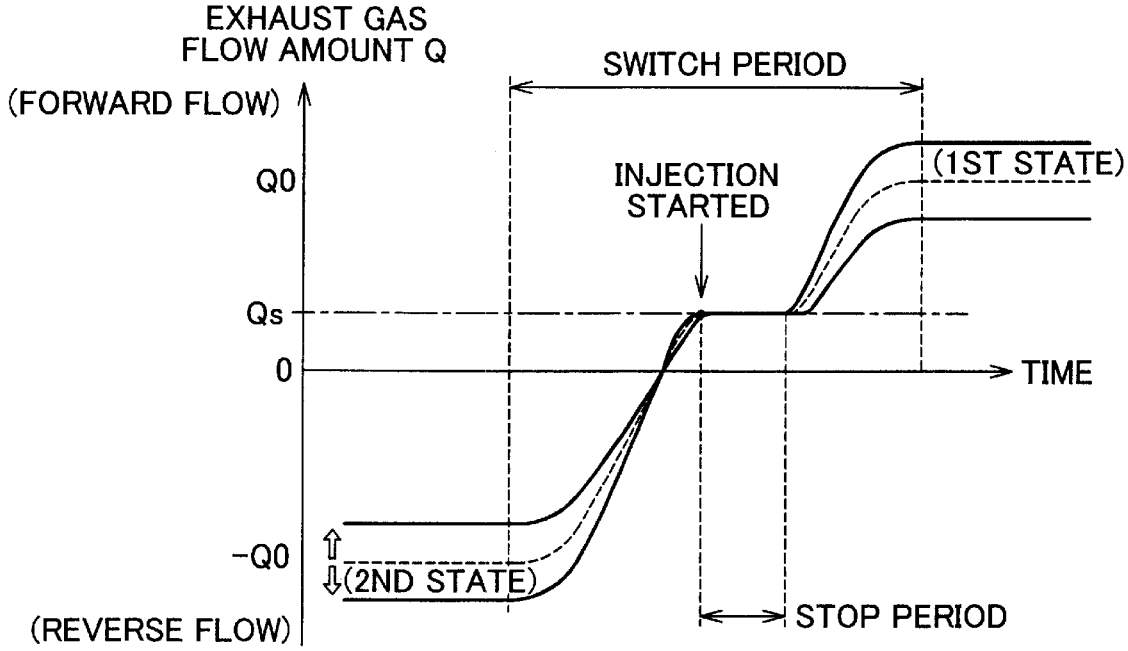

FIGS. 32(A) and 32(B) are diagrams indicating a case where the exhaust gas flow amount Q0 during the start state of the switching valve changes. As indicated in FIGS. 32(A) and 32(B), the use of the differential pressure ΔP makes it possible to inject the reducer while the exhaust gas flow amount Q is substantially kept at Qs, regardless of the exhaust gas flow amount Q0 occurring during the start state of the switching valve.

Although in this embodiment, the differential pressure ΔP is set at a fixed target value regardless of the switching direction of the switching valve, it is also possible to vary the target value of the differential pressure ΔP in accordance with the switching direction of the switching valve. This manner of operation makes it possible to vary the amount Q of exhaust gas that flows through the first emission control portion 210 at the time of injection of the reducer, in accordance with the switching direction of the switching valve.

As described above, this embodiment includes an emission control unit similar to that adopted in the second embodiment. The ECU 90 stops the switching valve and injects the reducer when the difference ΔP between the two pressures becomes equal to a predetermined target pressure. This manner of operation makes it possible to inject the reducer while the amount of flow of exhaust gas through the first emission control portion 210 is substantially kept at a predetermined amount.

E. FIFTH EMBODIMENT

While the third embodiment injects the reducer at an intermediate point during the switching operation of the switching valve on the basis of the back pressure PE, the fifth embodiment temporarily stops the switching operation of the switching valve to inject the reducer on the basis of the back pressure PE.

Figure 33:
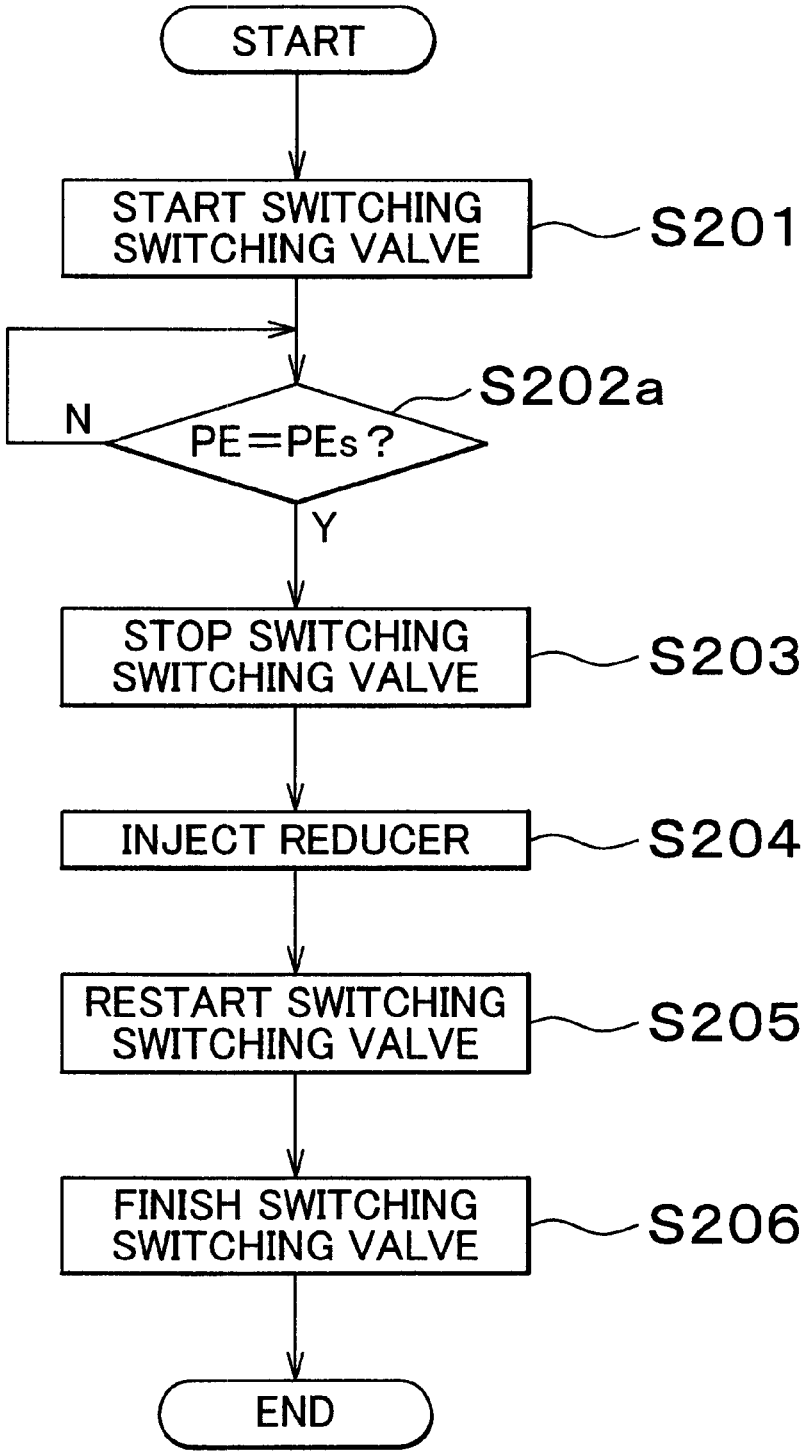
FIG. 33 is a flowchart illustrating a process performed to recover the emission control function of the first emission control portion in a seventh embodiment.

FIG. 33 is a flowchart illustrating a process performed to recover the emission control function of the first emission control portion 210 in the fifth embodiment. The process illustrated in FIG. 33 is executed in the emission control unit 200C shown in FIG. 23. FIG. 33 is substantially the same as FIG. 30, except that step S202*a* is modified.

In step S202*a*, it is determined whether a measurement result provided by the pressure sensor 131, that is, a back pressure Pe, is equal to a pre-set target value PEs. If the back pressure Pe equals PEs, the process proceeds to step S203.

In FIG. 33, the switching valve is stopped halfway during the switching operation in step S203. Therefore, a process of determining a switching direction of the switching valve as in step S102 in FIG. 24 is omitted.

Figure 34:
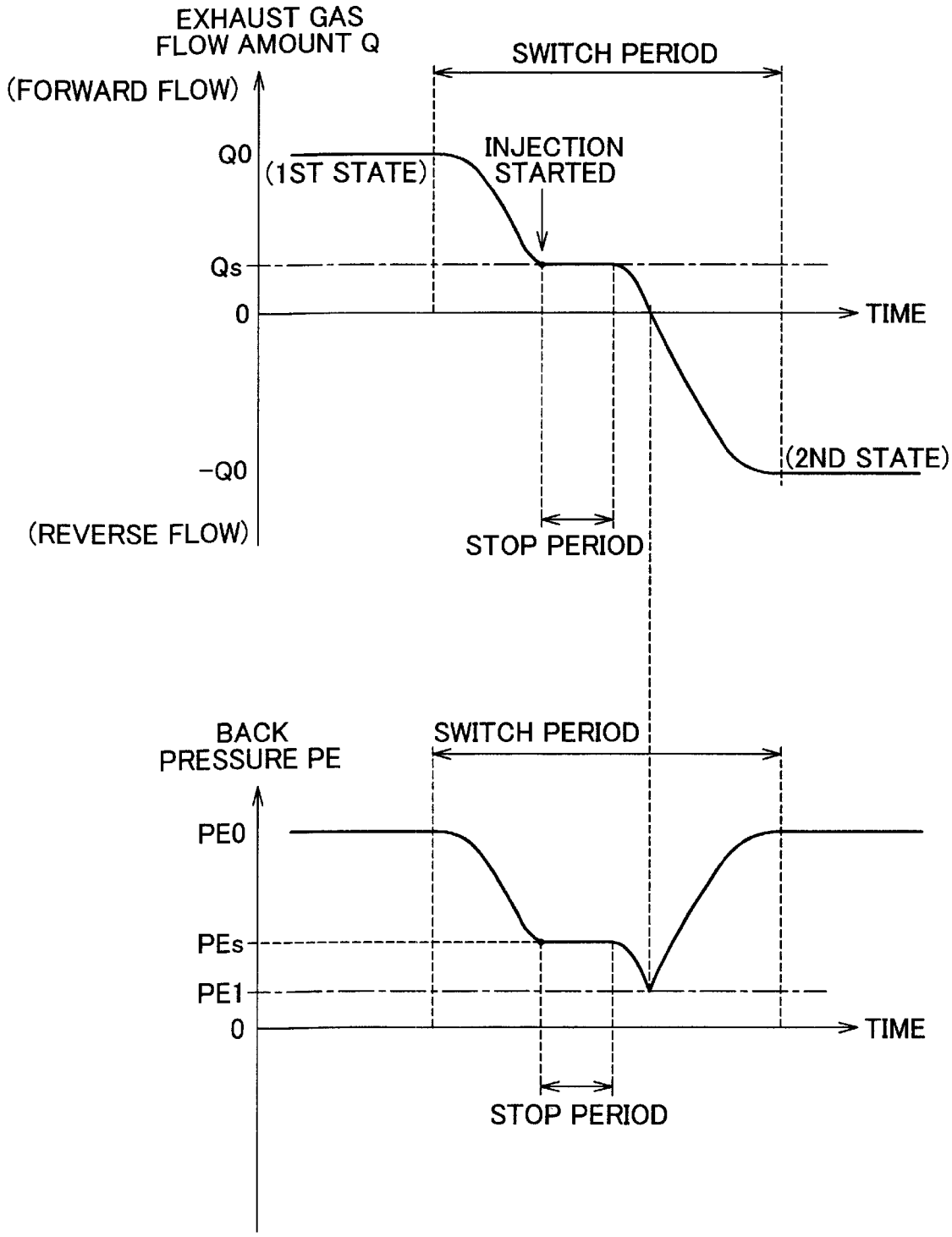
FIG. 34 is diagram indicating changes in the back pressure PE and changes in the exhaust gas flow amount Q in a case where the switching valve is stopped halfway during the switching of the valve.

FIG. 34 is diagram indicating changes in the back pressure PE and changes in the exhaust gas flow amount Q in a case where the switching valve is stopped halfway during the switching of the valve. The upper diagram and the lower diagram in FIG. 34 correspond to the upper diagram and the lower diagram in FIG. 25. The exhaust gas flow amount Q becomes equal to Qs at a time point when it is determined in step S202*a* in FIG. 33 that the back pressure PE becomes equal to the target value PEs. Therefore, if the switching operation of the switching valve is stopped and the injection of the reducer is started when the back pressure PE becomes equal to the target value PEs, it becomes possible to inject the reducer while the exhaust gas flow amount Q is substantially kept at Qs.

As mentioned above, the exhaust gas flow amount Q0 during the start state of the switching valve varies depending on the operation state of the engine 100. The ECU 90 in this embodiment is able to determine a target back pressure for stopping the switching operation of the switching valve and starting the injection of the reducer in accordance with the exhaust gas flow amount Q0, by using any one of the techniques ((C1) to (C5)) exemplified in conjunction with the third embodiment.

Specifically, the ECU 90 determines a target back pressure by using various parameters, for example (C1) the engine operation condition, (C2) the initial back pressure and the amount of intake air, (C3) the initial back pressure and the exhaust gas temperature, (C4) the initial gas pressure, the amount of intake air and the exhaust gas temperature, (C5) only the initial back pressure, etc.

Although in the foregoing description of this embodiment, the target value of the back pressure PE is fixed regardless of the switching direction of the switching valve, it is also possible to vary the target value of the back pressure PE in accordance with the switching direction of the switching valve as in the third embodiment. This manner of operation makes it possible to vary the amount Q of exhaust gas that flows through the first emission control portion 210 at the time of injection of the reducer, in accordance with the switching direction of the switching valve.

As described above, this embodiment incorporates an emission control unit similar to that incorporated in the third embodiment. The ECU 90 stops the switching valve and injects the reducer when the back pressure PE becomes equal to a predetermined target value. This manner of operation makes it possible to inject the reducer while the amount of flow of exhaust gas through the first emission control portion 210 is kept substantially at a predetermined amount.

F. SIXTH EMBODIMENT

Although in the first to fifth embodiment, the reducer injection start time point that starts at the switching start time point of the switching valve is set at time points varying in accordance with the switching direction of the switching valve, it is also possible to set the reducer injection start time point at a fixed time point regardless of the switching direction of the switching valve. In the sixth embodiment, the reducer is injected at the elapse of a predetermined time following the switching valve switching start time point, and the switching operation of the switching valve is changed in accordance with the switching direction of the switching valve.

Figure 35A:
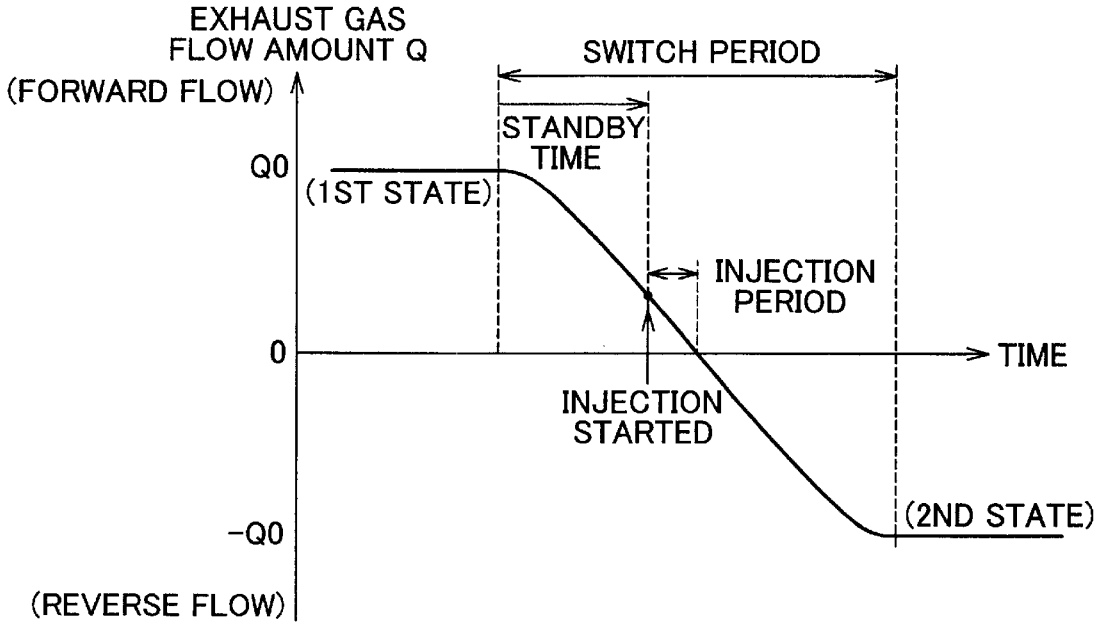
FIGS. 35(A) and 35(B) are diagrams indicating the reducer injection start time point and changes in the exhaust gas flow amount Q in a case where the switching speed of the switching valve is changed in accordance with the switching direction of the switching valve.
Figure 35B:
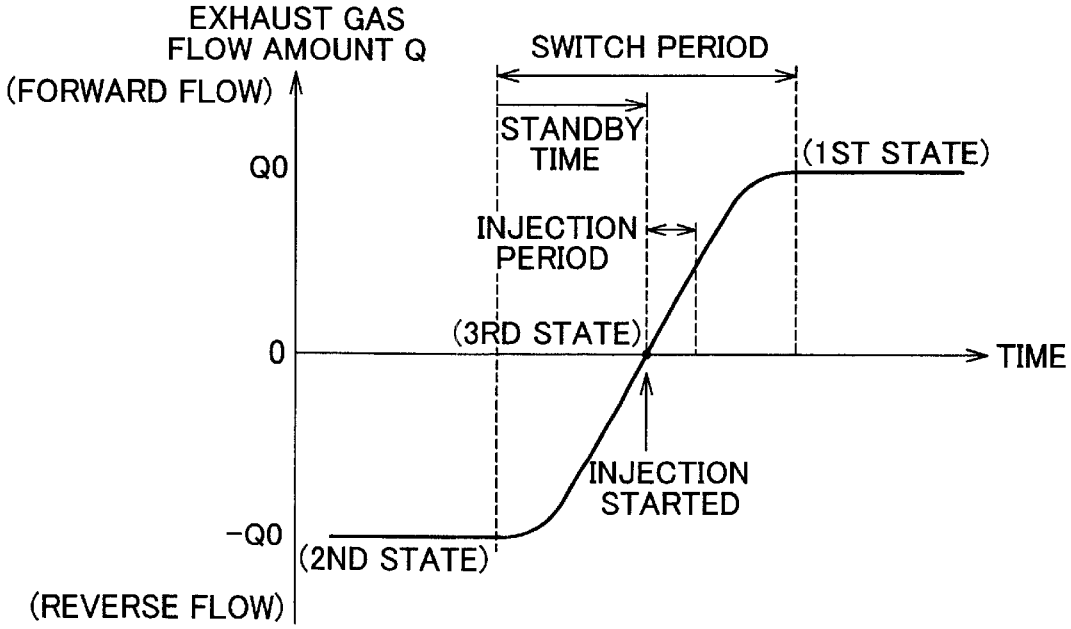

FIGS. 35(A) and 35(B) are diagrams indicating the reducer injection start time point and changes in the exhaust gas flow amount Q in a case where the switching speed of the switching valve is changed in accordance with the switching direction of the switching valve. In FIGS. 35(A) and 35(B), the standby time from the switching valve switching start time point until the reducer injection start time point is set at a fixed time regardless of the switching direction of the switching valve. Specifically, the reducer injection start time point is set at a time point at which the switching valve assumes the third state in the case where the switching valve is switched from the second state to the first state. Furthermore, the switching speed of the switching valve is changed in accordance with the switching direction of the switching valve. Specifically, the switching speed of the switching valve is set lower in the case where the switching valve switches from the first state to the second state (FIG. 35(A)) than in the case where the switching valve switches from the second state to the first state (FIG. 35(B)). Therefore, the switching period is longer in FIG. 35(A) than in FIG. 35(B).

Figure 36A:
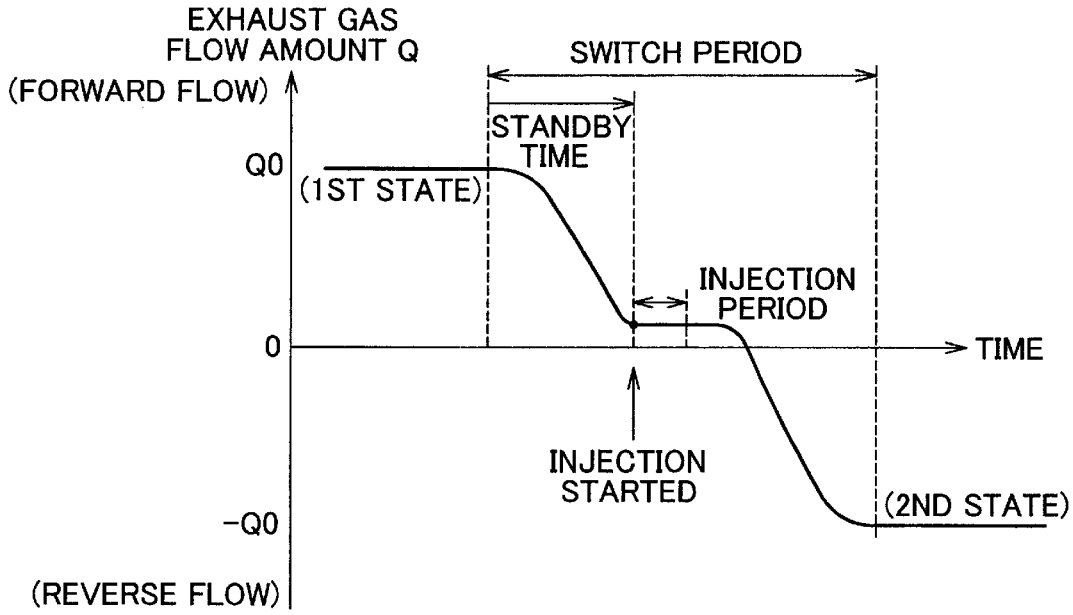
FIGS. 36(A) and 36(B) arm diagrams indicating the reducer injection start time point and changes in the exhaust gas flow amount Q in a case where the stop period of the switching valve is changed in accordance with the switching direction of the switching valve.
Figure 36B:
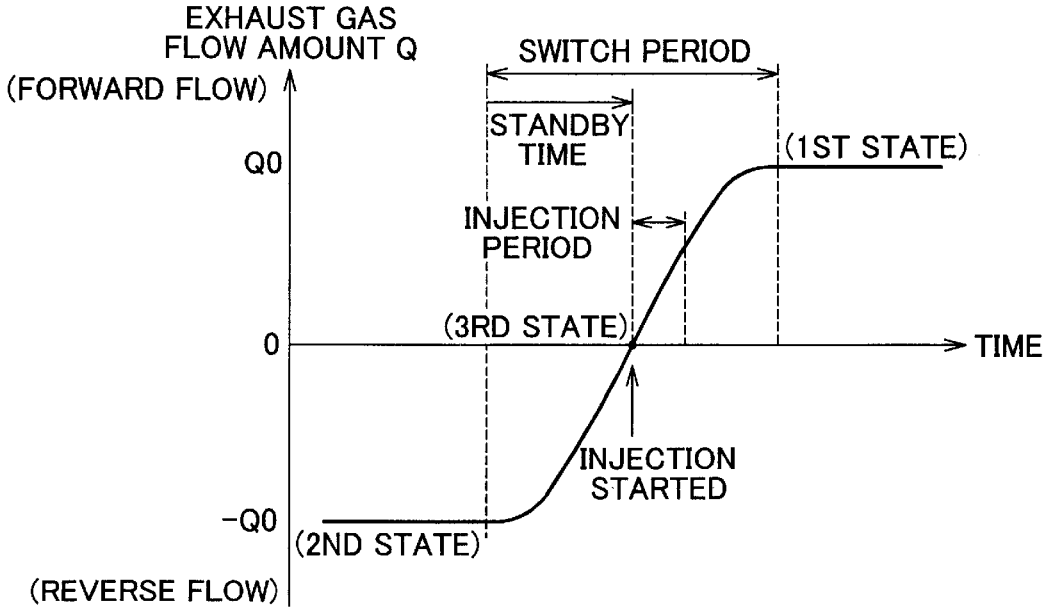

FIGS. 36(A) and 36(B) are diagrams indicating the reducer injection start time point and changes in the exhaust gas flow amount Q in a case where the stop period of the switching valve is changed in accordance with the switching unreaction or the switching valve. In FIGS. 36(A) and 36(B), too, the reducer injection start time point is set at a time point at which the switching valve assumes the third state in the case where the switching valve is switched from the second state to the first state. Furthermore, the stop period of the switching valve is changed in accordance with the switching direction of the switching valve. Specifically, if the switching valve switches from the first state to the second state (FIG. 36(A)), the switching valve is stopped at a time point before the valve assumes the third state. However, if the switching valve switches from the second state to the first state (FIG. 36(B)), the switching valve is not stopped halfway during the switching. That is, the stop period is set longer in FIG 36(A) than in FIG. 36(B). Therefore, the switching period is longer is FIG. 36(A) than in FIG. 36(B). In the case of FIG. 36(A), when the switching valve is stopped, the injection of the reducer is started. During the stop period, the reducer diffuses into the loop passage 30*b*, thereby recovering the emission control function of the first emission control portion 210.

If the reducer should be injected at a time point similar to that in FIGS. 35(A) to 36(A) in the case of a switch of the switching valve as indicated in FIGS. 14(A) and 14(B), the emission control function of the first emission control portion 210 will not be recovered at the time of the switch of the switching valve from the first state to the second state. This is because immediately after the injection of the reducer, exhaust gas will come to flow in the reverse direction and therefore the reducer will not be supplied to the first emission control portion 210. In contrast, if the switching operation of the switching valve is changed in accordance with the switching direction of the switching valve as indicated in FIGS. 35(A) to 36(B), the reducer can be supplied to the first emission control portion 210 so as to recover the emission control function of the first emission control portion 210, regardless of the switching direction of the switching valve.

Although in FIGS. 35(A) to 36(B), the reducer injection start time point is set at a time point at which the switching valve assumes the third state in FIGS. 35(B) and 36(B), the reducer injection start time point may also be set at, for example, a time point after the switching valve assumes the third state.

Furthermore, although in FIGS. 36(A) and 36(B), the switching valve is stopped only in the case where the switching valve is switched from the first state to the second state, it is also possible to stop the switching valve regardless of the switching direction of the switching valve. That is, it is appropriate for the ECU 90 to stop the switching valve halfway during the switching and change the stop period of the switching valve in accordance with the switching valve is switched from the first state to the second state. It should be noted herein that the stop period of the switching valve includes a stop period of "0" corresponding to the case where the switching valve is not stopped during the switching of the valve.

As is apparent from the foregoing description, the reducer is injected at a fixed time point regardless of the switching direction of the switching valve in FIGS. 35(A) to 36(B). In FIG. 35(A) and 35(B), the switching speed of the switching valve is changed in accordance with the switching direction of the switching valve. In FIGS. 36(A) and 36(B), the stop period of the switching valve is changed in accordance with the switching direction of the switching valve.

Normally, it is appropriate for the ECU 90 to change the switching operation of the switching valve in accordance with the switching direction of the switching valve, and to inject the reducer at the elapse of at least a predetermined time following the switching valve switching start time point regardless of the switching direction of the switching valve. This manner of operation also makes it possible to supply the reducer the first emission control portion 210 regardless of the state of the switching valve prior to the switching of the valve. As a result, the emission control function of the first emission control portion 210 can be recovered.

If the exhaust gas flow amount Q0 during the start state of the switching valve changes, it is also possible to change the reducer injection start time point in accordance with the exhaust gas flow amount Q0 as in the first embodiment.

G. SEVENTH EMBODIMENT

Although in the first to sixth embodiments, the ends state of the switching valve is set as a state different from the start state of the valve, regardless of the switching direction of the switching valve, the end state of the switching valve may be the same as the start state thereof if the start state of the switching valve is the first state.

Figure 37A:
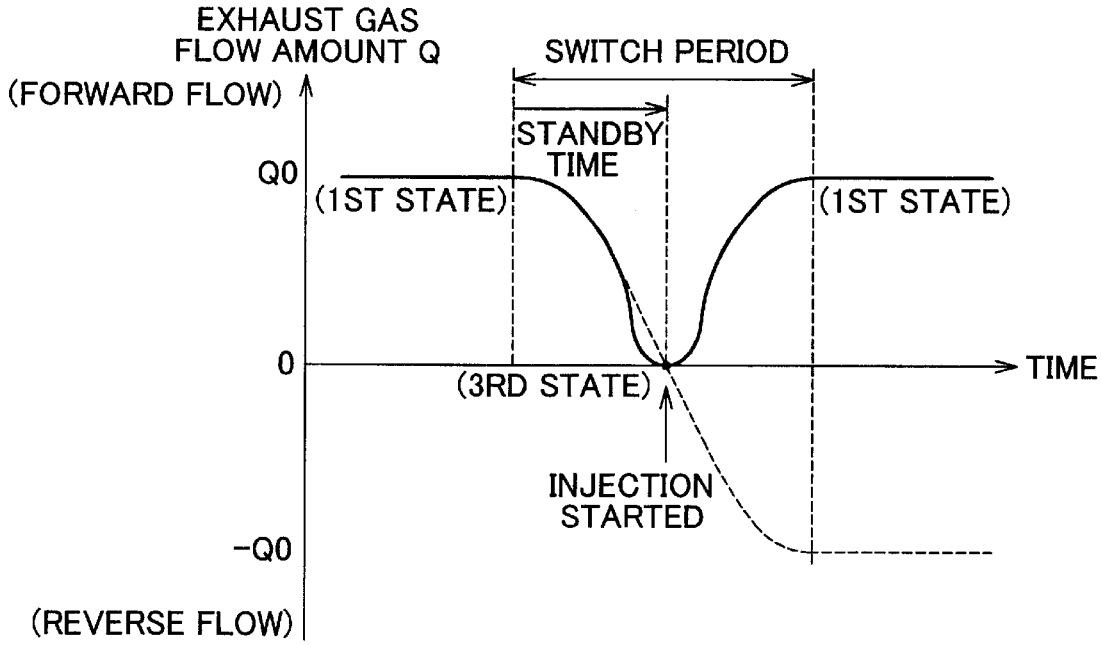
FIGS. 37(A) and 37(B) are diagrams indicating the reducer injection start time point and changes in the exhaust gas flow amount Q in a case where the switching operation of the switching valve is changed in accordance with the start state of the switching valve.
Figure 37B:
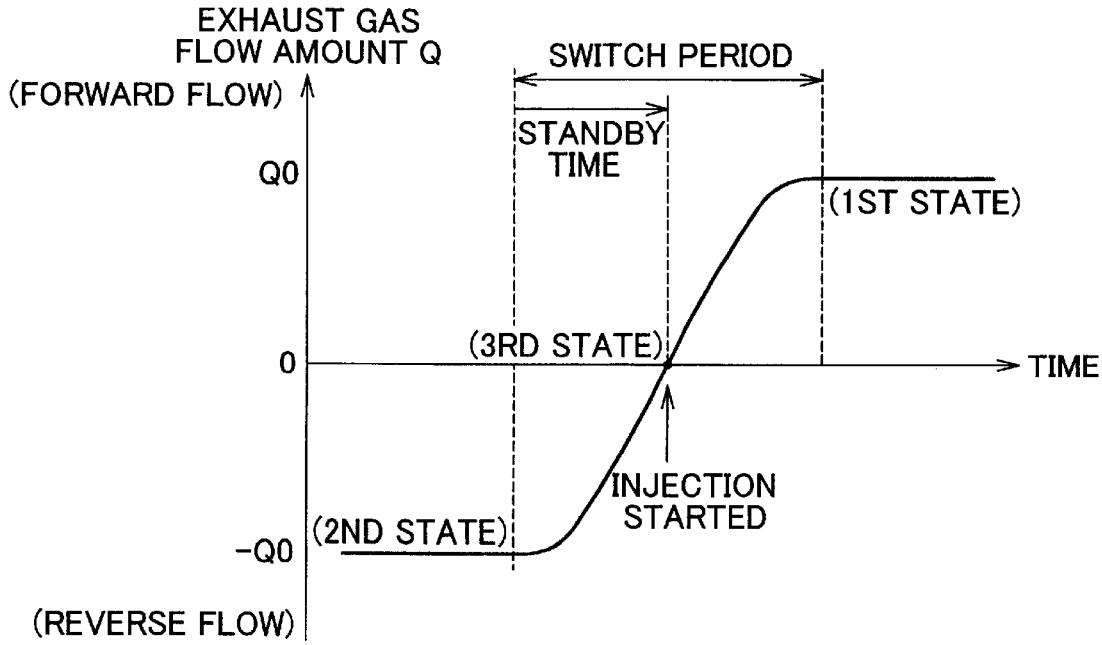

FIGS. 37(A) and 37(B) are diagrams indicating the reducer injection start time point and changes in the exhaust gas flow amount Q in a case where the switching operation of the switching valve is changed in accordance with the start state of the switching valve. FIG. 37(A) indicates a case where the start state of the switching valve is the first state. FIG. 37(B) indicates a case where the start state of the switching valve is the second state.

In FIGS. 37(A) and 37(B), the switching operation of the switching valve is changed in accordance with the start state of the switching valve. Specifically, if the start state of the switching valve is the first state (FIG. 37(A)), the switching valve is changed from the first state to the third state, and then is returned to the first state. Conversely, if the start state of the switching valve is the second state (FIG. 37(B)), the switching valve is switched from the second state to the first state. The standby time from the switching valve switching start time point to the reducer injection start time point is set at a fixed time regardless of the start state of the switching valve. Specifically, the reducer injection start time point is set at a time point at which the switching valve is set in the third state. The switch period in FIG. 37(A) is equal to the switch period in FIG. 37(B).

This manner of operation makes it possible to inject the reducer substantially at the time of a predetermined flowing direction and a predetermined amount of flow of exhaust gas through the first emission control portion 210 regardless of the start state of the switching valve.

Although in FIGS. 37(A) and 37(B), the switching valve is temporarily set in the third state if the start state of the switching valve is the first state, the switching valve may also be returned to the first state at an intermediate point during the change from the first state to the third state. Furthermore, it is also possible to temporarily stop the switching valve as the switching valve is returned. Still further, although in FIGS. 37(A) and 37(B), the reducer injection start time point is set at the time point at which the switching valve assumes the third state, regardless of the start state of the switching valve, it is also possible to set the reducer injection start time point at, for example, a time point after the switching valve assumes the third state. In this case, it is preferable that the reducer injection start time point be changed in accordance with the exhaust gas flow amount Q0 occurring during the start state of the switching valve.

Normally, if the start state of the switching valve is the first state, it is appropriate for the ECU 90 to inject the reducer at an intermediate point during the switch of the switching valve from the first state to the second state, and then return the switching valve to the first state instead of shifting valve to the second state. This manner of operation also makes it possible to recover the emission control function of the first emission control portion 210 regardless of the start state of the switching valve.

H. EIGHTH EMBODIMENT

As mentioned above, the emission control function of the first emission control portion 210 is recovered while the exhaust gas air-fuel ratio is relatively low (at the stoichiometric ratio or on the rich ratio side). Therefore, if the exhaust gas air-fuel ratio shifts to the lean ratio side due to, for example, a change in the operation state of the engine 100, it is necessary to increase the amount of injection of the reducer in order to shift the exhaust gas air-fuel ratio to the stoichiometric ratio or to the rich side.

The injection amount of the reducer can be changed by adjusting the reducer injection pressure, the injection period, etc. The injection pressure is adjusted on the basis of the pressure of the reducer supply pump 268. The injection period is adjusted on the basis of the on-period of the reducer injection nozzle 261 (FIG. 4).

It is preferable that the reducer injection conditions, such as the injection amount, the injection pressure, the injection period, etc., be determined so as to satisfy the following requirements. That is, the injection amount needs to be increased with increases in the exhaust gas air-fuel ratio occurring prior to the reducer injection so that the air-fuel ratio of exhaust gas flowing through the first emission control portion 210 becomes less than or equal to a predetermined value. The injection pressure needs to be raised with increases in the amount of flow of exhaust gas through the first emission control portion so that the amount of deposit of the reducer on passage wall surfaces of the loop passage 30*b* becomes relatively small and the reducer sufficiently mixes with exhaust gas. Furthermore, the injection period needs to be adjusted in accordance with the switching direction of the switching valve, taking the flowing direction of exhaust gas in to account.

Figure 38A:
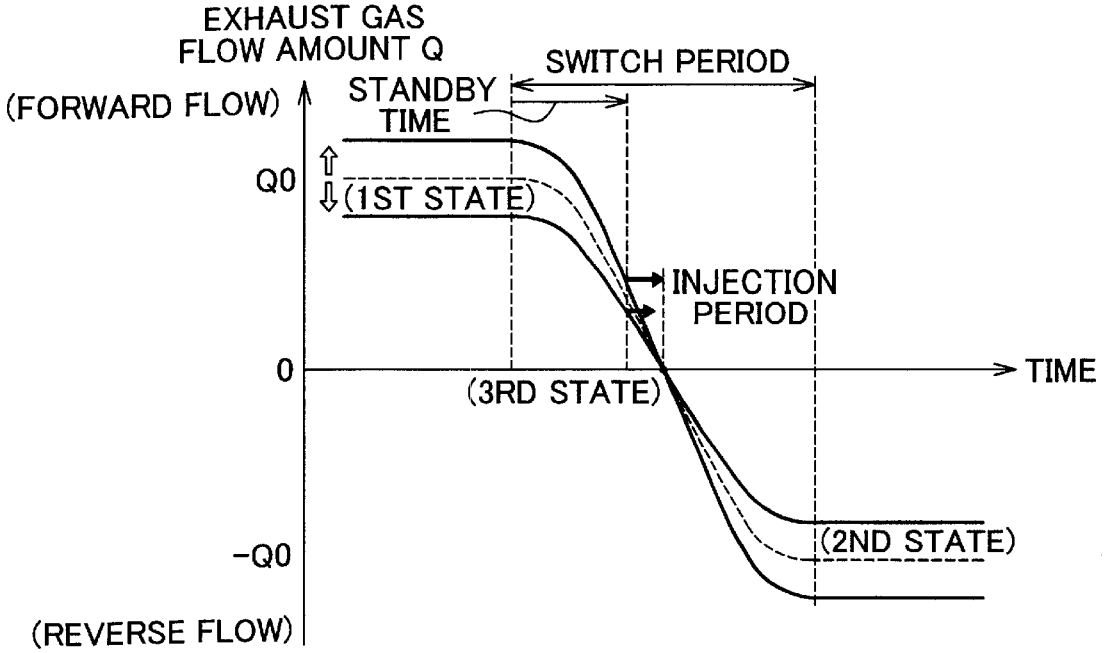
FIGS. 38(A) and 38(B) are diagrams indicating the reducer injecting operation and changes in the exhaust gas flow amount Q in a case where the amount of intake air changes.
Figure 38B:
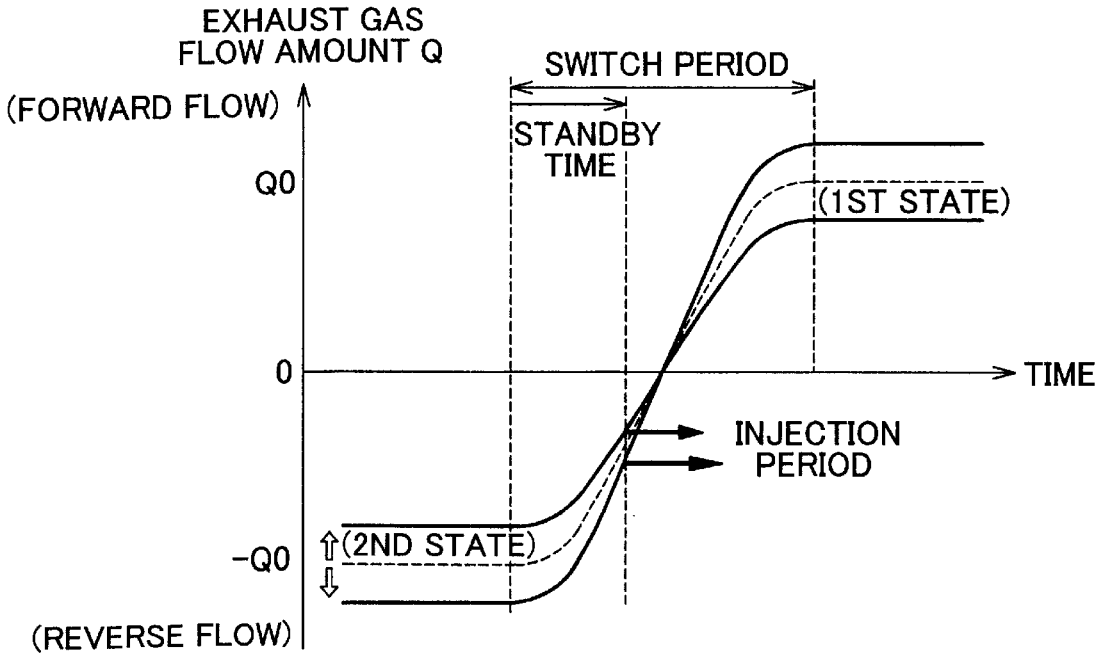

FIGS. 38(A) and 38(B) are diagrams indicating the reducer injecting operation and changes in the exhaust gas flow amount Q in a case where the amount of intake air changes. In FIGS. 38(A) and 38(B), the standby time from the switching valve switching start time point to the reducer injection start time point is set as a fixed time regardless of the switching direction of the switching valve. If the amount of intake air increases, the exhaust gas air-fuel ratio increases, and the exhaust gas flow amount Q at the time of injection of the reducer also increases.

In FIGS. 38(A) and 38(B), the reducer injection period is changed in accordance with the amount of intake air. Specifically, the injection period is set longer as the amount of intake air becomes greater. Furthermore, the reducer injection period is changed in accordance with the switching direction of the switching valve. Specifically, the injection period is set shorter in the case where the switching valve switches from the first state to the second state than in the case where switching valve switches from the second state to the first state. In the case where the switching valve switches from the first state to the second state, it is necessary that the injection of the reducer end before the switching valve assumes the third state. Therefore, in FIGS. 38(A) and 38(B), the injection period is changed in accordance with the switching direction of the switching valve. Correspondingly, the reducer injection pressure is also changed. Specifically, the injection pressure is set higher in the case where the switching valve switches from the first state to the second state than in the case where switching valve switches from the second state to the first state.

Although in FIGS. 38(A) and 38(B), the reducer injection period alone is changed in accordance with the amount of intake air, it is also possible to change only the reducer injection pressure instead. In that case, it is appropriate to set the injection pressure higher with increases in the amount of intake air. This will advantageously allow more homogeneous distribution in exhaust gas, in comparison with the case where only the injection period is changed. It is also possible to adjust both the injection period and the injection pressure.

Thus, the reducer injection condition is changed by adjusting the injection pressure, the injection period, etc. Then, by adjusting the injection pressure, the injection period, etc., the injection amount of the reducer is adjusted. Normally, it is appropriate to change the reducer injection condition by adjusting at least one of the injection pressure and the injection period. This makes it possible to execute the injection of the reducer appropriately in accordance with the state of exhaust gas.

If the reducer injection condition is changed in accordance with the switching direction of the switching valve, the reducer can be reliably supplied to the first emission control portion 210 regardless of the switching direction of the switching valve, so that the emission control function of the first emission control portion 210 can be reliably recovered. Furthermore, if the reducer injection condition is changed in accordance with the amount of intake air as described above, the injection amount of the reducer can be determined in accordance with the exhaust gas air-fuel ratio, so that it becomes possible to reduce the injection amount of the reducer.

The ECU 90 is able to the reducer injection condition in accordance with the exhaust gas air-fuel ratio by using any one of various techniques as follows.

(H1) FIRST TECHNIQUE

In a first technique, the ECU 90 determines the reducer injection condition through the use of the engine operation condition. The ECU 90 stores, in an internal memory (not shown), a map that indicates a relationship between the reducer injection condition and the engine operation condition, such as the engine rotation speed, the amount of accelerator operation, etc. The ECU 90 determines the reducer injection condition by detecting the engine operation condition and referring to the map. Typically, the reducer injection condition is indicated by the value of injection pressure, injection period, etc., in the map.

(H2) SECOND TECHNIQUE

Figure 39:
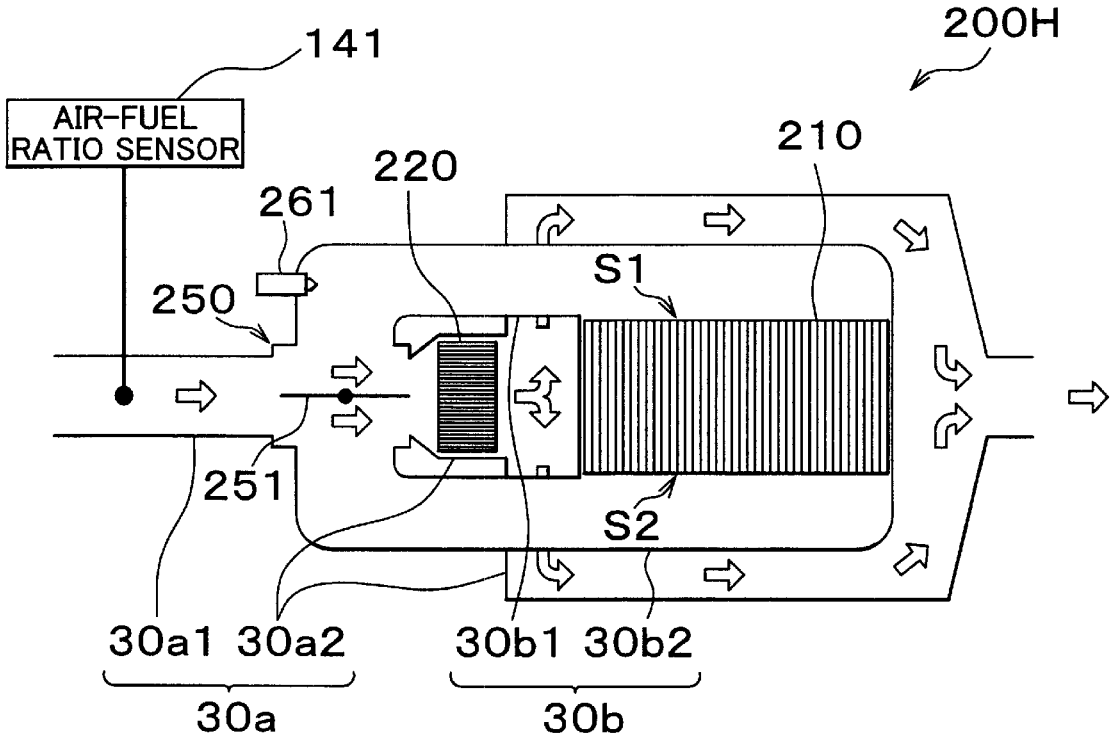
FIG. 39 is an illustration of an emission control unit capable of measuring the exhaust gas air-fuel ratio.

In a second technique, the ECU 90 determines the reducer injection condition through the use of the amount of intake air G and the exhaust gas air-fuel ratio. That is, if the amount of intake air G is known, it is possible to estimate the exhaust gas flow amount Q occurring near the first emission control portion 210 at the time of injection of the reducer. Then, a needed injection amount of the reducer can be determined from the estimated exhaust gas flow amount Q and the exhaust gas air-fuel ratio. FIG. 39 is an illustration of an emission control unit 200H capable of measuring the exhaust gas air-fuel ratio. FIG. 39 is substantially the same as FIGS. 4(A) to 6(A), except that an air-fuel ratio sensor 141 is added. The air-fuel ratio sensor 141 measures the air-fuel ratio of exhaust gas that flows in the upstream-side partial trunk passage 30*a*1. The air-fuel ratio sensor 141 is connected to the ECU 90, and provides the ECU 90 with measurement results. The ECU 90 stores, in an internal memory (not shown), a map that indicates a relationship of the reducer injection condition with the amount of intake air and the exhaust gas air-fuel ratio. The ECU 90 determines the reducer injection condition by detecting the amount of intake air and the exhaust gas air-fuel ratio, and referring to the map.

(H3) THIRD TECHNIQUE

In a third technique, the ECU 90 determines the reducer injection condition through the use of the exhaust gas air-fuel ratio, and information acquired from the flow of exhaust gas through the first emission control portion 210. Whereas the second technique uses the amount of flow of exhaust gas estimated from the amount of intake air, the third technique uses information acquired from the flow of exhaust gas that actually occurs in the first emission control portion 210. Specifically, the information may be the differential pressure ΔP as in the second embodiment, the back pressure PE as in the third embodiment, etc. The ECU 90 stores, in its internal memory (not shown), a map that indicates a relationship of the reducer injection condition with the exhaust gas air-fuel ratio and information acquired from the actual flow of exhaust gas, such as the differential pressure ΔP or the like. The ECU 90 determines the reducer injection condition by detecting the aforementioned information and the exhaust gas air-fuel ratio, and referring to the map.

If the aforementioned information is the differential pressure ΔP, it is appropriate for the emission control unit to have the air-fuel ratio sensor 141 as shown in FIG. 39 and the two pressure sensors 121, 122 as shown in FIG. 19. If the information is the back pressure PE, it is appropriate for the emission control unit to have the he air-fuel ratio sensor 141 as shown in FIG. 39 and the pressure sensor 131 as shown in FIG. 23. Furthermore, the information may also be the exhaust gas flow amount directly acquired from a flow meter.

Although the third technique uses the exhaust gas air-fuel ratio and information acquired from the actual flow of exhaust gas to determine the reducer injection condition, it is also possible to determine a preliminary reducer injection condition through the use of the information, and correct the preliminary reducer injection condition through the use of the exhaust gas air-fuel ratio.

If the reducer injection condition is changed in accordance with the switching direction of the switching valve as indicated in FIGS. 38(A) and 38(B), the maps employed in the techniques (H1) to (H3) contain injection conditions corresponding to the switching direction of the switching valve.

As described above, the ECU 90 is able to relatively precisely determine the reducer injection condition in accordance with the exhaust gas air-fuel ratio by using various techniques. Normally, it is appropriate to change the reducer injection condition so that the air-fuel ratio of exhaust gas flowing through the first emission control portion 210 becomes less than or equal to a predetermined value. This manner of operation makes it possible to more reliably recover the emission control function of the first emission control portion 210 and reduce the injection amount of the reducing agent.

I. NINTH EMBODIMENT

In the first to eighth embodiments, the switching period of the switching valve is kept unchanged regardless of the switching direction, or is changed in the switching direction. If the switching period of the switching valve is longer, the reducer injected is more likely to diffuse into exhaust gas, and therefore the emission control function of the first emission control portion 210 is more efficiently recovered. However, if the engine load is relatively great, the amount of carbon-containing particles and NOx produced becomes relatively great as described above with reference to FIG. 2. If in this case, the switching period of the switching valve is long, an increased amount of exhaust gas is discharged into the atmosphere without flowing through the loop passage 30*b*, that is, without flowing through the first emission control portion 210. Therefore, in this embodiment, the switching period of the switching valve is changed in accordance with the engine operation condition.

Figure 40A:
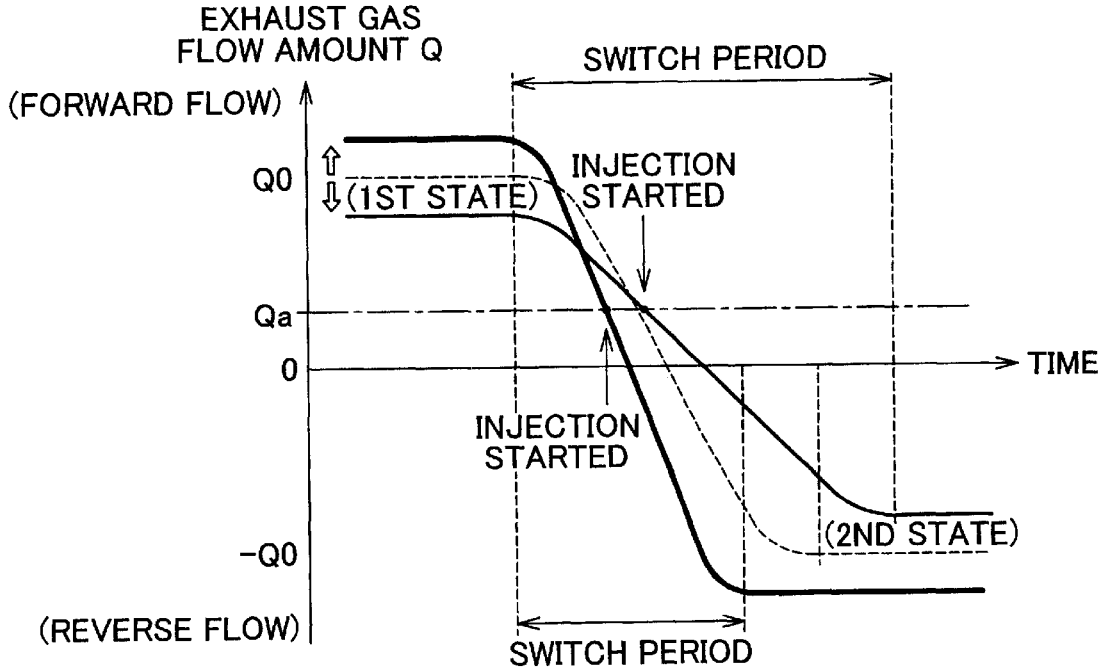
FIGS. 40(A) and 40(B) are diagrams indicating changes in the exhaust gas flow amount Q in a case where the switching period of the switching valve is changed in accordance with the engine operation condition.
Figure 40B:
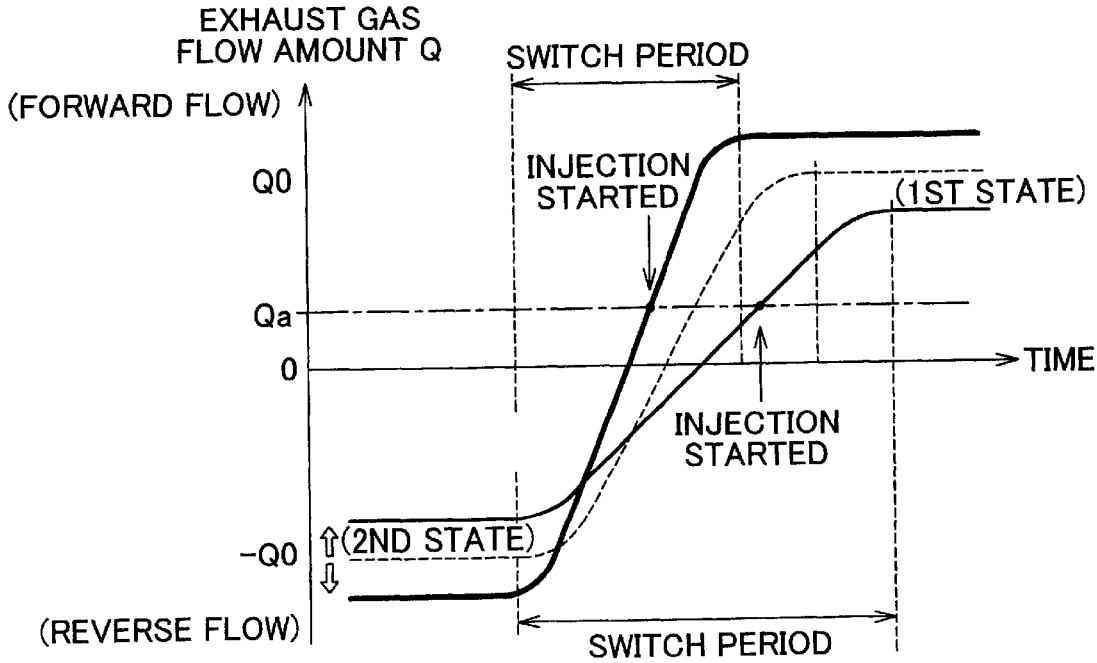

FIGS. 40(A) and 40(B) are diagrams indicating changes in the exhaust gas flow amount Q in a case where the switching period of the switching valve is changed in accordance with the engine operation condition. It should be noted that the exhaust gas flow amount Q0 during the state of the switching valve increases with increases in the engine load. In FIGS. 40(A) and 40(B), the switching speed of the switching valve is changed in accordance with the engine operation condition. Specifically, if the engine load is relatively great, the switching speed of the switching valve is set relatively high. If the engine load is relatively small, the switching speed of the switching valve is set relatively low. Therefore, the switching period of the switching valve is shorter in the case where the engine load is relatively great than in the case where the engine load is relatively low.

In FIGS. 40(A) and 40(B), the emission control unit 200B described above in conjunction with the second embodiment is used, and the injection of the reducer is started when the differential pressure ΔP becomes equal to a predetermined target value.

Figure 41A:
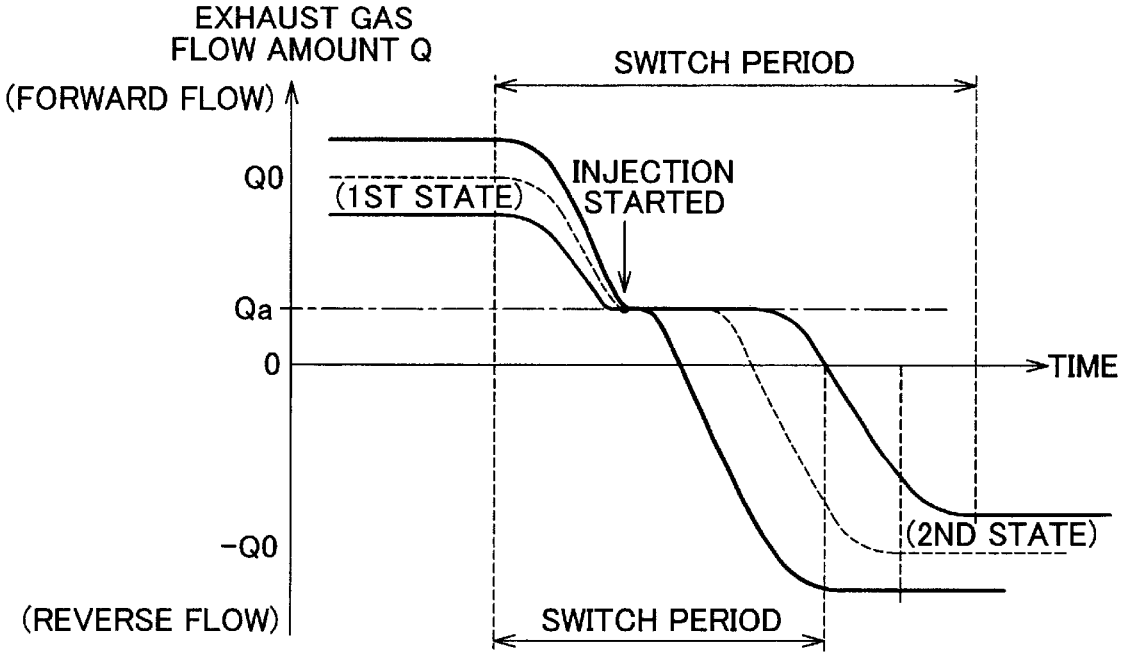
FIGS. 41(A) and 41(B) are diagrams indicating changes in the exhaust gas flow amount Q in a case where the switching period of the switching valve is changed in accordance with the engine operating condition.
Figure 41B:
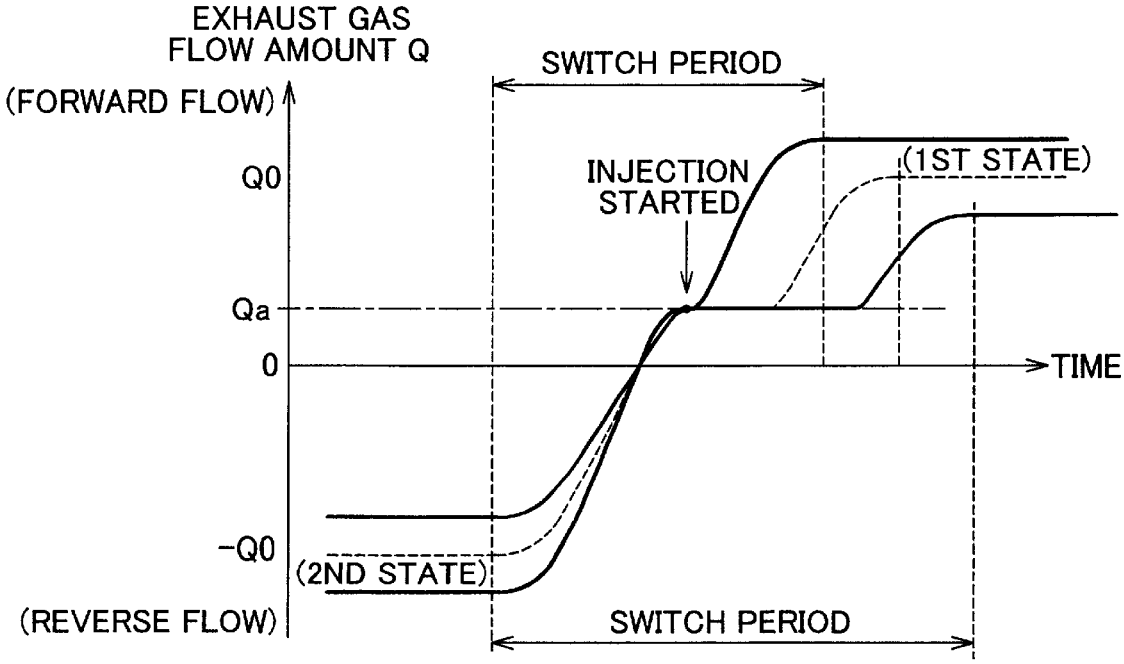

FIGS. 41(A) and 41(B) are also diagrams indicating changes in the exhaust gas flow amount Q in a case where the switching period of the switching valve is changed in accordance with the engine operation condition. In FIGS. 41(A) and 41(B), the stop period of the switching valve is changed in accordance with the engine operation condition. Specifically, if the engine load is relatively high, the stop period of the switching valve is set relatively short. If the engine load is relatively low, the stop period of the switching valve is set relatively long. Therefore, the switching period of the switching valve is shorter in the case where the engine load is relatively high than in the case where the engine load is relatively low. It is also possible to avoid the stopping of the switching valve if the engine load is high.

In FIGS. 41(A) and 41(B), the emission control unit 200B as described above in conjunction with the second embodiment is used, and the switching operation of the switching valve is stopped and the injection of the reducer is started when the differential pressure ΔP becomes equal to a predetermined target value.

As is apparent from the foregoing description, the ECU 90 in this embodiment changes the switching period of the switching valve in accordance with the load on the engine 100. This makes it possible to purify the amount of exhaust gas discharged into the atmosphere without passing through the first emission control portion 210. Therefore, it becomes possible to purify the emission of air pollutants contained in exhaust gas, such as carbon-containing particles and NOx, into the atmosphere. Normally, it is appropriate to change the switching period of the switching valve in accordance with the load of the engine 100.

J. TENTH EMBODIMENT

Since the reducer is supplied only to the second emission control portion 220, the NOx control function of the second emission control portion 220 can be sufficiently recovered through the use of a purified amount of the reducer, in comparison with the case where the emission control functions of the first and second emission control portions 210, 220 need to be sufficiently recovered as indicated in FIGS. 12 and 13 of the first embodiment.

Thus, it is possible to recover the emission control functions of the two emission control portions 210, 220 or the emission control function of the second emission control portion 220 alone by injecting the reducer in accordance with the state of the switching valve 251 as indicated in FIGS. 12 and 13. That is, if there is a need to recover at least the emission control function of the first emission control portion 210, it is appropriate to set the switching valve 251 in the first state and inject the reducer. If there is a need to recover the emission control function of the second emission control portion 220 alone, it is appropriate to set the switching valve 251 in the second state and inject the reducer. In this manner, the emission control function of each of the emission control portions 210, 220 can be efficiently recovered.

As described above, the switching action of the switching valve 251 and the reducer injecting action of the reducer injection nozzle 261 are controlled by the ECU 90 (FIG. 3(A)). Specifically, the ECU 90 estimates the amount of carbon-containing particles, NOx and the like discharged, from the history of the operation condition of the engine 100. Then, the ECU 90 determines whether there is a need for the switching action of the switching valve 251, and whether there is a need for the reducer injecting action of the reducer injection nozzle 261. If there are such needs, the ECU 90 causes the switching action of the switching valve 251 and the reducer injecting action of the reducer injection nozzle 261. In this fashion, the ECU 90 is able to accomplish the injection of the reducer in accordance with the state of the switching valve 251. If it becomes necessary to recover the emission control function of the second emission control portion 220 alone while the switching valve 251 is set in the first state, the ECU 90 switches the switching valve 251 to the second state, and then injects the reducer. Normally, the frequency of the injection of the reducer for recovering the second emission control portion 220 along is lower than the frequency of the injection of the reducer for recovering the two emission control portions 210, 220.

Thus, the emission control unit 200 of this embodiment is able to reverse the flow of exhaust gas through the first emission control portion 210 provided in the loop passage 30*b* by changing the path of exhaust gas through the use of the switching valve 251, and is therefore able to reduce deposit of carbon-containing particles in the first emission control portion 210. Furthermore, since the trunk passage 30*a* is provided with the second emission control portion 220, exhaust gas can be further cleaned. Still further, the emission control unit 200 is provided with the reducer supplying portion 260 for supplying into the loop passage 30*b* the reducing agent for recovering the emission control functions of the first and second emission control portions 210, 220. Therefore, it is possible to recover the emission control functions of the emission control unit 200 independently of the operation condition of the internal combustion engine.

As is apparent from the foregoing description, the reducer supplying portion 260 in this embodiment corresponds to the recovery agent supplying portion in the invention. Furthermore, the ECU 90 corresponds to the control portion in the invention.

K. ELEVENTH EMBODIMENT

Figure 42:
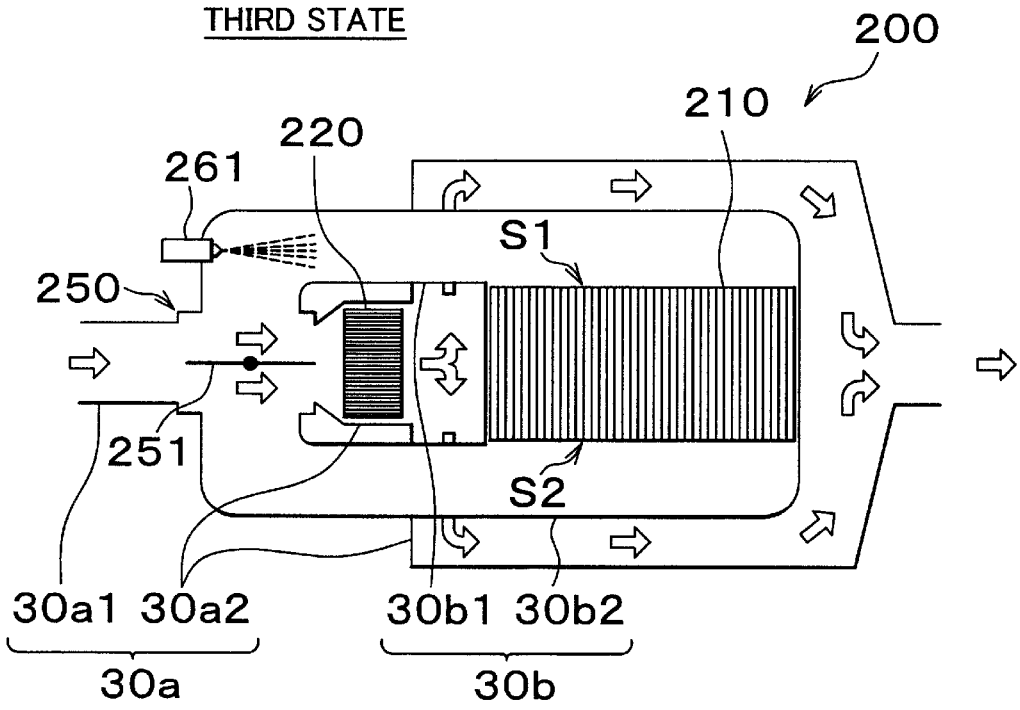
FIG. 42 is a diagram illustrating the injection of a reducer by a reducer injection nozzle in accordance with an eleventh embodiment.

FIG. 42 is a diagram illustrating the injection of a reducer by a reducer injection nozzle 261 in accordance with an eleventh embodiment. In the case shown in FIG. 42, the reducer injection nozzle 261 injects the reducer into the first partial loop passage 30*b*1 when the switching valve 251 assumes the third state, unlike the cases illustrated in FIGS. 12 and 13.

Figure 43A:
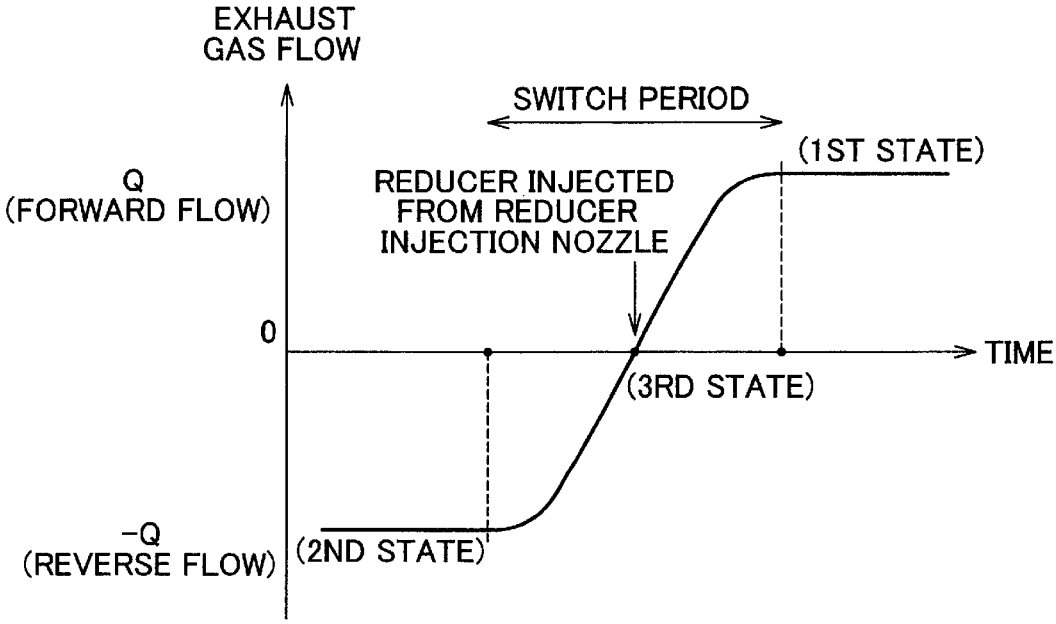
FIGS. 43(A) and 43(B) are diagrams indicating changes in the amount of flow of exhaust gas near the first emission control portion and the reducer injecting timing of the reducer injection nozzle.
Figure 43B:
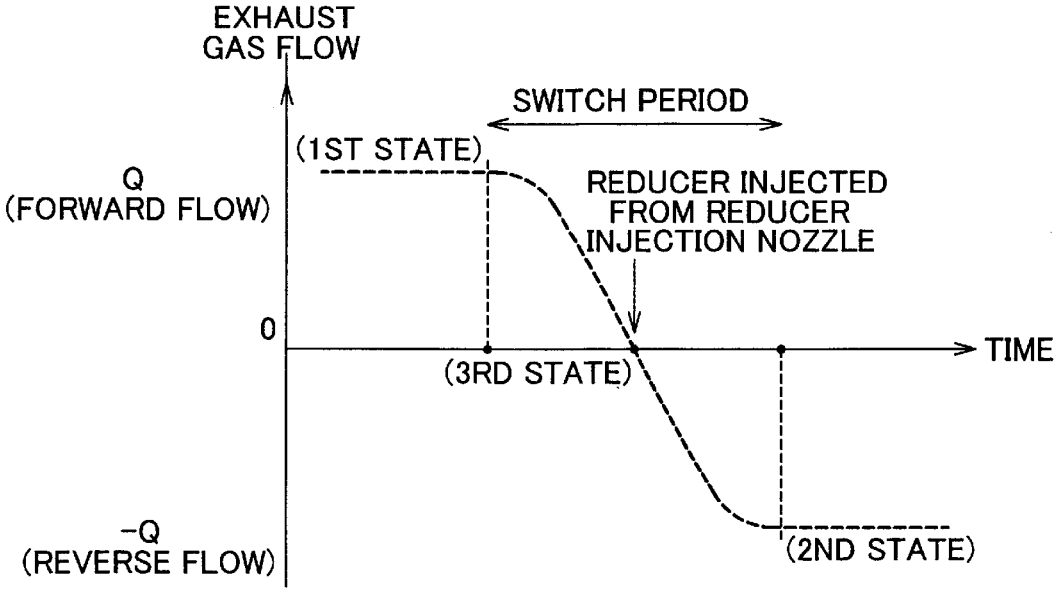

FIGS. 43(A) and 43(B) are diagrams indicating changes in the amount of flow of exhaust gas near the first emission control portion 210 and the reducer injecting timing of the reducer injection nozzle 261. The amount of flow herein refers to the volume of a fluid (exhaust gas) that flows per unit time. Hereinafter, the flow of exhaust gas during the first state of the switching valve 251 (the flow of exhaust gas from the first face S1 toward the second face S2 of the first emission control portion 210) will be referred to as "forward flow". The flow of exhaust gas during the second state of the switching valve 251 (the flow of exhaust gas from the second face S2 toward the first face S1 of the first emission control portion 210) will be referred to as "reverse flow".

FIG. 43(A) indicates changes in the amount of flow of exhaust gas and the reducer injecting timing in a case where the switching valve 251 is switched from the second state to the first state. In this case, the emission control functions of the two emission control portions 210, 220 are recovered.

As indicated in FIG. 43(A), while the switching valve 251 is set in the second state, a certain amount Q of flow of exhaust gas flows in the reverse direction. During a switching period of the switching valve 251, the amount of flow of exhaust gas in the reverse direction gradually decreases, and then the amount of flow of exhaust gas in the forward direction gradually increases. When the switching valve 251 assumes the third state at an intermediate point during the switching period, the amount of flow of exhaust gas becomes substantially "0". Then, as the switching valve 251 is set in the first state, a certain amount Q of flow of exhaust gas flows in the forward direction.

When the switching valve 251 switches from the second state to the first state, more specifically, at a time point when the switching valve 251 assumes the third state, the reducer is injected into the first partial loop passage 30*b*1. At this moment, the amount of flow of exhaust gas in the first partial loop passage 30*b*1 is approximately zero. Therefore, the reducer sufficiently diffuses into exhaust gas in the first partial loop passage 30*b*1. Then, as the switching valve 251 switches to the first state, the reducer relatively slowly flows through the first emission control portion 210. A predetermined amount Q of exhaust gas constantly flows through the downstream-side partial trunk passage 30*a*2 independently of the state of the switching valve 251. Exhaust gas that slowly flows through the first emission control portion 210 gradually comes to flow through the second emission control portion 220 as the switching valve 251 switches to the first state.

Thus, if the reducer is injected while the amount of flow of exhaust gas in the first partial loop passage 30*b*1 is relatively small, exhaust gas having a rich exhaust gas air-fuel ratio slowly flows through the first and second emission control portions, consuming relatively long time. Therefore, it is possible to reduce the amount of the reducer that needs to be injected in order to sufficiently recover at least the emission control function of the first emission control portion 210.

FIG. 43(B) indicates changes in the amount of flow of exhaust gas and the reducer injecting timing in a case where the switching valve 251 is switched from the first state to the second state. In this case, only the emission control function of the emission control portion 220 is recovered.

FIG. 43(B) is substantially the same as FIG. 43(A), except that the changing pattern of the amount of flow of exhaust gas is reverse. That is, during the switching period of the switching valve 251, the amount of flow of exhaust gas in the forward direction gradually decreases, and then the amount of flow of exhaust gas in the reverse direction gradually increases. When the switching valve 251 assumes the third state during the switching period, the amount of flow of exhaust gas becomes substantially "0".

When the switching valve 251 switches from the first state to the second state, more specifically, at a time point when the switching valve 251 assumes the third state, the reducer is injected into the first partial loop passage 30*b*1. At this moment, the amount of flow of exhaust gas in the first partial loop passage 30*b*1 is approximately zero. Therefore, the reducer sufficiently diffuses into exhaust gas, and then gradually flows through the second emission control portion 220 as the switching valve 251 switches to the second state.

Thus, if the reducer is injected while the amount of flow of exhaust gas in the first partial loop passage 30*b*1 is relatively small, exhaust gas having a rich exhaust gas air-fuel ratio slowly flows through the second emission control portion, consuming relatively long time. Therefore, there is a possibility that the amount of the reducer that needs to be injected in order to sufficiently recover the emission control function of the second emission control portion 220 can be reduced.

However, if only the emission control function of the second emission control portion 220 is to be recovered, it is considered preferable to inject the reducer into the first partial loop passage 30*b*1 when the switching valve 251 is set in the second state as in the first embodiment (FIG. 13). That is, if the reducer is gradually supplied to the second emission control portion 220 as the switching valve 251 switches to the second state in this embodiment (FIG. 43(B)), there is a danger of uneven distribution of the reducer in exhaust gas flowing in the second emission control portion 220. In that case, the second emission control portion 220 is recovered with an uneven distribution. If as in the tenth embodiment, the reducer is injected when the entire exhaust gas flows in the first partial loop passage 30*b*1, a relatively even distribution of the reducer in exhaust gas that flows in the second emission control portion 220 can be achieved. Therefore, the second emission control portion 220 can be recovered with a relatively even distribution. Furthermore, a construction as in the tenth embodiment advantageously makes it relatively easy to control the reducer injecting operation.

In this embodiment, the reducer is injected when the switching valve 251 is set in the third state during the switching of the valve as indicated in FIGS. 43(A) and 43(B). However, if at least the emission control function of the first emission control portion 210 is to be recovered, the reducer may be injected when the switching valve 251 is set in an intermediate state from the third state to the first state in FIG. 43(A). If the emission control function of the second emission control portion 220 is to be recovered, the reducer may be injected when the switching valve 251 is set in an intermediate state from the third state to the second state in FIG. 43(B).

In general, if at least the emission control function of the first emission control portion 210 is to be recovered, it is appropriate to inject the reducer when the switching valve is set so that there is exhaust gas that flows through the first partial loop passage 30*b*1 and the second partial loop passage 30*b*2 in that order (i.e., flows in the forward direction). The state where there exists exhaust gas as described above is realized when the switching valve is set in the first state. The state is also realized when the switching valve is set in an intermediate state from the third state to the first state during the switching of the switching valve from the second state to the first state.

If the emission control function of the second emission control portion 220 is to be recovered, it is appropriate to inject the reducer when the switching valve is set so that there exists exhaust gas that flows through the second partial loop passage 30*b*2 and the first partial loop passage 30*b*1 in that order (i.e., flows in the reverse direction). The state where there exists exhaust gas as described above is realized when the switching valve is set in the second state. The state is also realized when the switching valve is set in an intermediate state from the third state to the second state during the switching of the switching valve from the first state to the second state.

As mentioned above, a certain amount Q of exhaust gas flows in the downstream-side partial trunk passage 30*a*2 independently of the state of the switching valve 251. Therefore, normally, the amount of the reducer that needs to be injected in order to sufficiently recover the emission control function of the second emission control portion 220 is greater than the amount of the reducer that needs to be injected in order to sufficiently recover the emission control function of the first emission control portion 210. Therefore, the ECU 90 (FIG. 1) changes the amount of the reducer injected, through the control of the reducer supplying portion 260. More specifically, in the case where the switching valve is set so that there exists exhaust gas that flows in the reverse flow reduction, a greater amount of the reducer is injected into the first partial loop passage 30*b*1 than in the case where the switching valve is set so that there exists exhaust gas that flows in the forward direction. This makes it possible to efficiently recover the emission control functions of the two emission control portions 210, 220 through the use of a relatively small amount of the reducer.

Normally, it is appropriate to set the supplied amount of the reducer at different amounts for the case where the switching valve is set so that there exists exhaust gas that flows through the first partial loop passage 30*b*1 and the second partial loop passage 30*b*2 in that order and the case where the switching valve is set so that there exists exhaust gas that flows through the second partial loop passage 30*b*2 and the first partial loop passage 30*b*1 in that order.

L. TWELFTH EMBODIMENT

Figure 44:
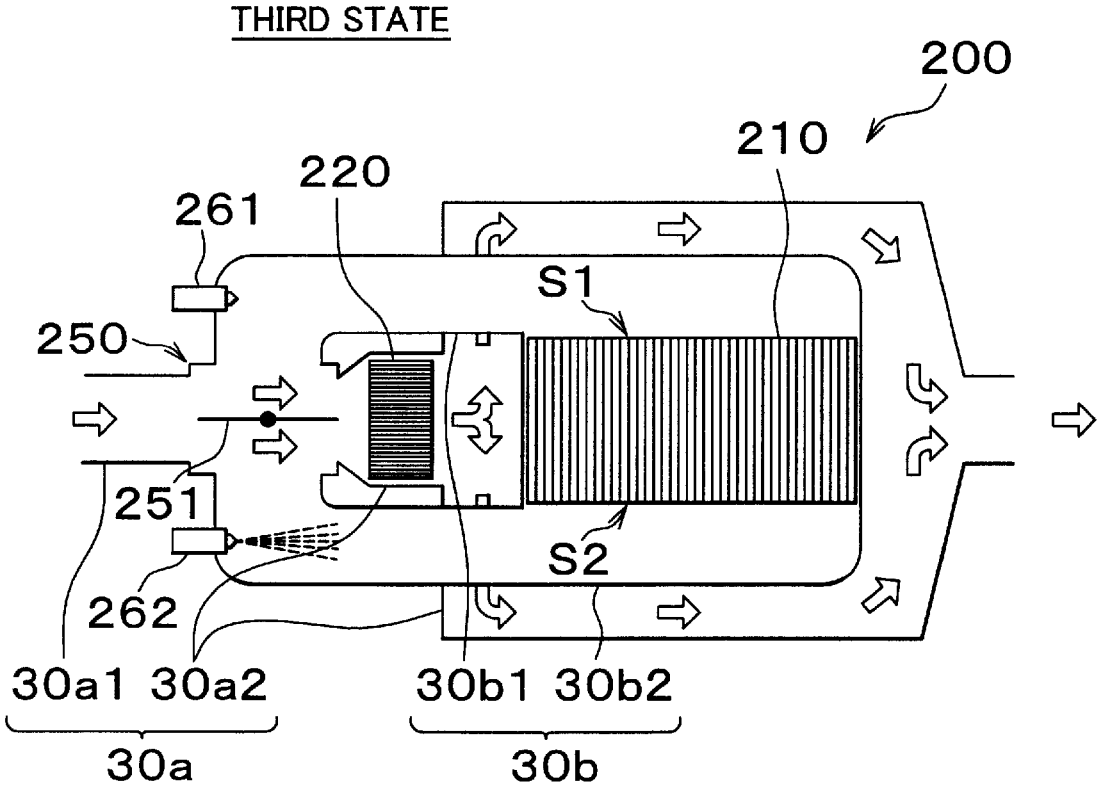
FIG. 44 is a diagram illustrating an emission control unit in accordance with a twelfth embodiment.

FIG. 44 is a diagram illustrating the emission control unit 200 in accordance with a twelfth embodiment. FIG. 44 is substantially the same as FIG. 42, except that a second reducer injection nozzle 262 is added. Similarly to the first reducer injection nozzle 261, the second reducer injection nozzle 262 injects the reducer supplied from the reducer supply pump 268 (FIG. 3(A)) into the second partial loop passage 30*b*2.

In the twelfth embodiment, one of the two reducer injection valves 261, 262 injects the reducer into the loop passage 30*b* when the switching valve 251 assumes the third state as in the eleventh embodiment (FIG. 42). Specifically, the reducer injection nozzle 261 injects the reducer into the first partial loop passage 30*b*1 at timing as indicated in FIGS. 43(A) and 43(B). The second reducer injection nozzle 262 injects the reducer into the second partial loop passage 30*b*2 at timing described below.

Figure 45A:
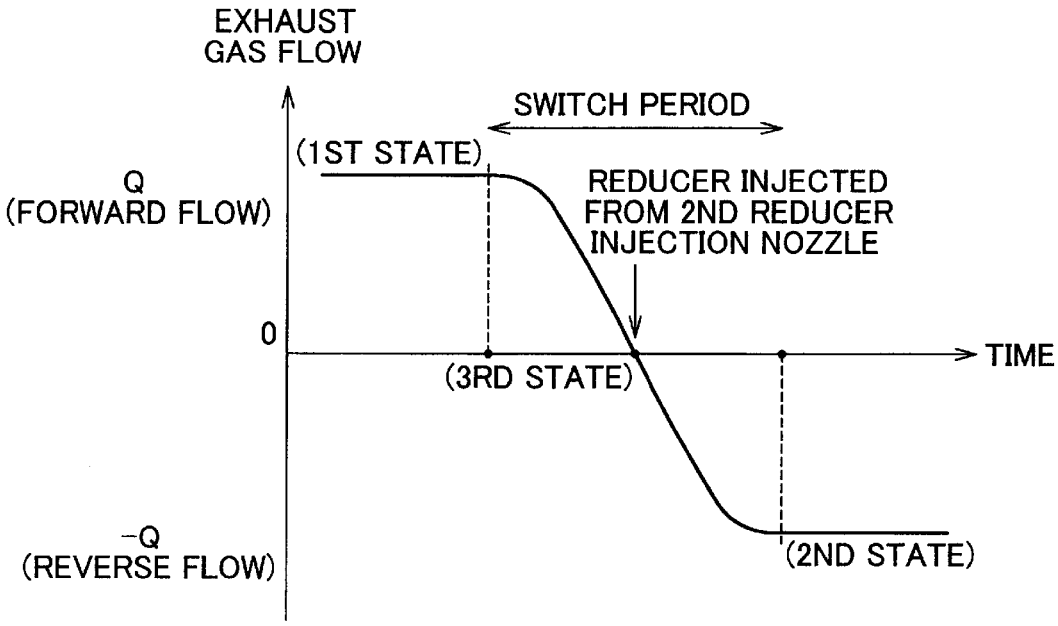
FIGS. 45(A) and 45(B) are diagrams indicating changes in the amount of flow of exhaust gas near the first emission control portion and the reducer injecting timing of the second reducer injection nozzle.
Figure 45B:
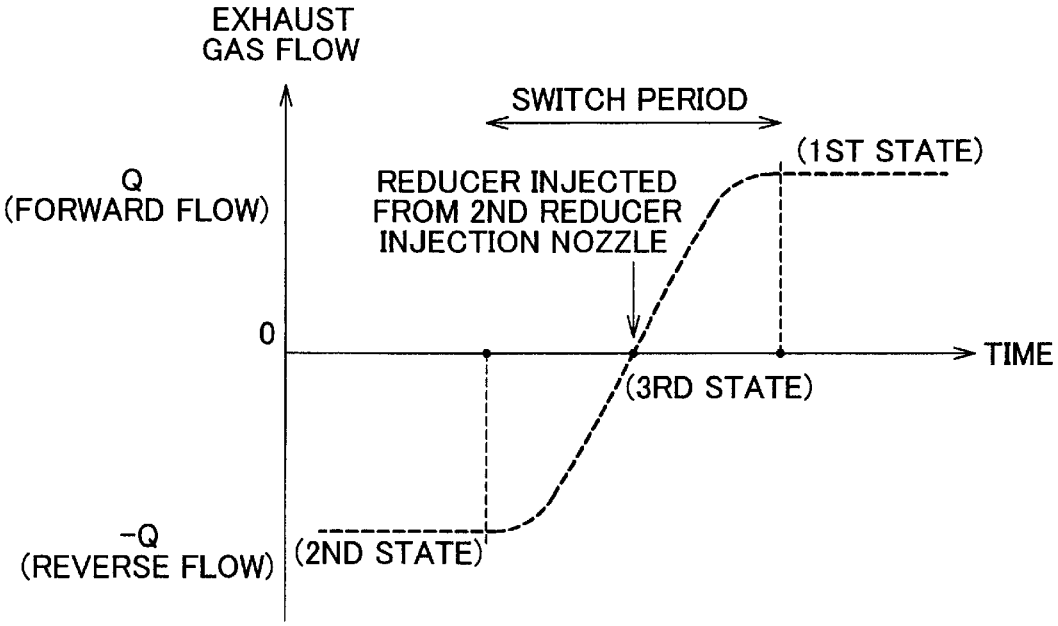

FIGS. 45(A) and 45(B) are diagrams indicating changes in the amount of flow of exhaust gas near the first emission portion 210 and the reducer injecting timing of the second reducer injection nozzle 262.

FIG. 45(A) indicates changes in the amount of flow of exhaust gas and the reducer injecting timing of the second reducer injection nozzle 262 in a case where the switching valve 251 is switched from the first state to the second state. In this case, the emission control functions of the two emission control portions 210, 220 are recovered. FIG. 45(B) indicates changes in the amount of flow of exhaust gas and the reducer injecting timing of the second reducer injection nozzle 262 in a case where the switching valve 251 is switched from the second state to the first state. In this case, only the emission control function of the emission control portion 220 is recovered.

As indicated in FIG. 43(A), it is possible to recover the emission control functions of the first and second emission control portions 210, 220 by the first reducer injection nozzle 261 injecting the reducer into the first partial loop passage 30*b*1 when the switching valve 251 switches from the second state to the first state. Furthermore, as indicated in FIG. 45(A), it is possible to recover the emission control functions of the first and second emission control portions 210, 220 by the second reducer injection nozzle 262 injecting the reducer into the second partial loop passage 30*b*2 when the switching valve 251 switches from the first state to the second state.

As indicated in FIG. 43(B), it is possible to recover only the emission control function of the second emission control portion 220 by the first reducer injection nozzle 261 injecting the reducer into the first partial loop passage 30*b*1 when the switching valve 251 switches from the first state to the second state. Furthermore, as indicated in FIG. 45(B), it is possible to recover only the emission control function of the second emission control portion 220 by the second reducer injection nozzle 262 injecting the reducer into the second partial loop passage 30*b*2 when the switching valve 251 switches from the second state to the first state.

That is, if the two partial loop passages 30*b*1, 30*b*2 are provided with the reducer injection nozzles 261, 262 for injecting the reducer into the two partial loop passages, respectively, it becomes possible to recover the emission control functions of the first and second emission control portions or the emission control functions of the second emission control portion alone, independently of the switching direction of the switching valve 251.

Although this embodiment has been described in conjunction with the case where the reducer is injected when the switching valve is switched, it is also possible to inject the reducer when the switching valve is set in the first or second state as in the tenth embodiment. In this case, too, the emission control functions of the first and second emission control portions or the emission control function of the second emission control portion alone can be recovered independently of the state of the switching valve. That is, the emission control functions of the first and second emission control portions can be recovered by the second reducer injection nozzle 262 injecting the reducer into the second partial loop passage 30*b*2 when the switching valve is set in the second state. The emission control function of the second emission control portion alone can be recovered by the second reducer injection nozzle 262 injecting the reducer into the second partial loop passage 30*b*2 when the switching valve is set in the first state.

M. MODIFICATIONS

The invention is not limited to the foregoing embodiments or constructions. On the contrary, the invention may also be carried out in various other manners without departing from the spirit of the invention. For example, modifications as described below are possible.

M-1. MODIFICATION 1

Although in the foregoing embodiments, the first emission control portion 210 for occluding carbon-containing particles in exhaust gas is provided in the emission control unit 200, a filter for occluding carbon-containing particles may be provided in the exhaust passage 30 upstream of the emission control unit 200, in addition to the first emission control portion 210. This filter may be provided, for example, in each one of manifold branch pipes of the exhaust passage 30 connected to the four combustion chambers #1 to #4.

Although in the foregoing embodiments, the exhaust gas air-fuel ratio is shifted to the rich side by injecting the reducer in order to recover at least the emission control function of the first emission control portion 210, it is also possible to inject an additional amount of fuel into a combustion chamber during a latter half period of the expansion stroke or during the exhaust stroke of the engine, in addition to the injection of the reducer.

This modification advantageously reduces the frequency of the switching of the switching valve 215, the frequency of injection of the reducer, the injection amount of the reducer, etc.

M-2. MODIFICATION 2

The foregoing embodiments are described on the assumption that the switching valve 251 is set in the first or second state, and is temporarily set in the third state during the switching of the valve. However, for example, if the diesel engine 100 continuously performs low-temperature combustion, the switching valve 251 may be continuously set in the third state because exhaust gas contains substantially no carbon-containing particles during such a continuous low-temperature combustion state. It should be noted herein that the low-temperature combustion can be continuously performed during a low-load operation (idling or low-speed operation) after an engine warm-up operation.

M-3. MODIFICATION 3

In the foregoing embodiments, the downstream-side partial trunk passage 30*a*2 is formed so as to surround a portion of the loop passage 30*b* located near the first emission control portion 210 as shown in FIGS. 3(A) and 3(B). That is, the loop passage 30*b* is formed so as to intersect with the downstream-side partial trunk passage 30*a*2. However, the downstream-side partial trunk passage 30*a* 2 and the loop passage 30*b* may be formed so that the two passages do not intersect with each other. For example, the downstream-side partial trunk passage 30*a*2 may be formed on an upper side (+z direction side) or a lower side (−z direction side) of the loop passage 30*b* in FIG. 3(B).

However, in the construction as in the foregoing embodiments, the exhaust gas flowing through the downstream-side partial trunk passage 30*a*2 keeps first emission control portion 210 at a relatively high temperature, thereby achieving an advantage of allowing more efficient activation of the function of the active metal 218 supported by the first emission control portion 210.

M-4. MODIFICATION 4

Although in the foregoing embodiments, the two emission control portions 210, 220 incorporate a monolithic ceramic support as a support of the active components, the monolithic ceramic support may be replaced by a monolithic metal support. Furthermore, the second emission control portion 220 may incorporate a pellet-type ceramic support.

In the foregoing embodiments, the first emission control portion 210 removes or purifies carbon-containing particles and NOx present in exhaust gas, and the second emission control portion 220 removes or purifies NOx present in exhaust gas. That is, in the foregoing embodiments, both emission control portions are able to remove or purify NOx present in exhaust gas. Therefore, the first emission control portion 210 does not need to have the NOx purifying function. Furthermore, if the first emission control portion 210 has the NOx purifying function, the second emission control portion 220 may be loaded with an oxidation catalyst (e.g., platinum Pt or palladium Pd) that allows oxidation of reducing substances HC, CO present in exhaust gas into carbon dioxide and water (vapor).

Furthermore, although the foregoing embodiments include the second emission control portion 220, the second emission control portion 220 may be omitted.

Normally, it is appropriate for the emission control apparatus to incorporate the first emission control portion 210 that has a filter for occluding and controlling at least carbon-containing particles present in exhaust gas. The emission control apparatus may also incorporate another emission control portion for controlling at least a specific gaseous substance present in exhaust gas.

M-5. MODIFICATION 5

In the second embodiment, the control portion includes the two pressure sensors 121, 122, and injects the reducer when the differential pressure ΔP becomes equal to a predetermined target value. In the third embodiment, the control portion includes the pressure sensor 131, and injects the reducer when the back pressure PE becomes equal to a predetermined target value. The control portion may incorporate a flow meter capable of directly measuring the amount of flow of exhaust gas that flows in the first emission control portion 210, instead of the pressure sensors. In this case, it is appropriate for the control portion to inject the reducer when the amount of flow of exhaust gas becomes equal to a predetermined target value.

Normally, it is appropriate for the control portion to inject the reducer when the amount of exhaust gas that flows in the first emission control portion 210 during the switching of the switching valve becomes substantially equal to a predetermined amount. This manner of operation allows the reducer to be efficiently used for the recovery of the emission control function of the first emission control portion 210, and therefore makes it possible to reduce the amount of the reducer that needs to be injected for the recovery.

M-6. MODIFICATION 6

In the fourth embodiment, the control portion incorporates the two pressure sensor 121, 122, and stops the switching valve and injects the reducer when the differential pressure ΔP becomes equal to a predetermined target value. In the third embodiment, the control portion incorporates the pressure sensor 131, and stops the switching valve and injects the reducer when the back pressure PE becomes equal to a predetermined target value. The control portion may incorporate a flow meter capable of directly measuring the amount of flow of exhaust gas that flows in the first emission control portion 210, instead of the pressure sensors. In this case, it is appropriate for the control portion to stop the switching valve and inject the reducer when the amount of flow of exhaust gas becomes equal to a predetermined target value.

Normally, it is appropriate for the control portion to stop the switching valve and inject the reducer when the amount of exhaust gas that flows in the first emission control portion 210 during the switching of the switching valve becomes substantially equal to a predetermined amount. This manner of operation allows the reducer to be efficiently used for the recovery of the emission control function of the first emission control portion 210, and therefore makes it possible to reduce the amount of the reducer that needs to be injected for the recovery.

M-7. MODIFICATION 7

Although in the fourth embodiment, the switching valve is stopped at an intermediate point during the switching regardless of the switching direction of the switching valve, it is also possible to stop the switching valve only when the switching valve is switched from the first state to the second state as in the sixth embodiment (FIGS. 36(A) and 36(B)).

Normally, it is appropriate for the control portion to stop the switching valve at an intermediate point during the switching and inject the reducer at least in the case where the switching valve is switched from the first state to the second state. This manner of operation makes it possible to more accurately maintain a constant exhaust gas flow amount Q of the first emission control portion 210 at the time of injection of the reducer at least when the switching valve is switched from the first state to the second state.

M-8. MODIFICATION 8

Although in the foregoing embodiments, the control portion recovers the emission control function of the first emission control portion 210 by executing the various controls, the control may also execute other controls.

Furthermore, the controls may execute controls of a combination of any two or more of the foregoing embodiments.

Normally, it is appropriate for the control portion to recover the emission control function of an emission control portion regardless of the state of the switching valve prior to the switching, by adjusting at least one of the switching operation of the switching valve and the reducer injecting operation.

M-9. MODIFICATION 9

Although the foregoing embodiments are described in conjunction with the case where the emission control apparatus of the invention is applied to a diesel engine, the emission control apparatus of the invention may also be applied to other types of internal combustion engines, for example, a type of gasoline engine that directly injects gasoline into the combustion chambers, and the like.

Furthermore, the emission control apparatus of the invention may also be applied to various internal combustion engines for motor vehicles, ships, and the like, or for stationary use, etc.

That is, the emission control apparatus of the invention is applicable to internal combustion engines that have a combustion chamber.

M-10. MODIFICATION 10

Although in the foregoing embodiments, the first emission control portion 210 for occluding carbon-containing particles from exhaust gas is provided in the emission control unit 200, a filter for occluding carbon-containing particles may be provided in the exhaust passage 30 upstream of the emission control unit 200, in addition to the first emission control portion 210. This filter may be provided, for example, in each one of manifold branch pipes of the exhaust passage 30 connected to the four combustion chambers #1 to #4.

Although in the foregoing embodiments, the exhaust gas air-fuel ratio is shifted to the rich side by injecting the reducer in order to recover the emission control functions of the first and second emission control portions 210, 220, it is also possible to inject an additional amount of fuel into a combustion chamber during a latter half period of the expansion stroke or during the exhaust stroke of the engine, in addition to the injection of the reducer.

This modification advantageously reduces the frequency of the switching of the switching valve 251, the frequency of the reducer injecting operation of the reducer injection nozzles 261, 262, the injection amount of the reducer, etc.

M-11. MODIFICATION 11

In the tenth and eleventh embodiments, the reducer supplying portion 260 has the reducer injection nozzle 261, and injects the reducer into only the first partial loop passage **30*b*1. In the twelfth embodiment, the reducer supply portion 260 has the two reducer injection nozzles 261, 262, and injects the reducer into the two partial loop passages 30*b*1, 30*b*2**.

Normally, it is appropriate for the recovery agent supplying portion to supply a recovery agent into at least one of the first and second partial loop passages.

However, the construction as in the tenth and eleventh embodiments advantageously allows the reducer supplying portion 260 to be designed in a relatively simple fashion.

The constructions and advantages of the foregoing embodiments of the invention and the modifications thereof will be briefly stated.

The emission control apparatus is able to reverse the flow of exhaust gas through the emission control portion provided in a loop passage by changing the path of exhaust gas through the use of the switching valve. Therefore, the apparatus is able to purify the deposit of particulate substances in the emission control portion. Furthermore, the emission control apparatus is equipped with the recovery agent injection portion that injects a recovery agent for recovering the emission control function of the emission control portion into the first partial loop passage. Therefore, it becomes possible to recover the emission control function of the emission control apparatus independently of the operation condition of the internal combustion engine.

Furthermore, in this apparatus, the control portion is able to supply the recovery agent to the emission control portion regardless of the state of the switching valve prior to the switching thereof by adjusting at least one of the switching valve switching operation and the recovery agent injecting operation. Therefore, it becomes possible to recover the emission control function of the emission control portion regardless of the state of the switching valve prior to the switching of the valve.

The state of the switching valve prior to the switching of the valve means the first state in the case of the switching of the valve from the first state to the second state, and also means the second state in the case of the switching from the second state to the first state.

In the above-described emission control apparatus, the control portion may change the standby time elapsing from the switching valve switching start time point to the recovery agent injection start time point in accordance with the switching direction of the switching valve.

For example, it is appropriate to set the standby time shorter in the case where the switching valve switches from the first state to the second state than in the case where the switching valve switches from the second state to the first state. If the standby time is varied in accordance with the switching direction of the switching valve as described above, the recovery agent can be supplied to the emission control portion regardless of the state of the switching valve prior to the switching of the valve, so that the emission control function of the emission control portion can be recovered.

In the emission control apparatus, it is preferable that the standby time in the case where the switching valve switches from the first state to the second state be set as a time that elapses until a time point of the reversal of the flowing direction of exhaust gas, and that the standby time in the case where the switching valve switches from the second state to the first state be set as a time that elapses until a time point that coincides with or follows a time point immediately prior to the reversal of the flowing direction of exhaust gas.

This setting makes it possible to reliably supply the injected recovery agent to the emission control portion via flow of exhaust gas, regardless of the switching direction of the switching valve. Therefore, the emission control function of the emission control portion can be reliably recovered.

Furthermore, in the emission control apparatus, the control portion may change the standby time in accordance with the amount of flow of exhaust gas that occurs in the emission control portion prior to the switching of the switching valve.

For example, it is appropriate that the standby time in the case where the switching valve switches from the first state to the second state be set longer with increases in the amount of flow of exhaust gas that flows in the emissions control portion prior to the switching of the switching valve, and that the standby time in the case where the switching valve switches from the second state to the first state be set shorter with increases in the amount of flow of exhaust gas that flows in the emission control portion prior to the switching of the switching valve.

If the standby time is changed in accordance with the switching direction of the switching valve and the standby time is changed in accordance with the amount of flow of exhaust gas that flows in the emission control portion prior to the switching of the switching valve as described above, the recovery agent can be injected at a time point at which the amount of flow of exhaust gas that flows in the emission control portion becomes substantially equal to a predetermined amount, so that the emission control function of the emission control portion can be efficiently recovered.

Specifically, the control portion is able to change the standby time by using a parameter as follows: (1) the operation condition of the internal combustion engine, (2) the amount of air taken into the combustion chambers, (3) the amount of air taken into the combustion chambers, and the temperature of exhaust gas.

The use of such a parameter allows the control portion to easily change the standby time in accordance with the amount of flow of exhaust gas that flows in the emission control portion prior to the switching of the switching valve.

In the emission control apparatus, the control portion may cause the recovery agent to be injected when the amount of flow of exhaust gas flowing in the emission control portion becomes substantially equal to a predetermined amount at an intermediate point during the switching of the switching valve.

In some cases, an increase in the amount of flow of exhaust gas flowing in the emission control portion results in an insufficient utilization of the injected recovery agent for the recovery of the emission control function of the emission control portion. However, the above-described control portion realizes efficient utilization of the recovery agent for the recovery of the emission control function of the emission control portion, and therefore allows a reduction in the amount of the recovery agent that needs to be injected in order to recover the emission control function of the emission control portion.

In the emission control apparatus, the control portion may include two pressure measurement portions for measuring the pressure in the first partial loop passage, and the pressure in the second partial loop passage, and the control portion may cause the recovery agent to be injected when a difference between the two pressures becomes equal to a predetermined target value.

This construction of the control portion makes it possible to inject the recovery agent precisely in timing when the amount of flow of exhaust gas flowing in the emission control portion becomes substantially equal to a predetermined amount.

In the emission control apparatus, the control portion may include a pressure measurement portion for measuring the pressure in the trunk passage upstream of the path change portion, and may cause the recovery agent to be injected when the pressure becomes equal to a predetermined target value.

This construction also makes it possible to inject the recovery agent precisely in timing when the amount of flow of exhaust gas flowing in the emission control portion becomes substantially equal to a predetermined amount.

Specifically, the control portion may determine the aforementioned target value by using a parameter as follows: (1) the operation condition of the internal combustion engine, (2) the pressure prior to the switching of the switching valve, and the amount of air taken into the combustion chambers, (3) the pressure prior to the switching of the switching valve, and the temperature of exhaust gas, (4) the pressure prior to the switching of the switching valve, the amount of air taken into the combustion chambers, and the temperature of exhaust gas.

The use of such a parameter allows the control portion to relatively accurately determine a target value such tat the amount of flow of exhaust gas flowing in the emission control portion becomes substantially equal to a predetermined amount.

In the emission control apparatus, the aforementioned predetermined target value may be changed in accordance with the switching direction of the switching valve.

Therefore, it becomes possible to change the amount of flow of exhaust gas that flows in the emission control portion at the time of injection of the recovery agent, in accordance with the switching direction of the switching valve.

Furthermore, in the emission control apparatus, the control portion may stop the switching valve at an intermediate point in the course of switching of the valve, when the control portion causes the recovery agent to be injected.

This makes it possible to inject the recovery agent while the amount of flow of exhaust gas flowing in the emission control portion is kept substantially at a predetermined amount.

In the emission control apparatus, the control portion may stop the switching valve at an intermediate point in the switching of the switching valve and may cause the recovery agent to be injected, at least in the case where the switching valve is switched from the first state to the second state.

This makes it possible to inject the recovery agent while the amount of flow of exhaust gas flowing in the emission control portion is kept substantially at a predetermined amount, at least in the case where the switching valve is switched from the first state to the second state.

In the emission control apparatus, it is preferable that the control portion stop the switching valve when the amount of flow of exhaust gas flowing in the emission control portion becomes substantially equal to a predetermined amount at an intermediate point in the switching of the switching valve.

In some cases, an increase in the amount of flow of exhaust gas flowing in the emission control portion results in an insufficient utilization of the injected recovery agent for the recovery of the emission control function of the emission control portion. However, the above-described control portion realizes efficient utilization of the recovery agent for the recovery of the emission control function of the emission control portion, and therefore allows a reduction in the amount of the recovery agent that needs to be injected in order to recover the emission control function of the emission control portion.

In the emission control apparatus, the control portion may include two pressure measurement portions for measuring the pressure in the first partial loop passage, and the pressure in the second partial loop passage, and the control portion may stop the switching valve when a difference between the two pressures becomes equal to a predetermined target value.

This construction of the control portion makes it possible to inject the recovery agent while the amount of flow of exhaust gas flowing in the emission control portion is kept substantially at a predetermined amount.

In the emission control apparatus, the control portion may include a pressure measurement portion for measuring the pressure in the trunk passage upstream of the path change portion, and may stop the switching valve when the pressure becomes equal to a predetermined target value.

This construction also makes it possible to inject the recovery agent while the amount of flow of exhaust gas flowing in the emission control portion is kept substantially at a predetermined amount.

As mentioned above, the control portion may determine the aforementioned predetermined target value by using a parameter as follows: (1) the operation condition of the internal combustion engine, (2) the pressure prior to the switching of the switching valve, and the amount of air taken into the combustion chambers, (3) the pressure prior to the switching of the switching valve, and the temperature of exhaust gas, (4) the pressure prior to the switching of the switching valve, the amount of air taken into the combustion chambers, and the temperature of exhaust gas.

In the emission control apparatus, the control portion may stop the switching valve at an intermediate point in the switching of the switching valve regardless of the switching direction of the switching valve, and may change the predetermined target value in accordance with the switching direction of the switching valve.

Therefore, it becomes possible to change the exhaust gas flow amount maintained at the time of injection of the recovery agent, in accordance with the switching direction of the switching valve.

In the emission control apparatus, the control portion may change the switching operation of the switching valve in accordance with the switching direction of the switching valve, and may cause the recovery agent to be injected at the elapse of at least a predetermined time following the switching valve switching start time point, regardless of the switching direction of the switching valve.

This also makes it possible to supply the recovery agent to the emission control portion regardless of the state of the switching valve prior to the switching of the valve, so that the emission control function of the emission control portion can be recovered.

In the emission control apparatus, the control portion may change the switching speed of the switching valve in accordance with the switching direction of the switching valve.

For example, it is appropriate to set the switching speed of the switching valve lower in the case where the switching valve switches from the first state to the second state than in the case where the switching valve switches from the second state to the first state.

In the emission control apparatus, the control portion may stop the switching valve at an intermediate point in the switching of the switching valve, in at least the case where the switching valve is switched from the first state to the second state.

For example, it is appropriate to set the stop period of the switching valve longer in the case where the switching valve switches from the first state to the second state than in the case where the switching valve switches from the second state to the first state.

The stop period herein includes a stop period of "0" corresponding to the case where the switching of the switching valve is not stopped at an intermediate point.

If the switching speed or the stop period of the switching valve is changed in accordance with the switching direction of the switching valve as described above, the recovery agent injected can be supplied to the emission control portion regardless of the switching direction of the switching valve, even in the case where the recovery agent is injected at the elapse of at least a predetermined time following the switching valve switching start time point.

In the emission control apparatus, if the switching valve is in the first state prior to the switching of the switching valve, the control portion may cause the recovery agent to be injected at an intermediate point in the switching of the switching valve from the first state to the second state, and then may return the switching valve to the first state instead of shifting the switching valve to the second state.

This also makes it possible to recover the emission control function of the emission control portion regardless of the state of the switching valve prior to the switching of the valve.

In the emission control apparatus, the control portion may change the recovery agent injection condition by adjusting at least one of the recovery agent injection period and the recovery agent injection pressure of the recovery agent injection portion.

This makes it possible to appropriately execute the injection of the recovery agent, for example, in accordance with the switching direction of the switching valve, the state of exhaust gas, such as the air-fuel ratio of exhaust gas or the like, etc.

In the emission control apparatus, it is preferable that the control portion change the recovery agent injection condition in accordance with the switching direction of the switching valve.

For example, it is appropriate for the control portion to inject the recovery agent at the elapse of at least a predetermined time following the switching valve switching start time point, regardless of the switching direction of the switching valve, and to set the injection period shorter and set the injection pressure higher in the case where the switching valve switches from the first state to the second state than in the case where the switching valve switches from the second state to the first state.

This makes it possible to reliably supply the recovery agent to the emission control portion regardless of the switching direction of the switching valve, so that the emission control function of the emission control portion can be reliably recovered.

In the emission control apparatus, it is preferable that the control portion change the recovery agent injection condition so that the air-fuel ratio of exhaust gas flowing in the emission control portion becomes less than or equal to a predetermined value.

This makes it possible to more reliably recover the emission control function of the emission control portion, and to reduce the injection amount of the recovery agent.

Specifically, the control portion may determine the recovery agent injection condition by using a parameter as follows: (1) the operation condition of the internal combustion engine, (2) the amount of intake air taken into the combustion chambers, and the exhaust gas air-fuel ratio, (3) the exhaust gas air-fuel ratio, and information acquired from flow of exhaust gas in the emission control portion. The information acquired from flow of exhaust gas includes the amount of flow of exhaust gas, the pressure that changes depending on the amount of flow of exhaust gas, etc. If the exhaust gas air-fuel ratio is used as a parameter, it is appropriate for the control portion to incorporate an air-fuel ratio measurement portion for measuring the air-fuel ratio of exhaust gas in the trunk passage upstream of the path change portion.

This makes it possible to relatively accurately determine the recovery agent injection condition in accordance with the air-fuel ratio of exhaust gas.

In the emission control apparatus, the control portion may change the switching period of the switching valve in accordance with the load of the internal combustion engine.

For example, the control portion may change the switching period by changing the switching speed of the switching valve, and may set the switching speed relatively high if the load of the internal combustion engine is relatively high, and may set the switching speed relatively low if the load of the internal combustion engine is relatively low.

The control portion may also change the switching period of the switching valve by changing the stop period of the switching valve at an intermediate point in the switching of the valve, and may set the stop period relatively short if the load of the internal combustion engine is relatively high, and may set the stop period relatively long if the load of the internal combustion engine is relatively low.

The stop period includes a stop period of "0" corresponding to the case where the switching of the switching valve is not stopped at an intermediate point.

If the switching period of the switching valve is long, the amount of exhaust gas that is discharged into the atmosphere without passing through the loop passage, that is, without passing through the emission control portion, increases. Furthermore, if the load of the internal combustion engine is high, particulate substances are produced in large amounts in ordinary cases. The above-described operation makes it possible to purify the exhaust gas that is discharged into the atmosphere without passing through the emission control portion, if the load of the internal combustion engine is relatively high. As a result, it becomes possible to purify the amount of atmospheric pollutants in exhaust gas, such as particulate substances and the like, that is discharged into the atmosphere.

In the emission control apparatus, the emission control portion may recover or purify nitrogen oxides and particulate substances present in exhaust gas.

Therefore, the particulate substances and nitrogen oxides present in exhaust gas can be removed or purified. Thus, the emission control apparatus is suitable to diesel engines.

The emission control apparatus may further have another emission control portion that is provided in the trunk passage downstream of the path change portion, and that removes or purifies at least a specific gaseous substance present in exhaust gas.

In this construction, exhaust gas inevitably passes through the another emission control portion, so that exhaust gas can be further cleaned.

This invention can be realized in various fashions, for example, an emission control apparatus, an apparatus, such as a mobile body equipped with an emission control apparatus or the like, an emission control method, a computer program for realizing the function of the apparatus or the method, a record medium where the computer program is recorded, data signals which include the computer program and which are embodied in carrier waves.

In the emission control apparatus, it is preferable that the recovery agent supplying portion supply the recovery agent only to the first partial loop passage.

This makes it possible to relatively easily construct the recovery agent supplying portion.

In the emission control apparatus, it is preferable that a control portion for controlling the path change portion and the recovery agent supplying portion be provided, and that the control portion recover at least the emission control function of the first emission control portion by controlling the recovery agent supplying portion so as to supply the recovery agent into the first partial loop passage when the control portion controls the path change portion to set the switching valve so that there exists exhaust gas that flows through the first partial loop passage and the second partial loop passage in that order.

If the switching valve is set so that there exists exhaust gas that flows through the first partial loop passage and the second partial loop passage in that order, the recovery agent passes through the second emission control portion after passing through the first emission control portion. Therefore, the above-described control portion makes it possible to recover the emission control function of at least the first emission control portion.

At an intermediate point in the switching of the switching valve, the valve is set in a third state that allows exhaust gas to flow only through the trunk passage and prevents flow of exhaust gas in the loop passage. The state where "there exists exhaust gas that flows through the first partial loop passage and the second partial loop passage in that order" is realized in the case where the switching valve is set in the first state. The state is also realized in the case where the switching valve is set in an intermediate state between the third state and the first state during the switching of the valve from the second state to the first state.

While the switching valve is set in the aforementioned intermediate state, exhaust gas relatively slowly flows in the first partial loop passage. Therefore, exhaust gas within the first partial loop passage relatively slowly flows through the first emission control portion, and then gradually flows through the second emission control portion. Therefore, if the recovery agent is supplied when the switching valve is set in the aforementioned intermediate state, the amount of the recovery agent that needs to be supplied in order to sufficiently recover at least the emission control function of the first emission control portion can be advantageously reduced.

In the emission control apparatus, it is preferable that the control portion recover the emission control function of the second emission control portion by controlling the recovery agent supplying portion so as to supply the recovery agent into the first partial loop passage when the control portion controls the path change portion to set the switching valve so that there exists exhaust gas that flows through the second partial loop passage and the first partial loop passage in that order.

When the switching valve is set so that there exists exhaust gas that flows through the second partial loop passage and the first partial loop passage in that order, the recovery agent does not flows through the first emission control portion, but flows through the second emission control portion alone. Therefore, the above-described operation can recover only the emission control function of the second emission control portion. Furthermore, since the recovery agent can be supplied to the second emission control portion alone, sufficient recovery of the emission control function of the second emission control portion can be accomplished by a reduced amount of the recovery agent, in comparison with the case where sufficient recovery of the emission control functions of the first and second emission control portions are to be accomplished.

The state where "there exists exhaust gas that flows through the second partial loop passage and the first partial loop passage in that order" is realized in the case where the switching valve is set in the second state. The state is also realized in the case where the switching valve is set in an intermediate state between the third state and the second state during the switching of the valve from the first state to the second state.

In the emission control apparatus, it is preferable that the control portion set the amount of supply of the recovery agent at different amounts for the case where the switching valve is set so that there exists exhaust gas that flows through the first partial loop passage and the second partial loop passage in that order, and for the case where the switching valve is set so that there exists exhaust gas that flows through the second partial loop passage and the first partial loop passage in that order.

For example, the control portion recovers at least the emission control function of the first emission control portion by supplying the recovery agent when the switching valve is set in an intermediate state during the shift from the third state to the first state. In this case, exhaust gas relatively slowly flows through the first emission control portion. Furthermore, the control portion recovers the emission control function of the second emission control portion by supplying the recovery agent when the switching valve is set in the second state. In this case, exhaust gas flows through the second emission control portion relatively fast. This is become the trunk passage always conveys the entire amount of exhaust gas discharged from the combustion chambers regardless of the state of the switching valve. In many cases, a relatively increased amount of supply of the recovery agent is needed to sufficiently recover the emission control function of the second emission control portion, in which exhaust gas flows fast. Therefore, if the amount of supply of the recovery agent in variable as described above, it becomes possible to efficiently recover the emission control functions of the two emission control portions through the use of a relatively small amount of the recovery agent.

In the emission control apparatus, the first emission control portion may remove or purify nitrogen oxides and particulate substances present in the exhaust gas, and the second emission control portion may remove or purify nitrogen oxides present in the exhaust gas.

Therefore, the emission control apparatus is able to significantly purify the nitrogen oxides and the particulate substances present in exhaust gas, and is therefore suitable for diesel engines.

While the invention has been described with reference to what are presently considered to be preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the invention.

What is claimed is:

1. An emission control apparatus that is applied to an internal combustion engine having a combustion chamber, and that controls emissions discharged from the combustion chamber, the emission control apparatus comprising:

an exhaust passage that conveys an emissions discharged from the combustion chamber, and that includes a trunk passage, and a loop passage having a first partial loop passage and a second partial loop passage that branch from the trunk passage;

a path change portion that is provided in a connecting portion between the trunk passage and the loop passage, and that includes a switching valve that is set in a first state where emissions in the loop passage flows through the first partial loop passage and the second partial loop passage in that order, and is set in a second state where emissions in the loop passage flows through the second partial loop passage and the first partial loop passage in that order;

a first emission control portion that is provided in the loop passage, and that has a filter that occludes and purifies at least a particulate substance present in the emissions, one side face of the filter communicating with the first partial loop passage, and another side face of the filter communicating with the second partial loop passage;

a second emission control portion that is provided in the trunk passage downstream of the path change portion, and that purifies at least a specific gaseous substance present in the emissions;

a recovery agent injection portion that injects a recovery agent which recover an emission control function of the first emission control portion and an emission control function of the second emission control portion, into at least one of the first partial loop passage and the second partial loop passage; and a control portion that recovers the emission control functions of the emission control portions by adjusting at least one of a switching operation of the switching valve and an injecting operation of the recovery agent injection portion.

2. The emission control apparatus according to claim 1, wherein the control portion changes a standby time that elapses from a switching valve switching start time point to a recovery agent injection start time point in accordance with a switching direction of the switching valve.

3. The emission control apparatus according to claim 2, wherein the standby time in a case where the switching valve switches from the first state to the second state is set as a time that elapses until a time portion of a reversal of a flowing direction of the emissions, and wherein the standby time in a case where the switching valve switches from the second state to the first state is set as a time that elapses until a time point that coincides with or follows a time point immediately prior to a reversal of the flowing direction of the emissions.

4. The emission control apparatus according to claim 2, wherein the control portion changes the standby time in accordance with an amount of emissions that flows in the emission control portion prior to the switching of the switching valve.

5. The emission control apparatus according to claim 4, wherein the standby time in the case where the switching valve switches from the first state to the second state is set longer with increases in the amount of emissions that flows in the emission control portion prior to the switching of the switching valve, and wherein the standby time in the case where the switching valve switches from the second state to the first state is set shorter with increases in the amount of emissions that flows in the emission control portion prior to the switching of the switching valve.

6. The emission control apparatus according to claim 2, wherein the control portion changes the standby time in accordance with an operation condition of the internal combustion engine.

7. The emission control apparatus according to claim 2, wherein the control portion changes the standby time in accordance with an amount of air taken into the combustion chamber.

8. The emission control apparatus according to claim 2, wherein the control portion changes the standby time in accordance with an amount of air taken into the combustion chamber, and a temperature of the emissions.

9. The emission control apparatus according to claim 1, wherein the control portion causes the recovery agent to be injected when an amount of emissions flowing in the emission control portion becomes substantially equal to a predetermined amount during the switching of the switching valve.

10. The emission control apparatus according to claim 9, further comprising a first pressure measurement portion that measures a first pressure in the first partial loop passage and a second pressure measurement portion that measures a second pressure in the second partial loop passage, wherein the control portion causes the recovery agent to be injected when a difference between the first pressure and the second pressure becomes equal to a predetermined target value.

11. The emission control apparatus according to claim 10, wherein the predetermined target value is changed in accordance with a switching direction of the switching valve.

12. The emission control apparatus according to claim 9, further comprising a pressure measurement portion that measures a pressure in the trunk passage upstream of the path change portion, wherein the control portion causes the recovery agent to be injected when the pressure becomes equal to a predetermined target value.

13. The emission control apparatus according to claim 12, wherein the control portion determines the predetermined target value in accordance with an operation condition of the internal combustion engine.

14. The emission control apparatus according to claim 12, wherein the control portion determines the predetermined target value in accordance with the pressure prior to the switching of the switching valve, and an amount of air taken into the combustion chamber.

15. The emission control apparatus according to claim 12, wherein the control portion determines the predetermined target value in accordance with the pressure prior to the switching of the switching valve, and a temperature of the emissions.

16. The emission control apparatus according to claim 12, wherein the control portion determines the predetermined target value in accordance with the pressure prior to the switching of the switching valve, an amount of air taken into the combustion chamber, and a temperature of the emissions.

17. The emission control apparatus according to claim 9, wherein the control portion stops switching of the switching valve during switching when the control portion causes the recovery agent to be injected.

18. The emission control apparatus according to claim 1, wherein the control portion stops switching of the switching valve during switching and causes the recovery agent to be injected, at least in a case where the switching valve is switched from the first state to the second state.

19. The emission control apparatus according to claim 18, wherein the control portion stops switching of the switching valve when an amount of flow of emissions flowing in the emission control portion becomes substantially equal to a predetermined amount at an intermediate point in the switching of the switching valve.

20. The emission control apparatus according to claim 19, further comprising a first pressure measurement portion that measures a first pressure in the first partial loop passage and a second pressure measurement portion that measures a second pressure in the second partial loop passage, wherein the control portion stops switching of the switching valve when a difference between the first pressure and the second pressure becomes equal to a predetermined target value.

21. The emission control apparatus according to claim 20, wherein the control portion stops switching of the switching valve at the intermediate point in the switching of the switching valve regardless of a switching direction of the switching valve, and wherein the predetermined target value is changed in accordance with the switching direction of the switching valve.

22. The emission control apparatus according to claim 19, further comprising a pressure measurement portion that measures a pressure in the trunk passage upstream of the path change portion, wherein the control portion stops switching of the switching valve when the pressure becomes equal to a predetermined target value.

23. The emission control apparatus according to claim 1, wherein the control portion changes a switching operation of the switching valve in accordance with a switching direction of the switching valve, and causes the recovery agent to be injected at the elapse of a predetermined time following a switching valve switching start time point, regardless of the switching direction of the switching valve.

24. The emission control apparatus according to claim 23, wherein the control portion changes a switching speed of the switching valve in accordance with the switching direction of the switching valve.

25. The emission control apparatus according to claim 24, wherein the switching speed of the switching valve is set lower in a case where the switching valve switches from the first state to the second state than in a case where the switching valve switches from the second state to the first state.

26. The emission control apparatus according to claim 23, wherein the control portion stops switching of the switching valve at an intermediate point in the switching of the switching valve, in at least the case where the switching valve is switched from the first state to the second state.

27. The emission control apparatus according to claim 26, wherein the stop period of the switching valve is set longer in the case where the switching valve switches from the first state to the second state than in the case where the switching valve switches from the second state to the first state.

28. The emission control apparatus according to claim 1, wherein if the switching valve is in the first state prior to the switching of the switching valve, the control portion causes the recovery agent to be injected at an intermediate point in the switching of the switching valve from the first state to the second state, and then returns the switching valve to the first state instead of shifting the switching valve to the second state.

29. The emission control apparatus according to claim 1, wherein the control portion adjusts at least one of a recovery agent injection period and a recovery agent injection pressure of the recovery agent injection portion.

30. The emission control apparatus according to claim 29, wherein the control portion changes at least one of the recovery agent injection period and the recovery agent injection pressure in accordance with a switching direction of the switching valve.

31. The emission control apparatus according to claim 30, wherein the control portion causes the recovery agent to be injected at the elapse of a predetermined time following a switching valve switching start time point, regardless of a switching direction of the switching valve, and wherein the control portion sets the injection period shorter and sets the injection pressure higher in a case where the switching valve switches from the first state to the second state than in a case where the switching valve switches from the second state to the first state.

32. The emission control apparatus according to claim 29, wherein the control portion changes a recovery agent injection condition so that an air-fuel ratio of emissions flowing in the emission control portion becomes less than equal to a predetermined value.

33. The emission control apparatus according to claim 32, wherein the control portion determines a recovery agent injection condition in accordance with the engine operation condition.

34. The emission control apparatus according to claim 32, further comprises an air-fuel ratio measurement portion that measures the air-fuel ratio of emissions in the trunk passage upstream of the path change portion, wherein the control portion determines a recovery agent injection condition in accordance with the use of the amount of intake air taken into the combustion chambers, and air-fuel ratio of emissions.

35. The emission control apparatus according to claim 32, further comprising an air-fuel ratio measurement portion that measures the air-fuel ratio of emissions in the trunk passage upstream of the path change portion, wherein the control portion determines a recovery agent injection condition in accordance with the air-fuel ratio of emissions, and information acquired from a flow of emissions that flows in the emission control portion.

36. The emission control apparatus according to claim 1, wherein the control portion changes a switching period of the switching valve in accordance with a load of the internal combustion engine.

37. The emission control apparatus according to claim 36 wherein the control portion changes the switching period by changing a switching speed of the switching valve, and wherein a first switching speed corresponding to a first load of the internal combustion engine is set lower than a second switching speed corresponding to a second load of the internal combustion engine that is greater than the first load.

38. The emission control apparatus according to claim 36 wherein the control portion temporarily stops switching of the switching valve in the switching of the switching valve, and changes the switching period of the switching valve by changing a stop period of the valve, and wherein a first switching period corresponding to a first load of the internal combustion engine is set longer than a second switching period corresponding to a second load of the internal combustion engine that is greater than the first load.

39. The emission control apparatus according to claim 1, wherein the recovery agent injection portion supplies the recovery agent solely into the first partial loop passage.

40. The emission control apparatus according to claim 39, wherein the control portion recovers at least the emission control function of the first emission control portion by controlling the recovery agent injection portion so as to supply the recovery agent into the first partial loop passage when the control portion controls the path change portion to set the switching valve so that there exists emissions that flows through the first partial loop passage and the second partial loop passage in that order.

41. The emission control apparatus according to claim 40, wherein the control portion recovers the emission control function of the second emission control portion by controlling the recovery agent injection portion so as to supply the recovery agent into the first partial loop passage when the control portion controls the path change portion to set the switching valve so that there exists emissions that flows through the second partial loop passage and the first partial loop passage in that order.

42. The emission control apparatus according to claim 41, wherein the control portion sets different amounts of supply of the recovery agent for a case where the switching valve is set so that there exists emissions that flows through the first partial loop passage and the second partial loop passage in that order, and for a case where the switching valve is set so that there exists emissions that flows through the second partial loop passage and the first partial loop passage in that order.

43. The emission control apparatus according to claim 1, wherein the first emission control portion purifies a nitrogen oxide and the particulate substance present in the emissions, and wherein the second emission control portion purifies a nitrogen oxide present in the emissions.

* * * * *